US009885486B2

(12) United States Patent
Wintemute

(10) Patent No.: US 9,885,486 B2
(45) Date of Patent: Feb. 6, 2018

(54) HEAT PUMP HUMIDIFIER AND DEHUMIDIFIER SYSTEM AND METHOD

(75) Inventor: David Martin Wintemute, Montreal (CA)

(73) Assignee: Nortek Air Solutions Canada, Inc., Saskatoon (CA)

( * ) Notice: Subject to any disclaimer, the term of this patent is extended or adjusted under 35 U.S.C. 154(b) by 1345 days.

(21) Appl. No.: 13/275,633

(22) Filed: Oct. 18, 2011

(65) Prior Publication Data

US 2012/0085112 A1 Apr. 12, 2012

Related U.S. Application Data

(63) Continuation-in-part of application No. 12/870,545, filed on Aug. 27, 2010.

(51) Int. Cl.
*F25D 17/06* (2006.01)
*F24F 3/147* (2006.01)
(Continued)

(52) U.S. Cl.
CPC ..... *F24F 3/147* (2013.01); *F25B 49/02* (2013.01); *F24F 2203/026* (2013.01); *F24F 2203/10* (2013.01); *F25B 13/00* (2013.01)

(58) Field of Classification Search
CPC .. F25D 21/00; F25D 21/12; F24F 3/14; F24F 3/147; F24F 12/003; F24F 2003/1446;
(Continued)

(56) References Cited

U.S. PATENT DOCUMENTS 2,186,844 A 1/1940 Smith
2,562,811 A 7/1951 Muffly
(Continued)

FOREIGN PATENT DOCUMENTS

CN 101701739 A 5/2010
CN 101900378 A 12/2010
(Continued)

OTHER PUBLICATIONS

"Performance analysis of a liquid desiccant and membrane contactor hybrid air-conditioning system," Bergero, Chiari, Energy and Buildings, 2010.

(Continued)

*Primary Examiner* — Elizabeth Martin
(74) *Attorney, Agent, or Firm* — Schwegman Lundberg & Woessner, P.A.

(57) ABSTRACT

A heat pump system for conditioning air supplied to a space is provided. The system includes a pre-processing module that pre-conditions supply air. A supply air heat exchanger is in flow communication with the pre-processing module. The supply air heat exchanger receives air from the pre-processing module and at least one of heats or cools the air from the pre-processing module. A processing module is in flow communication with the supply air heat exchanger. The processing module receiving and conditioning air from the supply air heat exchanger. A regeneration air heat exchanger is provided to at least one of heat or cool regeneration air. The regeneration air heat exchanger and the supply air heat exchanger are fluidly coupled by a refrigerant system.

37 Claims, 44 Drawing Sheets

(51) Int. Cl.
*F25B 49/02* (2006.01)
*F25B 13/00* (2006.01)

(58) Field of Classification Search
CPC ..... F24F 2003/1458; F24F 2203/1084; F24F 2203/1088; F25B 15/00; Y02B 30/62
USPC ..... 62/80, 91–93, 271, 282, 324.5
See application file for complete search history.

(56) References Cited

U.S. PATENT DOCUMENTS 2,946,201 A 7/1960 Munters
2,968,165 A 1/1961 Norback
3,009,684 A 11/1961 Munters
3,247,679 A 4/1966 Meckler
3,401,530 A 9/1968 Meckler
4,113,004 A 9/1978 Rush et al.
4,180,985 A 1/1980 Northrup, Jr.
4,235,081 A 11/1980 Dowling
4,474,021 A * 10/1984 Harband ..... F24F 3/1423 62/271
4,594,860 A 6/1986 Coellner et al.
4,719,761 A 1/1988 Cromer
4,729,774 A 3/1988 Cohen et al.
4,887,438 A 12/1989 Meckler
4,903,503 A 2/1990 Meckler
4,936,107 A 6/1990 Kitagaki et al.
4,982,575 A 1/1991 Besik
5,003,961 A 4/1991 Besik
5,148,374 A 9/1992 Coellner
5,170,633 A 12/1992 Kaplan
5,176,005 A 1/1993 Kaplan
5,325,676 A 7/1994 Meckler
5,337,574 A * 8/1994 Dick ..... 62/89
5,351,497 A 10/1994 Lowenstein
5,353,606 A 10/1994 Yoho et al.
5,373,704 A 12/1994 McFadden
5,448,895 A * 9/1995 Coeliner et al. ..... 62/94
5,496,397 A 3/1996 Fischer et al.
5,502,975 A 4/1996 Brickley et al.
5,517,828 A 5/1996 Calton et al.
5,526,651 A 6/1996 Worek et al.
5,542,968 A 8/1996 Belding
5,551,245 A 9/1996 Calton et al.
5,564,281 A 10/1996 Calton et al.
5,579,647 A 12/1996 Calton et al.
5,580,369 A 12/1996 Belding
5,632,954 A 5/1997 Coellner et al.
5,638,900 A 6/1997 Lowenstein
5,649,428 A 7/1997 Calton et al.
5,650,221 A 7/1997 Belding
5,660,048 A 8/1997 Belding
5,685,897 A 11/1997 Belding
5,701,762 A 12/1997 Akamatsu et al.
5,727,394 A 3/1998 Belding
5,749,230 A 5/1998 Coellner et al.
5,758,508 A 6/1998 Belding
5,761,915 A 6/1998 Rao
5,761,923 A 6/1998 Maeda
5,791,153 A 8/1998 Belding
5,816,065 A 10/1998 Macda
5,825,641 A 10/1998 Mangtani
5,826,434 A 10/1998 Belding
5,860,284 A 1/1999 Goland
5,890,372 A 4/1999 Belding
5,931,016 A 8/1999 Yoho, Sr.
5,943,874 A 8/1999 Macda
5,992,160 A 11/1999 Bussjager et al.
6,003,327 A 12/1999 Belding
6,018,953 A 2/2000 Belding
6,029,462 A 2/2000 Denniston
6,029,467 A 2/2000 Moratalla
6,050,100 A 4/2000 Belding
6,079,481 A 6/2000 Lowenstein
6,094,835 A 8/2000 Cromer
6,141,979 A 11/2000 Dunlap
6,178,762 B1 1/2001 Flax
6,199,388 B1 * 3/2001 Fischer, Jr. ..... 62/90
6,199,392 B1 3/2001 Maeda
6,237,354 B1 5/2001 Cromer
6,176,101 B1 6/2001 Lowenstein
6,247,323 B1 6/2001 Maeda
6,269,650 B1 8/2001 Shaw
6,318,106 B1 11/2001 Maeda
RE37,464 E 12/2001 Meckler
6,363,218 B1 3/2002 Lowenstein
6,442,951 B1 9/2002 Maeda et al.
6,568,466 B2 5/2003 Lowenstein
6,575,228 B1 6/2003 Ragland et al.
6,644,059 B2 11/2003 Maeda et al.
6,720,990 B1 4/2004 Walker et al.
6,745,826 B2 6/2004 Lowenstein
6,751,964 B2 6/2004 Fischer
6,848,265 B2 2/2005 Lowenstein
6,918,263 B2 7/2005 Lee et al.
6,973,795 B1 12/2005 Moffitt
7,013,655 B2 3/2006 Des Champs
7,017,356 B2 3/2006 Moffitt
7,092,006 B2 8/2006 Walker et al.
7,178,355 B2 2/2007 Moffitt
7,231,967 B2 6/2007 Haglid
7,269,966 B2 9/2007 Lowenstein
7,306,650 B2 12/2007 Slayzak
7,340,906 B2 3/2008 Moffitt
7,389,646 B2 6/2008 Moffitt
7,593,033 B2 9/2009 Walker et al.
7,602,414 B2 10/2009 Walker et al.
7,605,840 B2 10/2009 Walker et al.
7,719,565 B2 5/2010 Walker et al.
7,817,182 B2 10/2010 Walker et al.
7,966,841 B2 6/2011 Lowenstein
8,915,092 B2 12/2014 Gerber et al.
2002/0129614 A1 9/2002 Dinnage et al.
2004/0134211 A1 7/2004 Lee et al.
2005/0262862 A1 12/2005 Moffitt
2007/0095519 A1 5/2007 Hombucher
2010/0170655 A1 7/2010 Kronvall et al.
2010/0242507 A1 * 9/2010 Meckler ..... 62/94
2010/0307175 A1 * 12/2010 Teige et al. ..... 62/94
2010/0319370 A1 12/2010 Kozubal
2011/0308265 A1 * 12/2011 Phannavong et al. ..... 62/160
2012/0047923 A1 3/2012 Wintemute et al.
2012/0125020 A1 5/2012 Vandermeulen
2012/0125021 A1 5/2012 Vandermeulen
2012/0125031 A1 5/2012 Vandermeulen
2012/0125405 A1 5/2012 Vandermeulen
2012/0125581 A1 5/2012 Allen
2012/0131934 A1 5/2012 Vandermeulen
2012/0131937 A1 5/2012 Vandermeulen
2012/0131938 A1 5/2012 Vandermeulen
2012/0131939 A1 5/2012 Vandermeulen
2012/0131940 A1 5/2012 Vandermeulen
2012/0132513 A1 5/2012 Vandermeulen
2012/0180505 A1 7/2012 Gerber et al.
2012/0186281 A1 7/2012 Vandermeulen

FOREIGN PATENT DOCUMENTS

CN 105202795 A 12/2015
EP 2397787 A2 12/2011
GB 2015384 A 9/1979
JP 05157282 A 6/1993
JP 07310964 A 11/1995
JP 09196482 A 7/1997
JP 2004257588 A 9/2004
JP 2006308241 A 11/2006
JP 2006336999 A 12/2006
JP 2008304150 A 12/2008
WO WO 1996 41107 12/1996
WO WO 1999 14535 3/1999
WO WO-0171260 A1 9/2001
WO WO-2009000974 A1 12/2008
WO WO-2012097445 A1 7/2012

(56) References Cited

FOREIGN PATENT DOCUMENTS

OTHER PUBLICATIONS

AAONAIRE Energy Recovery Units Users Information Manual.
Acker; "Industrial Dehumidification: Water Vapor Load Calculations and System Descriptions"; HPAC Heating/Piping/Air Conditioning; Mar. 1999; pp. 49-59.
ASHRAE Technical Committee; Meeting Programs; Jan. 29, 1997 to Jan. 25, 2001 (13 pages).
Bellia et al.; "Air Conditioning Systems With Desiccant Wheel for Italian Climates"; International Journal on Architectural Science; vol. 1; No. 4; 2000; (pp. 193-213).
Chant et al.; "A Steady-State Simulation of an Advanced Desiccant-Enhanced Cooling and Dehumidification System"; ASHRAE Transactions: Research; Jul. 1992; pp. 339-347.
Coad; "Conditioning Ventilation Air for Improved Performance and Air Quality"; HPAC Heating/Piping/Air Conditioning; Sep. 1999; pp. 49-56.
DES Champs Laboratories, Inc.; "Dehumidification Solutions"; 2001; (18 pages).
DES Champs Technologies; "Desi-Wringer™ Precision Desiccant Dehumidification Systems"; 2007; (12 pages).
DiBlasio; "Desicants in Hospitals—Conditioning a Research Facility"; Engineered Systems; Sep. 1995; (4 pages).
Downing et al.; "Operation and Maintenance for Quality Indoor Air"; Proceedings of the 7$^{th}$ Symposium on Improving Building Systems in Hot and Humid Climates, Ft. Worth, TX; Oct. 9-10, 1990; (5 pages).
Downing; "Humidity Control—No Place Like Home"; Engineered Systems; 1996; (4 pages).
Federal Technology Alert; "Two-Wheel Desiccant Dehumidification System—Technology for Dehumidification and Improving Indoor Air Quality"; Apr. 1997 (24 pages).
Fischer; "Active Desiccant Dehumidification Module Integration With Rooftop Packaged HVAC Units—Final Report Phase 3B"; Oak Ridge National Laboratory; Mar. 2002; (36 pages).
Fischer; "Optimizing IAQ, Humidity Control, and Energy Efficiency in School Environments Through the Application of Desiccant-Based Total Energy Recovery Systems"; IAQ 96/Paths to Better Building Environments/Environmental Effects on Health and Productivity; Date unknown (pp. 179-194).
Harriman, III et al.; "Dehumidification and Cooling Loads From Ventilation Air"; ASHRAE Journal; Nov. 1997; (pp. 37-45).
Harrimann, III et al.; "New Weather Data for Energy Calculations"; ASHRAE Journal; Mar. 1999; (pp. 31-38).
Harriman, III et al.; "Evaluating Active Desiccant Systems for Ventilating Commercial Buildings"; ASHRAE Journal; Oct. 1999; (pp. 25-34).
"Heating, Ventilating, and Air Conditioning (HVAC) Demonstration"; Chapter 8—HVAC Demonstration; (pp. 65-77 and 157-158).
Jeong et al.; "Energy Conservation Benefits of a Dedicated Outdoor Air System with Parallel Sensible Cooling by Ceiling Radiant Panels"; ASHRAE Transactions; vol. 109; Part 2; 2003; (10 pages).
Kosar et al.; "Dehumidification Issues of Standard 62-1989"; ASHARE Journal; Mar. 1998; (pp. 71-75).
MC Gahey; "New Commercial Applications for Desiccant-Based Cooling"; ASHARE Journal; Jul. 1998; (pp. 41-45).
MC Gahey et al.; "Desiccants: Benefits for the Second Century of Air Conditioning"; Proceedings of the Tenth Symposium on Improving Building Systems in Hot and Humid Climates, Ft. Worth, Texas; May 13-14, 1996 (9 pages).
Mumma et al.; "Achieving Dry Outside Air in an Energy-Efficient Manner"; ASHRAE Transactions 2001; vol. 107; Part 1; (8 pages).
Mumma; "Dedicated Outdoor Air-Dual Wheel System Control Requirements"; ASHRAE Transactions 2001; vol. 107; Part 1; (9 pages).
Mumma et al.; "Extension of the Multiple Spaces Concept of ASHRAE Standard 62 to Include Infiltration, Exhaust/Exfiltration, Interzonal Transfer, and Additional Short-Circuit Paths"; ASHRAE Transactions: Symposia; Date Unknown; (pp. 1232-1241).
Mumma; "Overview of Integrating Dedicated Outdoor Air Systems With Parallel Terminal Systems"; ASHRAE Transactions 2001; vol. 107; Part 1; (7 pages).
Nimmo et al.; "DEAC: Desiccant Enhancement of Cooling-Based Dehumidification"; ASHRAE Transactions: Symposia; Date Unknown; (pp. 842-848).
Qin et al.; "Engine-driven Desiccant-assisted Hybrid Air-conditioning System"; 23$^{rd}$ World Gas Conference, Amsterdam 2006 (15 pages).
Scofield et al.; "HVAC Design for Classrooms: Divide and Conquer"; Heating/Piping/Air Conditioning; May 1993 (pp. 53-59).
"Energy Recovery—Fresh in Air Quality"; SEMCO Inc.; Date Unknown (131 pages).
Sevigny et al.; "Air Handling Unit Direct Digital Control System Retrofit to Provide Acceptable Indoor Air Quality and Global Energy Optimization"; Energy Engineering; vol. 94; No. 5; 1997; (pp. 24-43).
Shank et al.; "Selecting the Supply Air Conditions for a Dedicated Outdoor Air System Working in Parallel with Distributed Sensible Cooling Terminal Equipment"; ASHRAE Transactions 2001; vol. 107; Part 1; (10 pages).
Smith et al.; "Outdoor Air, Heat Wheels and JC Penny: A New Approach to Retail Ventilation"; Proceedings of the Eleventh Symposium on Improving Building Systems in Hot and Humid Climates, Ft. Worth, Texas; Jun. 1-2, 1998 (pp. 311).
Smith; "Schools Resolve IAQ/Humidity Problems with Desiccant Preconditioning"; Heating/Piping/Air Conditioning; Apr. 1996; (6 pages).
Swails et al.; "A Cure for Growing Pains"; www.csermag.com; Consulting Specifying Engineer; Jun. 1997 (4 pages).
"Advances in Desiccant-Based Dehumidification"; TRANE Engineers Newsletter; vol. 34-4; Date Unknown; (pp. 1-8).
Turpin; "Dehumidification: The Problem No One Wants to Talk About (Apr. 2000)"; http//www.esmagazine.com/copyright/de12c1c879ba8010VgnVCM100000f932a8c0_?. . . ; May 6, 2011 (6 pages).
Yborra; "Field Evaluation of Desiccant-Integrated HVAC Systems: A Review of Case Studies in Multiple Commercial/Institutional Building Types"; Proceedings of the Eleventh Symposium on Improving Building Systems in Hot and Humid Climates, Ft. Worth, Texas; Jun. 1-2, 1998;(pp. 361-370).
"AAONAIRE Energy Recovery Units Users Information Manual", (Aug. 2006), 16 pgs.
"U.S. Appl. No. 12/870,545, Advisory Action dated Jan. 24, 2014", 3 pgs.
"U.S. Appl. No. 12/870,545 Appeal Brief filed Mar. 26, 2014", 29 pgs.
"U.S. Appl. No. 12/870,545, Appeal Decision dated Nov. 14, 2016", 12 pgs.
"U.S. Appl. No. 12/870,545, Corrected Notice of Allowance dated Mar. 14, 2017", 7 pgs.
"U.S. Appl. No. 12/870,545, Corrected Notice of Allowance dated Mar. 23, 2017", 7 pgs.
"U.S. Appl. No. 12/870,545, Examiner's Answer to Appeal Brief dated Jul. 31, 2014", 12 pgs.
"U.S. Appl. No. 12/870,545, Final Office Action dated Nov. 21, 2013", 15 pgs.
"U.S. Appl. No. 12/870,545, Non Final Office Action dated Jul. 2, 2013", 13 pgs.
"U.S. Appl. No. 12/870,545, Notice of Allowance dated Feb. 27, 2017", 9 pgs.
"U.S. Appl. No. 12/870,545, Notice of Allowance dated May 18, 2017", 9 pgs.
"U.S. Appl. No. 12/870,545, Preliminary Amendment filed Feb. 15, 2011", 12 pgs.
"U.S. Appl. No. 12/870,545, Preliminary Amendment filed Jul. 21, 2011", 9 pgs.
"U.S. Appl. No. 12/870,545, Preliminary Amendment filed Sep. 26, 2011", 8 pgs.
"U.S. Appl. No. 12/870,545, Reply Brief filed Aug. 20, 2014", 19 pgs.
"U.S. Appl. No. 12/870,545, Response filed Jul. 31, 2013 to Non Final Office Action dated Jul. 2, 2013", 13 pgs.

(56) References Cited

OTHER PUBLICATIONS

"U.S. Appl. No. 12/870,545, Response filed Dec. 19, 2013 to Final Office Action dated Nov. 21, 2013", 13 pgs.
"U.S. Appl. No. 13/350,902, Appeal Brief filed Apr. 4, 2014", 24 pgs.
"U.S. Appl. No. 13/350,902, Appeal Decision dated Sep. 30, 2016", 6 pgs.
"U.S. Appl. No. 13/350,902, Examiner's Answer dated Jun. 16, 2014", 17 pgs.
"U.S. Appl. No. 13/350,902, Final Office Action dated Dec. 30, 2013", 13 pgs.
"U.S. Appl. No. 13/350,902, Non Final Office Action dated Oct. 1, 2013", 13 pgs.
"U.S. Appl. No. 13/350,902, Notice of Allowance dated Mar. 1, 2017", 7 pgs.
"U.S. Appl. No. 13/350,902, Notice of Allowance dated Jun. 22, 2017", 7 pgs.
"U.S. Appl. No. 13/350,902, Notice of Allowance dated Nov. 9, 2016", 9 pgs.
"U.S. Appl. No. 13/350,902, Reply Brief filed Jul. 8, 2014", 9 pgs.
"U.S. Appl. No. 13/350,902, Response filed Aug. 5, 2013 to Restriction Requirement dated Jul. 23, 2013", 2 pgs.
"U.S. Appl. No. 13/350,902, Response filed Oct. 29, 2013 to Non Final Office Action dated Oct. 1, 2013", 15 pgs.
"U.S. Appl. No. 13/350,902, Restriction Requirement dated Jul. 23, 2013", 8 pgs.
"U.S. Appl. No. 14/186,420, Notice of Allowance dated Jan. 27, 2017", 7 pgs.
"U.S. Appl. No. 14/186,420, Notice of Allowance dated May 31, 2017", 7 pgs.
"Australian Application Serial No. 2012208921, First Examiner Report dated Jun. 2, 2016", 7 pgs.
"Chinese Application Serial No. 201280006006.9, Office Action dated Feb. 2, 2016", (w/ English Summary), 19 pgs.
"Chinese Application Serial No. 201280006006.9, Response filed Apr. 8, 2016 to Office Action dated Feb. 2, 2016", (w/ English Translation of Claims), 64 pgs.
"Chinese Application Serial No. 201280006006.9, Voluntary Amendment filed Apr. 14, 2014", 61 pgs.
"Chinese Application Serial No. 201280006006.9, Decision of Rejection dated May 4, 2017", w/ summary in English, 7 pgs.
"Chinese Application Serial No. 201280006006.9, Office Action dated May 13, 2015", 3 pgs.
"Chinese Application Serial No. 201280006006.9, Office Action dated Aug. 15, 2016", (English Translation), 18 pgs.
"Chinese Application Serial No. 201280006006.9, Response filed Sep. 28, 2015 to Office Action dated May 13, 2015", (w/ English Translation of Claims), 71 pgs.
"Chinese Application Serial No. 201280006006.9, Response filed Dec. 30, 2016 to Office Action dated Aug. 15, 2016", (w/ English Translation of Claims), 69 pgs.
"Chinese Application Serial No. 201510655570.9, Office Action dated Apr. 1, 2017", (w/ English Translation), 14 pgs.
"European Application Serial No. 12736074.1, Communication Pursuant to Article 94(3) EPC dated Feb. 9, 2017", 4 pgs.
"European Application Serial No. 12736074.1, Extended European Search Report dated Jul. 13, 2015", 8 pgs.
"European Application Serial No. 12736074.1, Response filed Oct. 2, 2015 to Extended European Search Report dated Jul. 13, 2015", 10 pgs.
"International Application Serial No. PCT/CA2012/000055, International Preliminary Report on Patentability dated Aug. 1, 2013", 9 pgs.
"International Application Serial No. PCT/CA2012/000055, International Search Report dated May 24, 2012", 4 pgs.
"International Application Serial No. PCT/CA2012/000055, Invitation to Pay Add'l Fees and Partial Search Report dated Mar. 23, 2012", 2 pgs.
"International Application Serial No. PCT/CA2012/000055, Written Opinion dated May 24, 2012", 7 pgs.
"International Application Serial No. PCT/CA2012/00055, International Preliminary Report on Patentability dated Aug. 1, 2013", 9 pgs.
"International Application Serial No. PCT/CA2012/00055, International Search Report dated May 24, 2012", 4 pgs.
"International Application Serial No. PCT/CA2012/00055, Written Opinion dated May 24, 2012", 7 pgs.

* cited by examiner

HEAT PUMP HUMIDIFIER AND DEHUMIDIFIER SYSTEM AND METHOD

CROSS-REFERENCE TO RELATED APPLICATIONS

The present application is a continuation-in-part of and claims priority from U.S. patent application Ser. No. 12/870,545 titled "Heat Pump Humidifier and Dehumidifier System and Method" filed Aug. 27, 2010, the complete subject matter of which is hereby expressly incorporated by reference in its entirety.

BACKGROUND OF THE INVENTION

The subject matter herein relates generally to heat pumps and, more particularly, to a heat pump humidifier and dehumidifier system and method.

Heat pumps are used to condition air supplied to a building or structure. Typically, the supply air passes through a first heat exchanger to adjust a temperature and humidity of the supply air. The supply air is then channeled to a desiccant wheel to humidify or dehumidify the air prior to discharging the air into the space. Generally, return air is utilized to regenerate the desiccant wheel by humidifying or dehumidifying the regeneration air. When the supply air is humidified, the regeneration air is dehumidified. When the supply air is dehumidified, the regeneration air is humidified. Generally, the regeneration air also passes through a second heat exchanger prior to passing through the desiccant wheel. The first and second heat exchangers usually transfer energy between the supply air and the regeneration air.

Typically, the regeneration air is supplied from inside the space. As such, outside air generally lacks sufficient energy to properly regenerate the desiccant wheel. Accordingly, known heat pump systems may operate at reduced efficiencies when using outside air to regenerate the desiccant wheel. Because of the reduced efficiency of the heat pump, the heat pump may not be capable of conditioning some outside air. In particular, known heat pumps generally lack the capability of conditioning outside air having extreme hot or extreme cold temperatures.

A need remains for a more efficient heat pump system or method that utilizes the energy of return air to regenerate the desiccant wheel, increase effectiveness of the heat pump and provides considerable humidification load reductions to building operation. Another need remains for a heat pump that pre-processes supply air to enable the heat pump to operate in extreme weather conditions without significant reduction in efficiency.

SUMMARY OF THE INVENTION

In one embodiment, a heat pump system for conditioning air supplied to a space is provided. The system includes a pre-processing module that pre-conditions supply air. A supply air heat exchanger is in flow communication with the pre-processing module. The supply air heat exchanger receives air from the pre-processing module and at least one of heats or cools the air from the pre-processing module. A processing module is in flow communication with the supply air heat exchanger. The processing module receives and conditions air from the supply air heat exchanger. A regeneration air heat exchanger is provided to at least one of heat or cool regeneration air. The regeneration air heat exchanger and the supply air heat exchanger are fluidly coupled by a refrigerant system.

In another embodiment, a method for conditioning air supplied to a space is provided. The method includes pre-conditioning supply air with a pre-processing module. The method also includes at least one of heating or cooling the air from the pre-processing module with a supply air heat exchanger in flow communication with the pre-processing module. The method also includes conditioning air from the supply air heat exchanger with a processing module in flow communication with the supply air heat exchanger. The method also includes at least one of heating or cooling regeneration air with a regeneration air heat exchanger that is fluidly coupled to the supply air heat exchanger by a refrigerant system.

In another embodiment, a method for conditioning air supplied to a space is provided. The method includes conditioning supply air with a processing module. The method also includes at least one of heating or cooling the air prior to or after the processing module with one or more supply air heat exchangers in flow communication with the processing module. The method also includes at least one of heating or cooling the regeneration air with one or more regeneration air heat exchanger that is fluidly coupled to the supply air heat exchangers by a refrigerant system.

In another embodiment, a method for conditioning air supplied to a space is provided. The method includes conditioning supply air with a processing module. The method also includes at least one of heating or cooling the air prior to or after the processing module with one or more supply air heat exchangers in flow communication with the processing module. The method also includes at least one heat exchanger switch in flow communication with the supply air heat exchangers that is fluidly coupled to a refrigerant system.

In another embodiment, a method for conditioning air supplied to a space is provided. The method includes conditioning supply air with a processing module. The method also includes at least one of heating or cooling the air prior to or after the processing module with one or more supply air heat exchangers in flow communication with the processing module. The method also includes at least one heat exchanger switch in flow communication with the supply air heat exchangers that is fluidly coupled to a refrigerant system and a control method that allows the space sensible load and latent load to be maintained independently.

DETAILED DESCRIPTION OF THE DRAWINGS

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
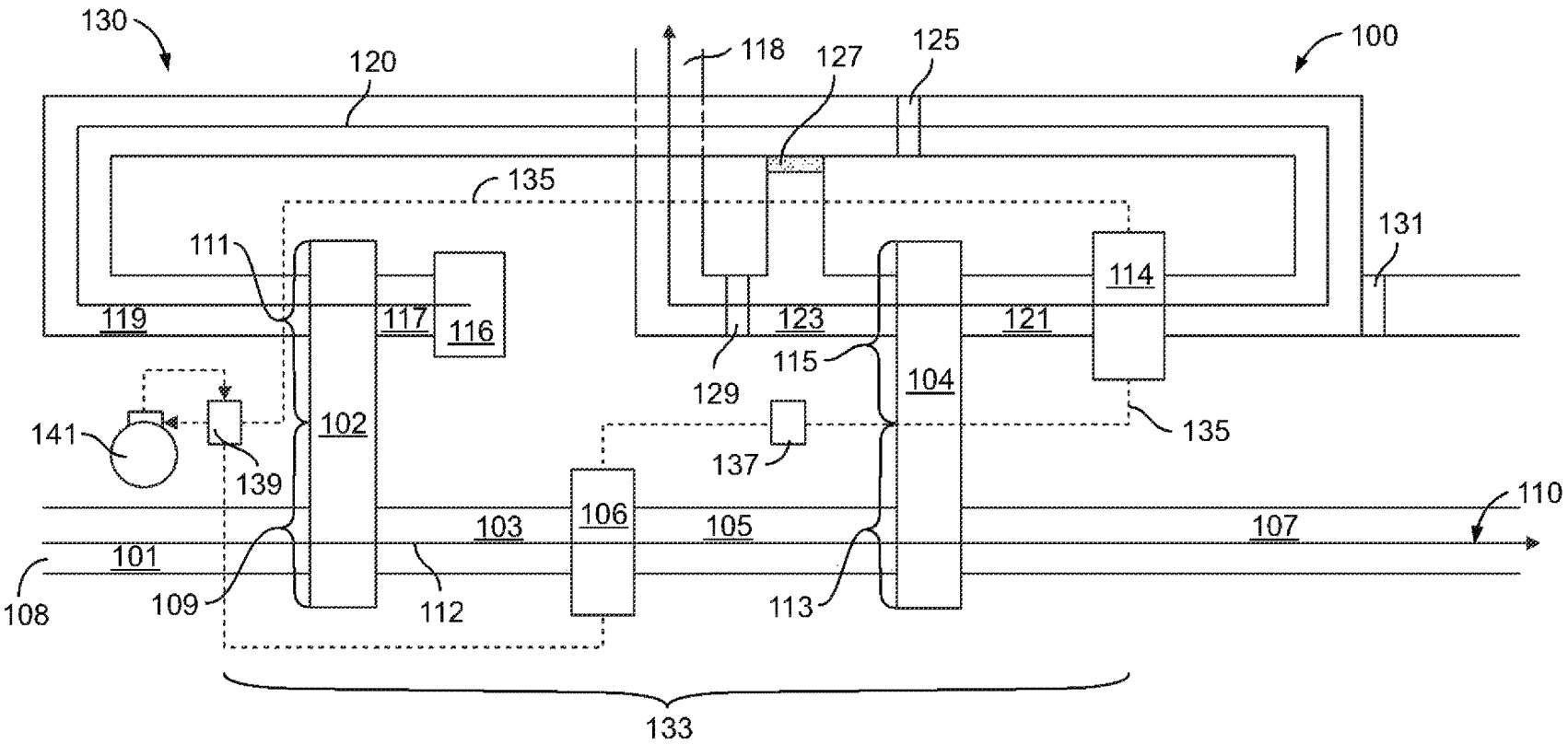
FIG. 1 is a schematic view of a heat pump system formed in accordance with an embodiment and operating in a summer mode.
Figure 2:
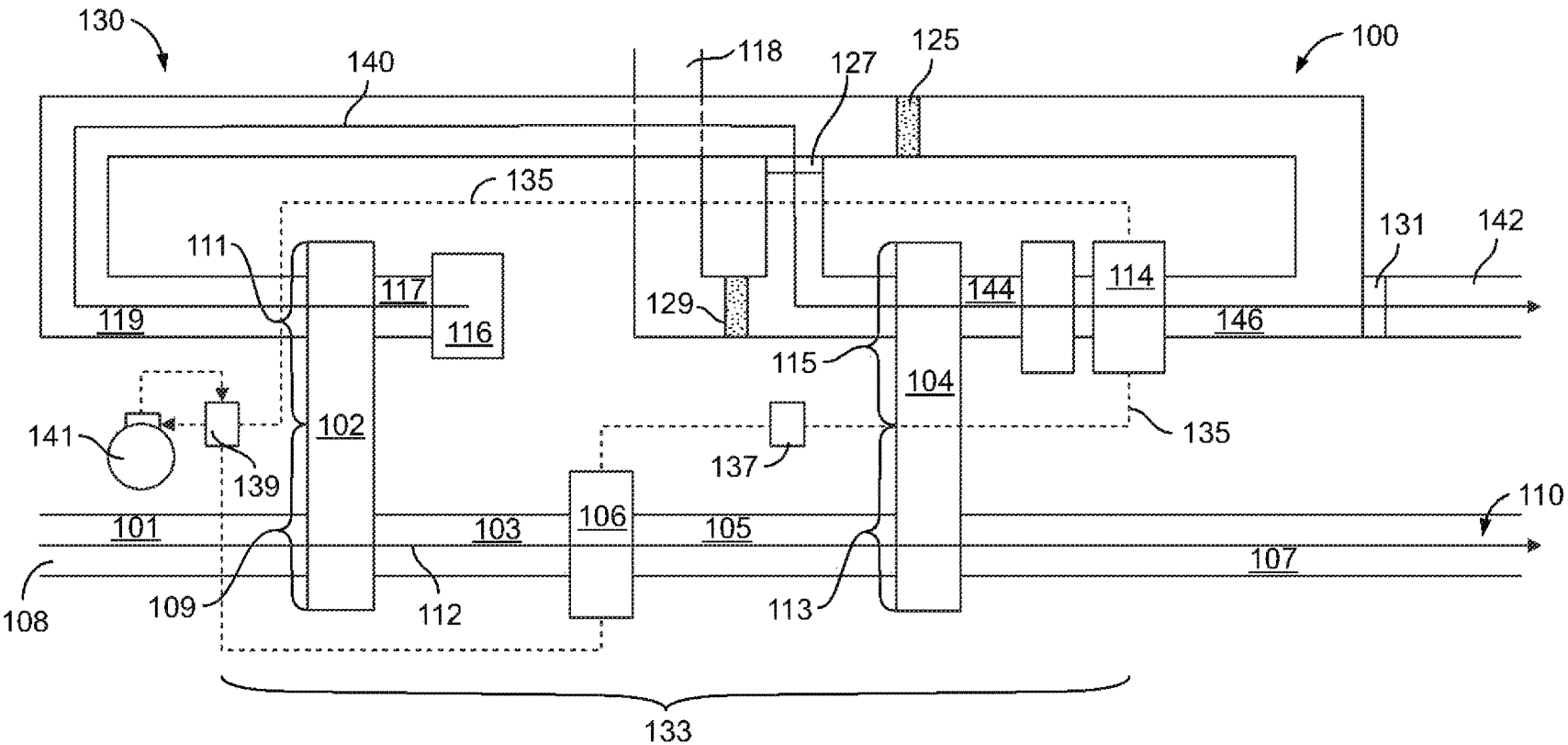
FIG. 2 is a schematic view of the system shown in FIG. 1 operating in a winter mode.

FIG. 1 is a schematic view of a heat pump system 100 formed in accordance with an embodiment and operating in a summer mode 130. FIG. 2 is a schematic view of the system 100 operating in a winter mode 132. The system 100 is configured to condition supply air flowing into a building or space and return air channeled from within the building or space. When in the summer mode 130, among other things, the system 100 dehumidifies the supply air flowing into the building. When in the winter mode 132, among other things, the system 100 humidifies the supply air flowing into the building. The system 100 is capable of switching between the summer mode 130 and the winter mode 132 without the need to reconfigure the components of the system 100.

First, the operation of system 100 is described in connection with the summer mode 130, as illustrated in FIG. 1. In the summer mode 130, the system includes a supply air flow path 112 and a return air flow path 120. The supply air flow path 112 travels between a supply air inlet 108 and a supply air outlet 110. In one embodiment, the system 100 may include at least one fan to draw air into and move air through the supply air flow path 112. Outside air flows through the supply air inlet 108 and into an outside air region 101.

A pre-processing module 102 is positioned downstream of the outside air region 101. In one embodiment, the pre-processing module 102 may include an energy recovery device, such as, an enthalpy wheel, a fixed enthalpy plate, an enthalpy pump and/or any other suitable heat exchanger that transfers both sensible heat and latent heat. In one embodiment the pre-processing module 102 is formed as a fixed body heat exchanger, an air to air heat exchanger, an air to liquid heat exchanger, a liquid to air heat exchanger, or liquid to liquid heat exchanger. The pre-processing module 102 includes a supply air side 109 and a return air side 111. The supply air side 109 is positioned within the supply air flow path 112. The return air side 111 is positioned within the return air flow path 120.

Outside air passes through the supply air side 109 of the pre-processing module 102. The pre-processing module 102 is configured to transfer latent energy and sensible energy between the supply air flow path 112 and the return air flow path 120. The latent energy includes moisture in the flow paths 112 and 120. The pre-processing module 102 transfers heat from a warmer flow path to a cooler flow path. The pre-processing module 102 also transfers humidity from a high humidity flow path to a low humidity flow path. The outside air is cooled as the outside air passes through the pre-processing module 102. The cooled air from the pre-processing module 102 is discharged into a pre-processed air region 103 positioned downstream from the pre-processing module 102.

A supply air heat exchanger 106 is positioned downstream from the pre-processed air region 103. The supply air heat exchanger 106 operates as an evaporator coil or cooling coil in the summer mode 130. As an evaporator coil, the supply air heat exchanger 106 conditions the cooled air and further removes heat from the cooled air to produce saturated air that is discharged into a conditioned air region 105. The amount of energy required to saturate air is proportional to the temperature and humidity of the air conditions in the pre-processed air region. Generally cooler air requires less energy to become saturated than warmer air. Because the supply air is first cooled by the pre-processing module 102, the energy expended by the supply air heat exchanger 106 to saturate the supply air to the desired saturated conditions is reduced, thereby increasing an efficiency of the supply air heat exchanger 106 as the supply air heat exchanger 106 saturates or cools the air. In the summer mode 130, the system 100 is capable of operating at extreme temperatures. For example, in the summer mode 130, the pre-processing module is capable of conditioning outside air having a dry bulb temperature over 90° F. Additionally, the supply air heat exchanger 106 is capable of conditioning air having a dry bulb temperature over 80° F.

A processing module 104 is positioned downstream from the conditioned air region 105. The saturated air passes through the processing module 104. In one embodiment, the processing module 104 may include a desiccant wheel, liquid desiccant system or any other suitable exchanger that removes and/or transfers moisture from the air. The processing module 104 may utilize any one of, or a combination of drierite, silica gel, calcium sulfate, calcium chloride, montmorillonite clay, activated aluminas, zeolites and/or molecular sieves to absorb moisture in the air. Other components that may also be used by the processing module are halogenated compounds such as halogen salts including chloride, bromide and fluoride salts, to name a few examples. In one embodiment, the processing module 104 is formed as a fixed body heat exchanger, an air to air heat exchanger, an air to liquid heat exchanger, a liquid to air heat exchanger, or liquid to liquid heat exchanger. The processing module 104 includes a supply air side 113 and a return air side 115. The supply air side 113 is positioned within the supply air flow path 112 and the return air side 115 is positioned within the return air flow path 120. The saturated air passes through the supply air side 113 to remove moisture therefrom and produce conditioned supply air that has been further dehumidified. Because the air is first saturated by the supply air heat exchanger 106, the efficiency of the processing module 104 is increased when dehumidifying the air. The dehumidified supply air flows downstream into a processed air region 107. From the processed air region 107, the dehumidified supply air flows through the supply air outlet 110 and into the space.

Regeneration air in the form of return air leaves the space at return air inlet 116 and traverses a return air flow path 120. The return air flow path 120 is defined between the return air inlet 116 and a return air outlet 118. In one embodiment, the system 100 may include at least one fan to draw air into and move air through the return air flow path 120. Return air enters through the return air inlet 116 and flows downstream into the return air region 117.

The return air side 111 of the pre-processing module 102 is positioned downstream from the return air region 117. The return air passes through the return air side 111 of the pre-processing module 102. The pre-processing module 102 transfers heat and moisture into the return air passing through the return air side 111, thereby removing heat from the supply air passing through the supply air side 109. The heated air flows into a pre-processed air region 119 and through a series of dampers 125, 127, 129, and 131. In the summer mode 130 dampers 125 and 129 are opened and dampers 127 and 131 are closed to direct the heated air to a regeneration air heat exchanger 114 positioned downstream from the damper 125.

The regeneration air heat exchanger 114 operates as a condenser coil in the summer mode 130 to heat and lower a relative humidity of conditioned air. The heat exchanger 114 uses the heat from the supply air heat exchanger 106 to lower the relative humidity of the heated air thus increasing the air's capacity to absorb water downstream. The heated air flows into a conditioned air region 121. The lowered relative humidity air in the conditioned air region 121 is channeled downstream to the return air side 115 of the processing module 104.

The lowered relative humidity air passing through the return air side 115 of the processing module 104 regenerates the processing module 104 by receiving moisture from the saturated air in the supply air side 113 and adding humidity to the exhaust air that flows into a processed air region 123. The exhaust air is channeled through the open damper 129, through return air outlet 118, and is exhausted from the space.

In one embodiment, the heat pump system 100 senses a condition of at least one of the supply air or return air from the space to control an output of at least one of the pre-processing module 102, the processing module 104, the supply air heat exchanger 106, and/or the regeneration air heat exchanger 114 to achieve a pre-determined dehumidification in the summer mode 130 and pre-determined humidification in a winter mode 130.

In another embodiment, the heat pump system 100 senses a condition of at least one of the supply or return air from the space to control an output of at least one of the pre-processing module 102, the processing module 104, the supply air heat exchanger 106, and/or the regeneration air heat exchanger 114 to achieve a pre-determined performance of the system 100.

In another embodiment, the heat pump system 100 senses a condition of at least one of the supply air or return air from the space to control an output of at least one of the pre-processing module 102, the processing module 104, the supply air heat exchanger 106, and/or the regeneration air heat exchanger 114 to limit frost formation in the pre-processing module 102 and/or the regeneration air heat exchanger 114 in the winter mode 132.

In another embodiment, the heat pump system 100 senses a condition of at least one of the supply air or the return air from the space to control an output of at least one of the pre-processing module 102 or the processing module 104.

In another embodiment, at least one of the pre-processing module 102 or processing module 104 is formed as a rotating body. The rotating body is rotated with at least one of a pre-determined speed or a predetermined range to achieve a pre-determined amount of at least one of moisture transfer or heat transfer to limit frost formation in the pre-processing module 102 and/or the regeneration air heat exchanger 114. A rotational speed of at least one of the pre-processing module 102 and/or the processing module 104 may be adjusted to a predetermined range, such that the pre-processing module 102 operates as at least one of a sensible wheel, a enthalpy wheel or a desiccant wheel based on variations in the outside air or return air from the space.

In another embodiment, the heat pump system 100 senses a condition of at least one of a supply air stream or a return air stream to control the output of at least one of a single compressor or variable compressor to limit frost formation in the pre-processing module and or the heat exchanger in winter mode.

In another embodiment, the heat pump system 100 senses a condition of at least one of a supply air stream or a return air stream to control the output of at least one of a single compressor or variable compressor to achieve a pre-determined performance of the system 100.

It should be noted that the system 100 is exemplary only and may include any number of pre-processing modules 102, processing modules 104, supply air heat exchangers 106 and/or regeneration air heat exchangers 114. Additionally, the arrangement of the components may be varied. The components described herein are arranged to provide a balance in energy between the supply air flow path 112 and the return air flow path 120.

The system 100 includes a refrigerant system 133 having piping 135 that fluidly couples the supply air heat exchanger 106 and the regeneration air heat exchanger 114. The refrigerant system 133 pumps a refrigerant between the supply air heat exchanger 106 and the regeneration air heat exchanger 114. In the summer mode 130, the refrigerant system 133 pumps cooled refrigerant to the supply air heat exchanger 106 to cool the air flowing through the supply air heat exchanger 106. The cooled refrigerant is heated by the air in the supply air heat exchanger 106 to form heated refrigerant. The heated refrigerant flows through the piping 135 to the regeneration air heat exchanger 114 to heat the air flowing through the regeneration air heat exchanger 114. The refrigerant is cooled by the air in the regeneration air heat exchanger 114 to form cooled refrigerant that is pumped back to the supply air heat exchanger 106.

In the winter mode 132, the refrigerant system 133 pumps heated refrigerant to the supply air heat exchanger 106 to heat the air flowing through the supply air heat exchanger 106. The heated refrigerant is cooled by the air in the supply air heat exchanger 106 to form cooled refrigerant. The cooled refrigerant flows through the piping 135 to the regeneration air heat exchanger 114 to cool the air flowing through the regeneration air heat exchanger 114. The refrigerant is heated by the air in the regeneration air heat exchanger 114 to form heated refrigerant that is pumped back to the supply air heat exchanger 106.

The refrigerant system 133 may include a metering device and check valve system 137 to control a flow of the refrigerant between the supply air heat exchanger 106 and the regeneration air heat exchanger 114. Additionally, a switch 139 may be provided to reverse a flow of the refrigerant through the refrigerant system 133. For example, the flow of the refrigerant may be reversed when the system 100 is switched between the summer mode 130 and the winter mode 132. A compressor 141 is provided to compress the refrigerant. In the summer mode 130, the refrigerant passes through the compressor 141 after exiting the supply air heat exchanger 106 and before entering the regeneration air heat exchanger 114. In the winter mode 132, the refrigerant passes through the compressor 141 after exiting the regeneration air heat exchanger 114 and before entering the supply air heat exchanger 106.

Figure 3:
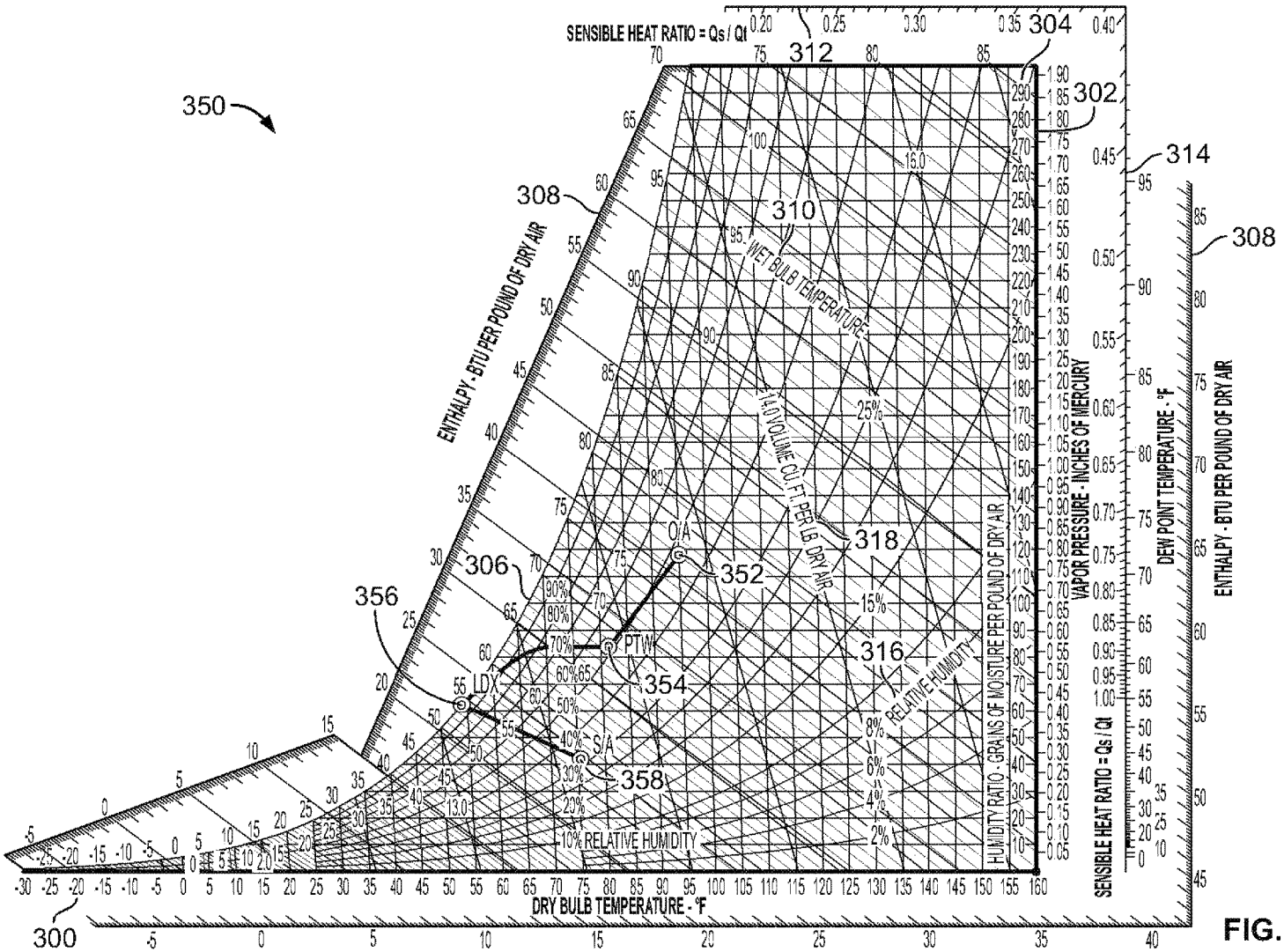
FIG. 3 is a psychrometric chart of the supply air of a heat pump system operating in a summer mode.
Figure 4:
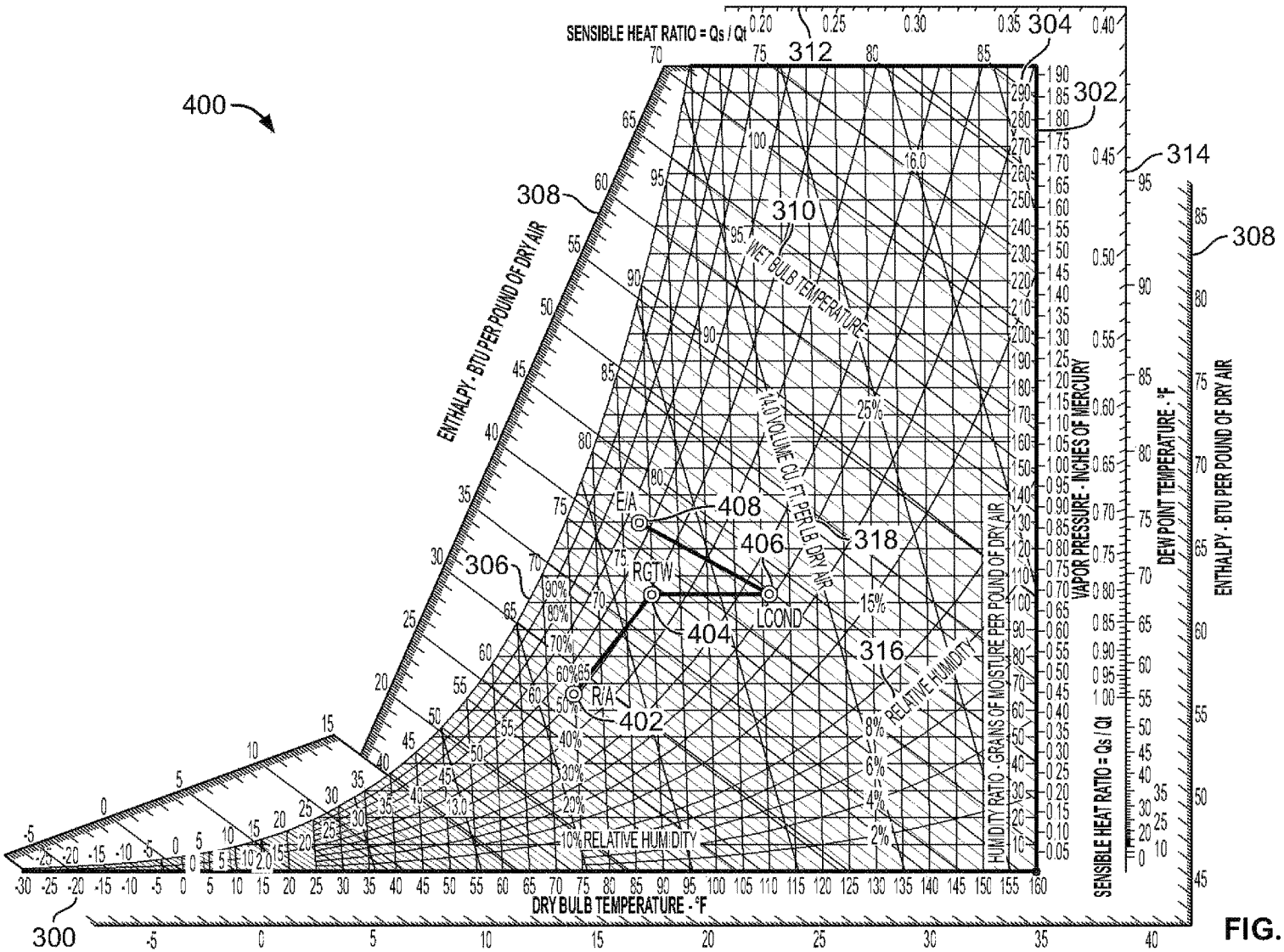
FIG. 4 is a psychrometric chart of the return air of a heat pump system operating in a summer mode.

FIGS. 3 and 4 illustrate psychrometric charts 350 and 400 for the system 100 when operating in the summer mode 130. It should be noted that the charts 350 and 400 are exemplary only and illustrate a single operating point for the summer mode 130 conditions. The charts 350 and 400 include an x-axis 300 that illustrates a dry bulb temperature of the air in degrees Fahrenheit and a y-axis 302 that illustrates vapor pressure in inches of mercury. A second y-axis 304 illustrates a humidity ratio in grains of moisture per pound of dry air. Curve 306 illustrates a saturation point of the air and lines 308 illustrate an enthalpy of the air in BTU per pound of dry air. Lines 310 illustrate a wet bulb temperature of the air in degrees Fahrenheit. A sensible heat ratio is illustrated on line 312 and a dew point temperature in degrees Fahrenheit is illustrated on line 314. A relative humidity of the air is illustrated on curves 316 and a volume of the air in cubic feet per pound of dry air is illustrated on curves 318.

FIG. 3 is a psychrometric chart 350 illustrating the condition of the air in the supply air flow path 112 when the system 100 is operating in the summer mode 130 and when the supply air enters the outside air region 101 at point 352 on chart 350. The supply air has a dry bulb temperature of approximately 95° F. and a wet bulb temperature of approximately 78° F. The enthalpy of the supply air is approximately 42 BTU per pound of dry air and the humidity ratio is approximately 120 grains of moisture per pound of dry air.

The supply air passes through the supply air side 109 of the pre-processing module 102. The pre-processing module 102 cools the supply air to generate cooled air that is discharged into the pre-processed air region 103 of the system 100. Point 354 of chart 350 illustrates the conditions of the cooled air within the pre-processed air region 103. The cooled air has a dry bulb temperature of approximately 80° F. and a wet bulb temperature of approximately 68.5° F. The enthalpy of the cooled air is approximately 33 BTU per pound of dry air and the humidity ratio is approximately 86 grains of moisture per pound of dry air.

The cooled air flows downstream to the supply air heat exchanger 106 and is conditioned to near the saturation curve 306. The supply air heat exchanger 106 operates as an evaporator coil to further reduce the temperature of the cooled air and generate saturated air. The cooled saturated air is discharged into the conditioned air region 105. Point 356 of chart 350 illustrates the conditions of the saturated air within the conditioned air region 105. At point 356 the saturated air has a dry bulb temperature of approximately 52° F. and a wet bulb temperature of approximately 52° F. The enthalpy of the saturated air is approximately 22 BTU per pound of dry air and the humidity ratio is approximately 58 grains of moisture per pound of dry air.

Next the saturated air is channeled through supply air side 113 of the processing module 104. The processing module 104 removes moisture from the saturated air to generate dehumidified supply air within the processed air region 107. Point 358 of chart 350 illustrates the conditions of the supply air. The supply air has a dry bulb temperature of approximately 74° F. and a wet bulb temperature of approximately 57° F. The enthalpy of the supply air is approximately 24.5 BTU per pound of dry air and the humidity ratio is approximately 42 grains of moisture per pound of dry air. The supply air is discharged through the supply air outlet 110 and into the space.

FIG. 4 is a psychrometric chart 400 illustrating the condition of the air in the return air flow path 120 when the system 100 is operating in the summer mode 130. The return air enters the system 100 through the return air inlet 116. Point 402 of chart 400 illustrates the condition of the return air within the return air region 117. The return air has a dry bulb temperature of approximately 74° F. and a wet bulb temperature of approximately 62.5° F. The enthalpy of the return air is approximately 28 BTU per pound of dry air and the humidity ratio is approximately 66 grains of moisture per pound of dry air.

The return air flows through the return air side 111 of the pre-processing module 102. The heat and moisture removed from the supply air on the supply air side 109 of the pre-processing module 102 is transferred into the return air on the return air side 111 of the pre-processing module 102 to generate heated air. The heated air flows into the pre-processed air region 119. Point 404 of chart 400 illustrates the conditions of the heated air. At point 404 the heated air has a dry bulb temperature of approximately 88° F. and a wet bulb temperature of approximately 73° F. The enthalpy of the heated air is approximately 36 BTU per pound of dry air and the humidity ratio is approximately 98 grains of moisture per pound of dry air.

The heated air passes through the regeneration air heat exchanger 114. In the summer mode 130, the regeneration air heat exchanger 114 operates as a condenser coil and transfers the heat from the supply air heat exchanger 106 to the return air flow path 120. The heat exchanger 114 also lowers a relative humidity of the air to increase the air's capacity to absorb water downstream. The dry air is discharged into the conditioned air region 121. Point 406 of chart 400 illustrates the conditions of the dry air within the conditioned air region 121. At point 406 the dry air has a dry bulb temperature of approximately 110° F. and a wet bulb temperature of approximately 79° F. The enthalpy of the dry air is approximately 42 BTU per pound of dry air and the humidity ratio is approximately 98 grains of moisture per pound of dry air.

The dry air travels downstream to the return air side 115 of the processing module 104. The processing module 104 transfers moisture from the cooled saturated air in the supply air side 113 to the heated dry air in the return air side 115. Point 408 of chart 400 illustrates the conditions of the exhaust air. The exhaust air has a dry bulb temperature of approximately 87° F. and a wet bulb temperature of approximately 77° F. The enthalpy of the exhaust air is approximately 41 BTU per pound of dry air and the humidity ratio is approximately 125 grains of moisture per pound of dry air. The exhaust air is discharged from the space through the return air outlet 118.

Next, the operation of system 100 is described in connection with the winter mode 132, as illustrated in FIG. 2. In the winter mode 132, the supply air flow path 112 follows the same path as defined in the summer mode 130. In the winter mode 132, the function of the system components may differ from the function of the system components in the summer mode 130.

Outside air flows through the supply air inlet 108 and into the outside air region 101. The outside air in the outside air region 101 travels downstream through the supply air side 109 of the pre-processing module 102. The outside air is heated by the pre-processing module 102 to generate heated and humidified air that is discharged into the pre-processed air region 103.

The heated and humidified air in the pre-processed air region 103 passes through the supply air heat exchanger 106. The supply air heat exchanger 106 operates as a condenser coil in the winter mode 132 to lower a relative humidity of the heated air and increase the air's capacity to absorb water downstream. The supply air heat exchanger 106 generates dry air that is discharged into the conditioned air region 105. When processing air having extreme cold temperatures, the supply air heat exchanger will be operating in a very inefficient matter. Because the outside air is first heated by the pre-processing module 102, the supply air heat exchanger 106 is capable of heating outside air having extreme cold temperatures very efficiently. For example, the pre-processing module 102 is capable of conditioning air having a temperature below 32° F. Using the components illustrated in FIG. 2, the pre-processing module 102 is capable of conditioning air having a temperature between −10° F. and 32° F. With additional components, the pre-processing module 102 is capable of conditioning air having temperature between −30° F. and 32° F. Moreover, the supply air heat exchanger 106 is capable of conditioning air having a temperature below 50° F., in the winter mode 132.

The lowered relative humidity heated air travels from the supply air heat exchanger 106 through the supply air side 113 of the processing module 104. The processing module adds moisture to the conditioned air to produce humidified supply air. The humidified supply air flows into the processed air region 107. From the processed air region 107, the supply air flows through the supply air outlet 110 and into the space.

The return air flow path 140 of the winter mode 132 differs from the return air flow path 120 of the summer mode. The dampers 125, 127, 129, and 131 may be opened and/or closed to change the return air flow path 120 of the summer mode 130 to return air flow path 140 of the winter mode 132. Additionally, the functions of at least some of the system components may change in the winter mode 132. The return air flow path 140 is defined between the return air inlet 116 and a return air outlet 142.

Return air flows through the return air inlet 116 and into the return air region 117. The return air then flows into the return air side 111 of the pre-processing module 102. The pre-processing module 102 transfers heat and moisture from the return air into the supply air passing through the supply air side 109 of the pre-processing module 102, thereby cooling the air in the return air flow path 140. The cooled air flows into the pre-processed air region 119 and is channeled through dampers 125, 127, 129, and 131. In the winter mode 132 dampers 125 and 129 are closed and dampers 127 and 131 are opened to direct the cooled air to the return air side 115 of the processing module 104.

The processing module 104 is regenerated by the supply air. The processing module 104 removes moisture from the cooled air in the return air side 115 and discharges the moisture into the dry air in the supply air side 113. The processing module 104 dehumidifies air in the return air flow path 140 while humidifying the supply air flow. The dehumidified air is discharged into a processed air region 144. The dehumidified air in the processed air region 144 is channeled to the regeneration air heat exchanger 114.

The regeneration air heat exchanger 114 operates as an evaporator coil in the winter mode 130 to cool the dehumidified air. The regeneration air heat exchanger 114 also removes heat from the return air and discharges the heat to the supply air heat exchanger 106. The heat exchanger 114 cools the dehumidified air to generate cooled exhaust air. When cooling air having extreme cold temperatures, the regeneration air heat exchanger 114 is susceptible to freezing. Because the return air is first dehumidified by the processing module 104, the dehumidified air in the processed air region 144 is able to be cooled by the regeneration air heat exchanger 114 to very cold temperatures without the risk of freezing. Furthermore, as the return air is dried by the processing module 104, the air's dry bulb condition in the processed air region 144 is raised, thus enabling additional heat transfer to the supply air heat exchanger 106 improving efficiency of the system. The cooled exhaust air flows into a conditioned air region 146 and is channeled through return air outlet 142 and exhausted from the building.

Figure 5:
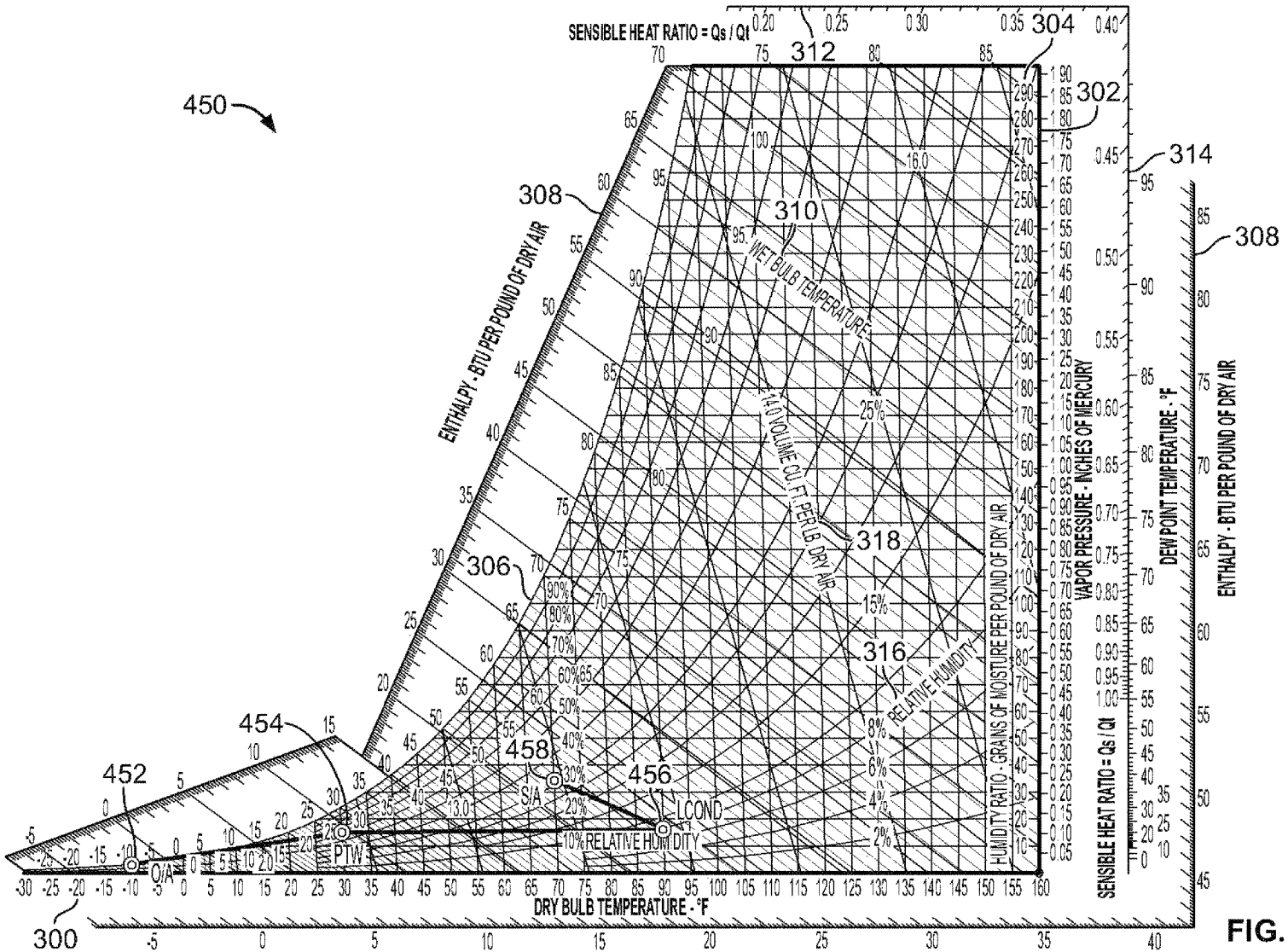
FIG. 5 is a psychrometric chart of the supply air of a heat pump system operating in a winter mode.
Figure 6:
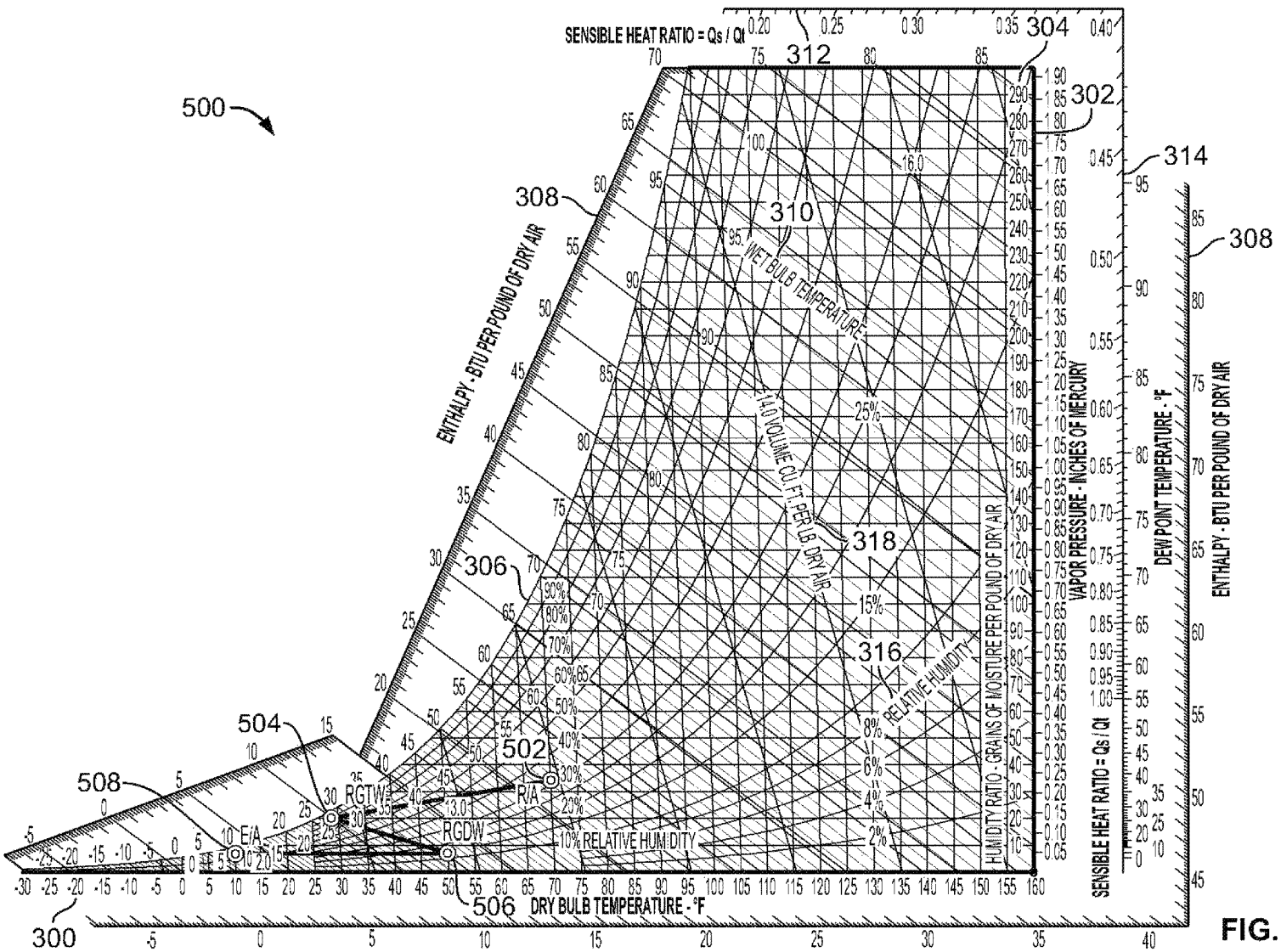
FIG. 6 is a psychrometric chart of the return air of a heat pump system operating in a winter mode.

FIGS. 5 and 6 illustrate psychrometric charts 450 and 500 for the system 100 when operating in the winter mode 132. It should be noted that the charts 450 and 500 are exemplary only and illustrate a single operating point for the winter mode 132 operating conditions. The charts 450 and 500 include an x-axis 300 that illustrates a dry bulb temperature of the air in degrees Fahrenheit and a y-axis 302 that illustrates vapor pressure in inches of mercury. A second y-axis 304 illustrates a humidity ratio in grains of moisture per pound of dry air. Curve 306 illustrates a saturation point of the air and lines 308 illustrate an enthalpy of the air in BTU per pound of dry air. Lines 310 illustrate a wet bulb temperature of the air in degrees Fahrenheit. A sensible heat ratio is illustrated on line 312 and a dew point temperature in degrees Fahrenheit is illustrated on line 314. A relative humidity of the air is illustrated on curves 316 and a volume of the air in cubic feet per pound of dry air is illustrated on curves 318.

FIG. 5 is a psychrometric chart 450 illustrating the condition of the outside air in the supply air flow path 112, when the system 100 is operating in the winter mode 132 and when the outside air enters the system 100 through the supply air inlet 108 and flows into the outside air region 101. Point 452 of chart 450 illustrates the conditions of the outside air. At point 452, the outside air has a dry bulb temperature of approximately −10° F. and a wet bulb temperature of approximately −10° F. The enthalpy of the outside air is approximately −2 BTU per pound of dry air and the humidity ratio is approximately 3 grains of moisture per pound of dry air.

The outside air passes through the supply air side 109 of the pre-processing module 102 where the air is heated and discharged into the pre-processed air region 103. Point 454 of chart 450 illustrates the conditions of the heated air in the pre-processed air region 103. At point 454, the heated air has a dry bulb temperature of approximately 30° F. and a wet bulb temperature of approximately 27° F. The enthalpy of the heated air is approximately 9.5 BTU per pound of dry air and the humidity ratio is approximately 16 grains of moisture per pound of dry air.

The heated air passes through the supply air heat exchanger 106. In the winter mode 132, the supply air heat exchanger 106 operates as a condenser coil to heat the air using heat discharged from the regeneration air heat exchanger 114. The supply air heat exchanger 106 also lowers a relative humidity of the air to increase the air's capacity to absorb water downstream. The supply air heat exchanger 106 lowers the relative humidity of heated air that is discharged into the conditioned air region 105. Point 456 illustrates the conditions of the heated air. At point 456 the heated air has a dry bulb temperature of approximately 90° F. and a wet bulb temperature of approximately 56.7° F. The enthalpy of the dried air is approximately 24 BTU per pound of dry air and the humidity ratio is approximately 16 grains of moisture per pound of dry air.

The heated air travels downstream through the supply side 113 of the processing module 104 where humidity from the return air in the return side 115 is discharged into the lower relative humidity air in the supply side 113. The humidified supply air is discharged into the processed air region 107. Point 458 of chart 450 illustrates the conditions of the supply air. At point 458, the supply air has a dry bulb temperature of approximately 70° F. and a wet bulb temperature of approximately 53° F. The enthalpy of the supply air is approximately 22 BTU per pound of dry air and the humidity ratio is approximately 33 grains of moisture per pound of dry air. The supply air is discharged through the supply air outlet 110 and into the building.

FIG. 6 is a psychrometric chart 500 illustrating the condition of the air in the return air flow path 140 when the system 100 is operating in the winter mode 132 and when the return air enters the system 100 through the return air inlet 116 and flows into the return air region 117. Point 502 of chart 500 illustrates the conditions of the return air. The return air has a dry bulb temperature of approximately 70° F. and a wet bulb temperature of approximately 53° F. The enthalpy of the return air is approximately 22 BTU per pound of dry air and the humidity ratio is approximately 33 grains of moisture per pound of dry air.

The return air flows through the return air side 111 of the pre-processing module 102 where heat is removed from the return air and discharged into the outside air in the supply air side 109 of the pre-processing module 102. The pre-processing module 102 produces cooled air in the return air flow path 140 that is discharged into the pre-processed air region 119. Point 504 of chart 500 illustrates the conditions of the cooled air in the pre-processed air region 119. The cooled air has a dry bulb temperature of approximately 28° F. and a wet bulb temperature of approximately 27° F. The enthalpy of the cooled air is approximately 10 BTU per pound of dry air and the humidity ratio is approximately 20 grains of moisture per pound of dry air.

The cooled air passes through return air side 115 of the processing module 104. The processing module 104 transfers humidity from the cooled air in the return air side 115 to the dry air in the supply air side 113 of the processing module 104. Dehumidified air is discharged from the processing module 104 into the processed air region 144. Point 506 of chart 500 illustrates the conditions of the dehumidified air in the processed air region 144. The dehumidified air in the processed air region 144 has a dry bulb temperature of approximately 49° F. and a wet bulb temperature of approximately 34° F. The enthalpy of the dehumidified air is approximately 13 BTU per pound of dry air and the humidity ratio is approximately 7 grains of moisture per pound of dry air.

The dehumidified air then passes through the regeneration air heat exchanger 114. In the winter mode 132, the regeneration air heat exchanger 114 operates as an evaporator coil to cool the dehumidified air. The regeneration air heat exchanger 114 removes heat from the dehumidified air. The heat is discharged into the supply air heat exchanger 106 to heat the supply air traveling through the supply air heat exchanger 106. Cooled exhaust air is discharged from the regeneration air heat exchanger 114 into the conditioned air region 146. Point 508 of chart 500 illustrates the conditions of the exhaust air. At point 508, the exhaust air has a dry bulb temperature of approximately 10° F. and a wet bulb temperature of approximately 9° F. The enthalpy of the exhaust air is approximately 3 BTU per pound of dry air and the humidity ratio is approximately 7 grains of moisture per pound of dry air. The exhaust air is discharged from the space through the return air outlet 142.

Figure 7:
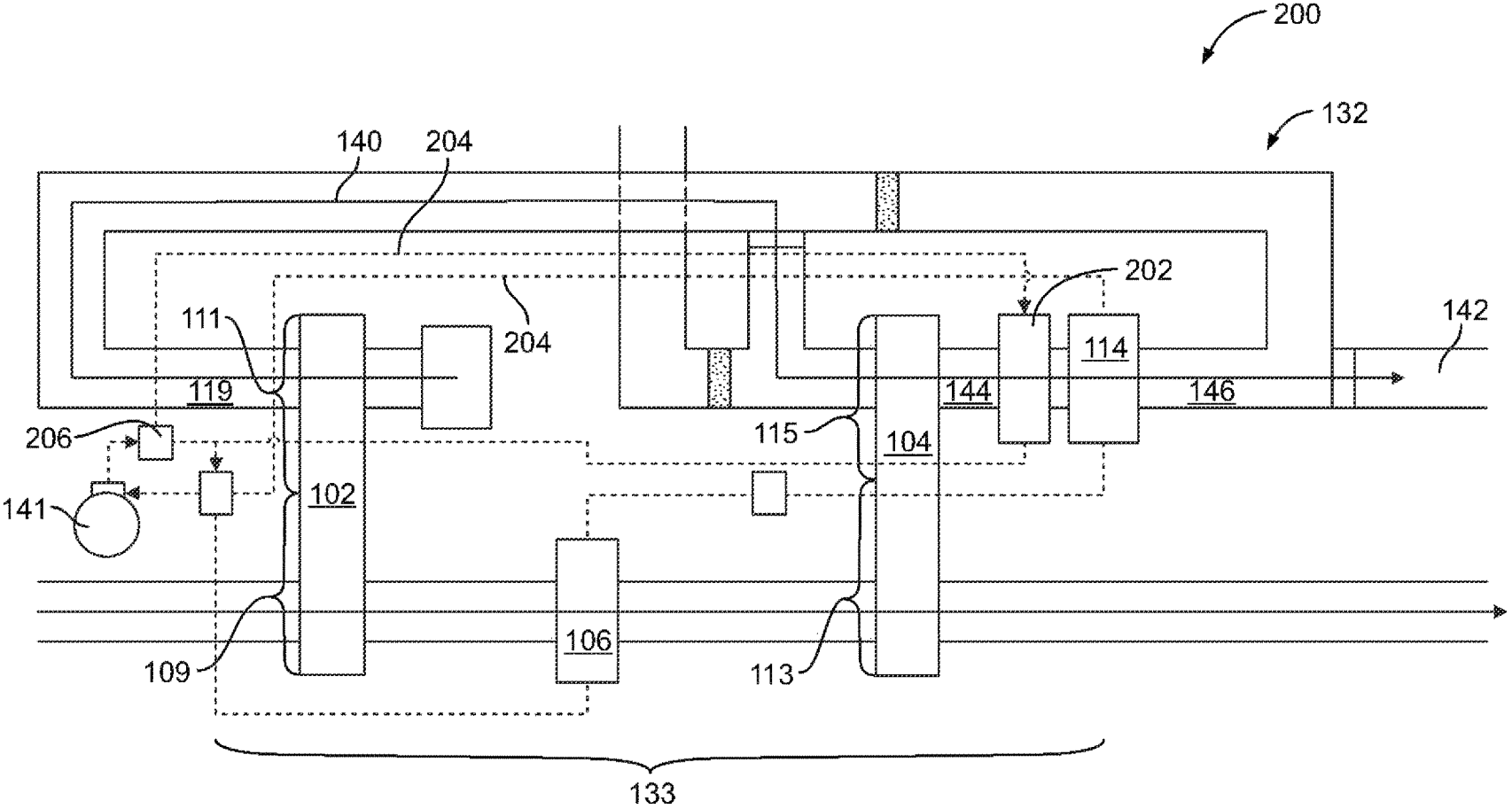
FIG. 7 is a schematic view of another heat pump system formed in accordance with an embodiment and operating in a winter mode.

FIG. 7 is a schematic view of another heat pump system 200 formed in accordance with an embodiment and operating in a winter mode. The heat pump system 200 includes many of the elements of the heat pump system 100. The elements of the heat pump system 200 that are the same as the elements of the heat pump system 100 are denoted using the same reference numerals. The heat pump system 200 includes a reheat coil 202 positioned upstream from the regeneration air heat exchanger 114 that is operational in the winter mode 132. The reheat coil 202 is positioned downstream from the return air side 115 of the processing module 104 in the winter mode 132. The reheat coil 202 adds heat, lowers the relative humidity of the return air exiting the return air side 115 of the processing module 104 prior to entering the regeneration air heat exchanger 114. The reheat coil 202 may prevent frost formation on the regeneration air heat exchanger 114 during the winter mode 132.

The reheat coil 202 is fluidly coupled to the refrigeration system 133 through piping 204. The piping 204 is joined to the compressor 141 to receive heated refrigerant therefrom. A refrigerant flow control device 206 may be provided to control a flow of refrigerant to the reheat coil 202.

Figure 8:
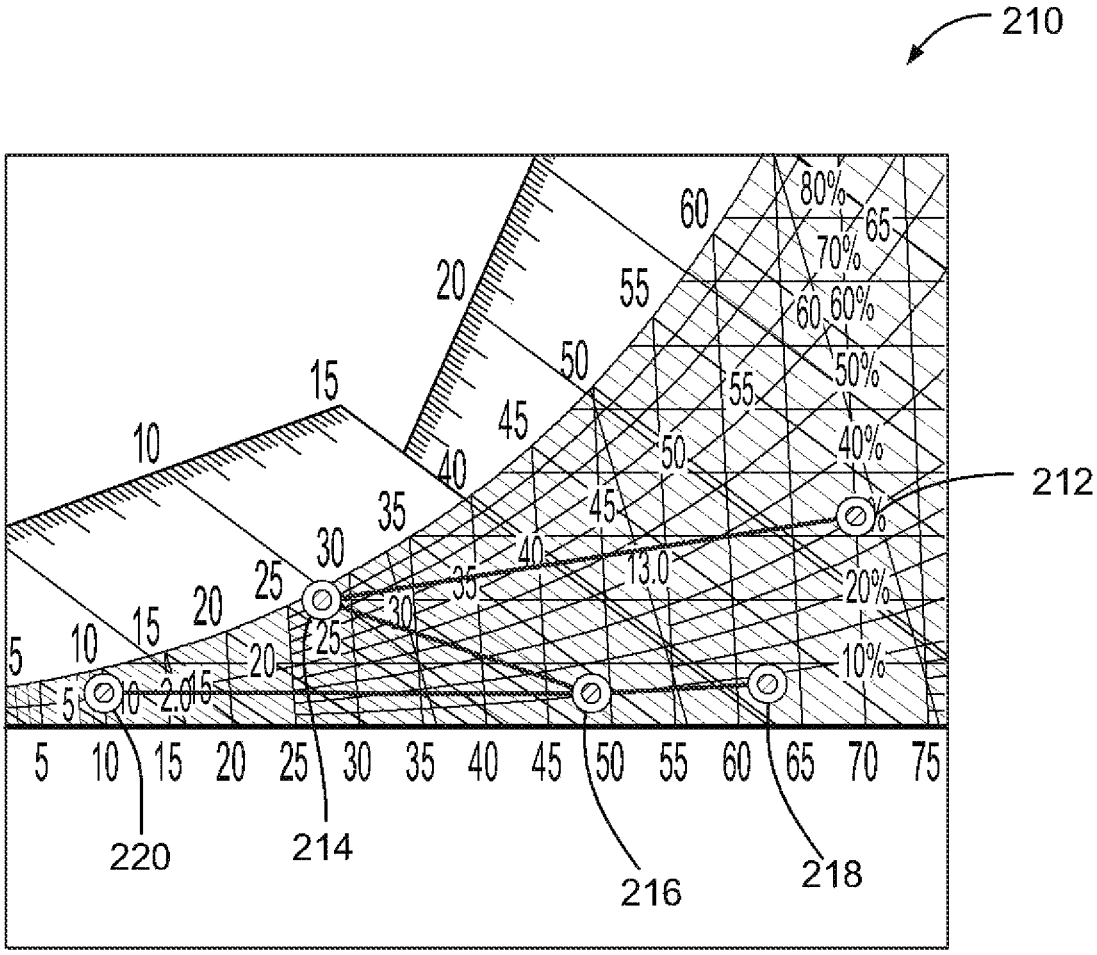
FIG. 8 is a psychrometric chart of the heat pump system shown in FIG. 7 operating in a winter mode.

FIG. 8 is a psychrometric chart 210 of the heat pump system 200 operating in a winter mode 132. Point 212 of chart 210 illustrates the conditions of the return air. The return air has a dry bulb temperature of approximately 70° F. and a wet bulb temperature of approximately 53° F. The enthalpy of the return air is approximately 22 BTU per pound of dry air.

The return air flows through the return air side 111 of the pre-processing module 102 where heat is removed from the return air and discharged into the outside air in the supply air side 109 of the pre-processing module 102. The pre-processing module 102 produces cooled air in the return air flow path 140 that is discharged into the pre-processed air region 119. Point 214 of chart 210 illustrates the conditions of the cooled air in the pre-processed air region 119. The cooled air has a dry bulb temperature of approximately 28° F. and a wet bulb temperature of approximately 27° F. The enthalpy of the cooled air is approximately 10 BTU per pound of dry air.

The cooled air passes through return air side 115 of the processing module 104. The processing module 104 transfers humidity from the cooled air in the return air side 115 to the dry air in the supply air side 113 of the processing module 104. Dehumidified air is discharged from the processing module 104 into the processed air region 144. Point 216 of chart 210 illustrates the conditions of the dehumidified air in the processed air region 144. The dehumidified air in the processed air region 144 has a dry bulb temperature of approximately 49° F. and a wet bulb temperature of approximately 34° F. The enthalpy of the dehumidified air is approximately 13 BTU per pound of dry air.

The dehumidified air then passes through the reheat coil 202. Point 218 of the chart 210 illustrates the conditions of the reheated air discharged from the reheat coil 202. The reheated air has a dry bulb temperature of approximately 63° F. and a wet bulb temperature of approximately 42° F. The enthalpy of the dehumidified air is approximately 16 BTU per pound of dry air.

The reheated air then passes through the regeneration air heat exchanger 114. The regeneration air heat exchanger 114 removes heat from the dehumidified air. The heat is discharged into the supply air heat exchanger 106 to heat the supply air traveling through the supply air heat exchanger 106. Cooled exhaust air is discharged from the regeneration air heat exchanger 114 into the conditioned air region 146. Point 220 of chart 210 illustrates the conditions of the exhaust air. At point 220, the exhaust air has a dry bulb temperature of approximately 10° F. and a wet bulb temperature of approximately 9° F. The enthalpy of the exhaust air is approximately 3 BTU per pound of dry air and the humidity ratio is approximately 7 grains of moisture per pound of dry air. The exhaust air is discharged from the space through the return air outlet 142.

Figure 9:
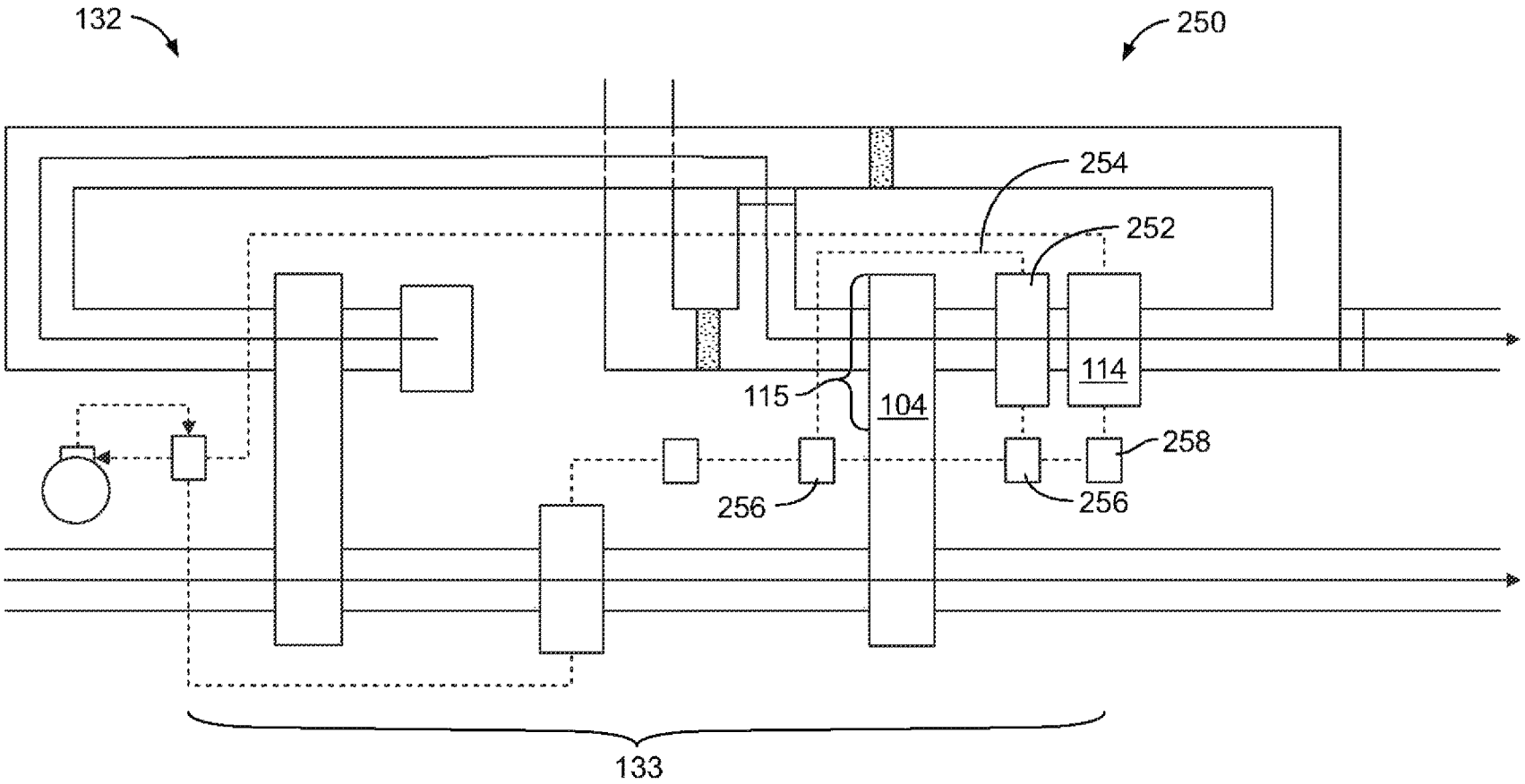
FIG. 9 is a schematic view of another heat pump system formed in accordance with an embodiment and operating in a winter mode.

FIG. 9 is a schematic view of another heat pump system 250 formed in accordance with an embodiment and operating in a winter mode. The heat pump system 250 includes many of the elements of the heat pump system 100. The elements of the heat pump system 250 that are the same as the elements of the heat pump system 100 are denoted using the same reference numerals. The heat pump system 250 includes a sub-cooling coil 252 positioned upstream from the regeneration air heat exchanger 114. The sub-cooling coil 252 is positioned downstream from the return air side 115 of the processing module 104. The sub-cooling coil 252 adds heat, lowers the relative humidity of the return air exiting the return air side 115 of the processing module 104 prior to entering the regeneration air heat exchanger 114. The sub-cooling coil 252 may prevent frost formation on the regeneration air heat exchanger 114 during the winter mode 132.

The sub-cooling coil 252 is fluidly coupled to the refrigeration system 133 through piping 254. The piping 254 includes a pair of flow control devices 256 to control a flow of refrigerant to the sub-cooling coil 252. In one embodiment, the refrigerant system 133 may also include an additional metering device and check valve system 258 to control the flow of refrigerant therethrough.

Figure 10:
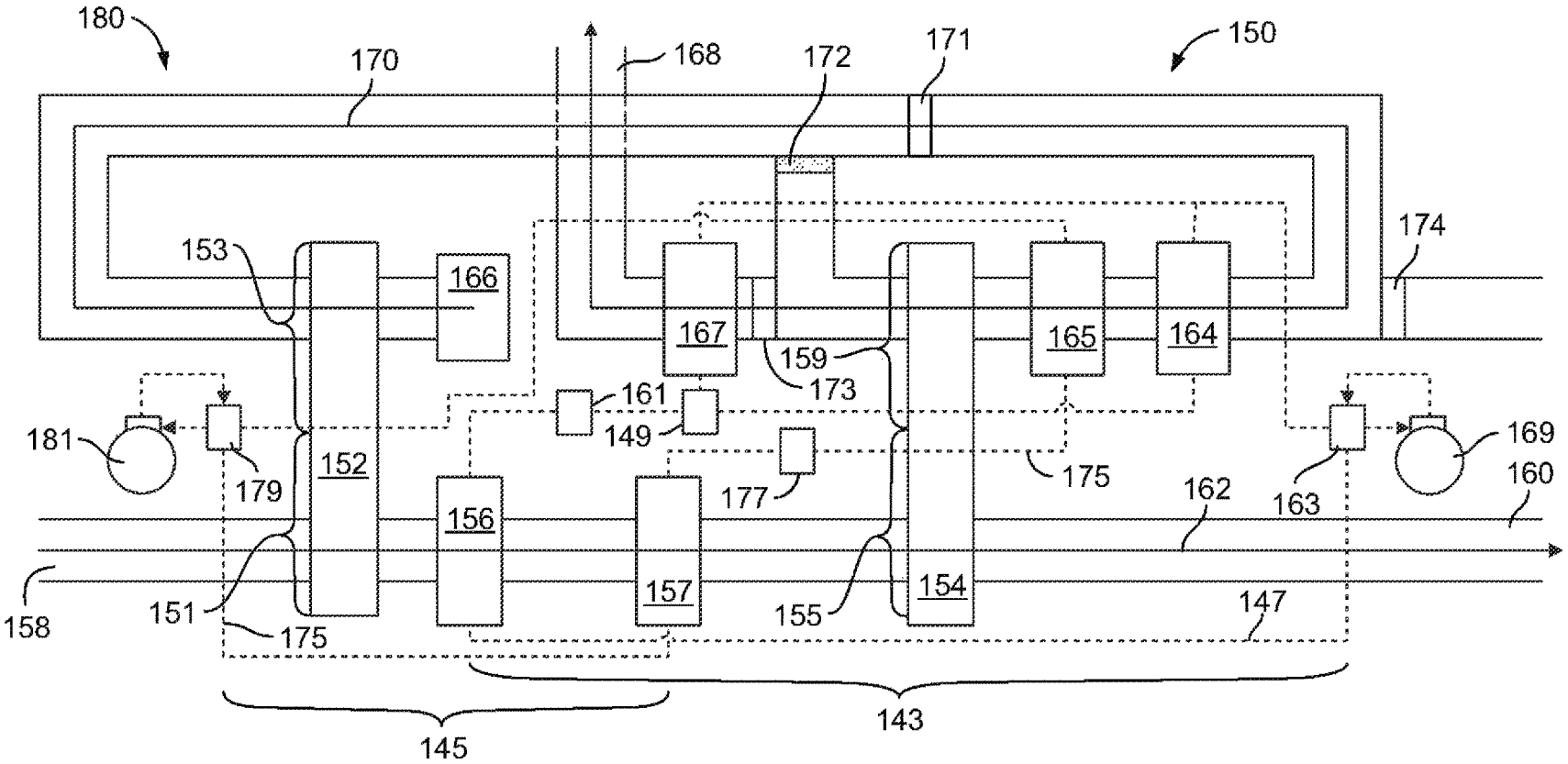
FIG. 10 is a schematic view of another heat pump system formed in accordance with an embodiment and operating in a summer mode.
Figure 11:
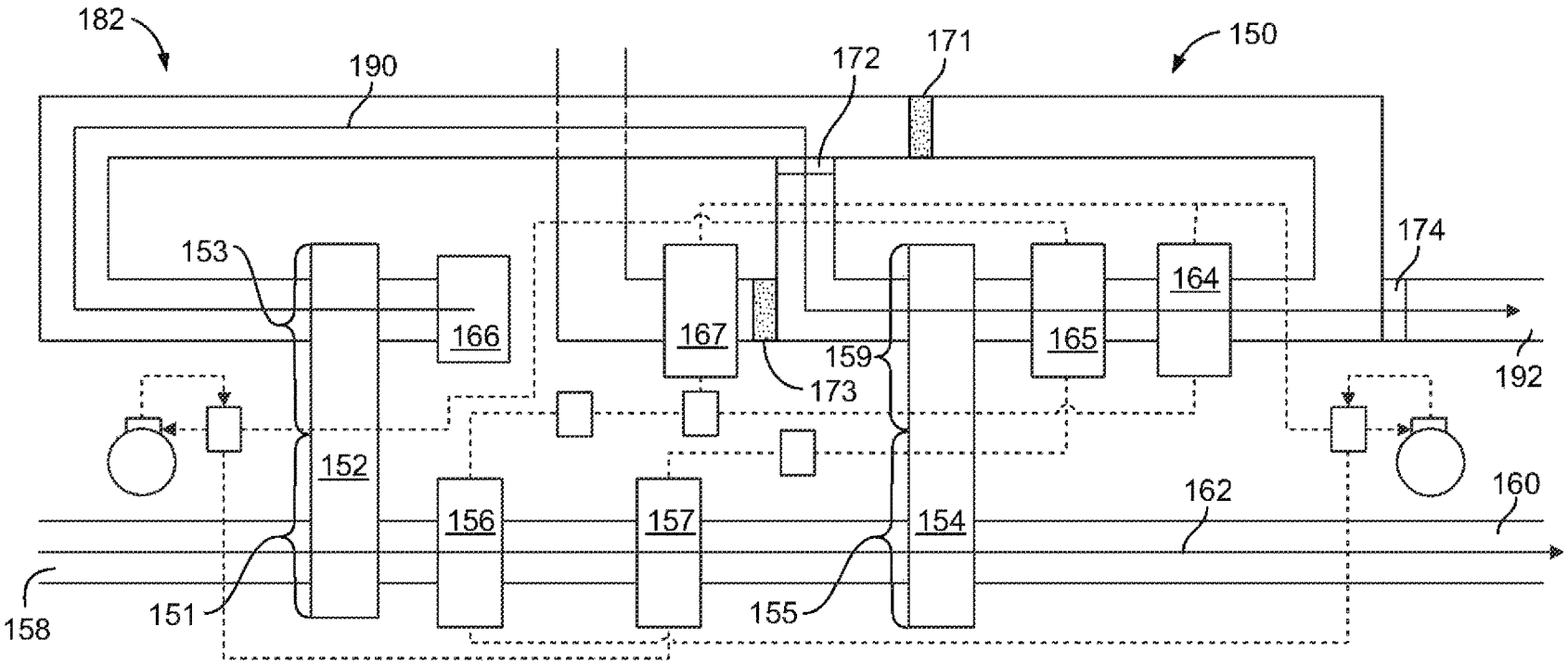
FIG. 11 is a schematic view of the heat pump system shown in FIG. 10 and operating in a summer mode.

FIG. 10 is a schematic view of another heat pump system 150 operating in a summer mode 180. FIG. 11 is a schematic view of the system 150 operating in a winter mode 182. In the summer mode 180, a supply air flow path 162 and a return air flow path 170 flow through the system 150. In the winter mode 182, the supply air flow path 162 follows the same path as defined in the summer mode 180 and return air follows a return air flow path 190. In the winter mode 182 the function of the system components may differ from the function of the system components in the summer mode 180. The system 150 includes dampers 171, 172, 173, and 174 to redirect the return air path 170 of the summer mode 180 into the return air path 190 of the winter mode 182.

Referring to the summer mode 180 illustrated in FIG. 10, outside air flows through the supply air inlet 158 and downstream to a supply air side 151 of a pre-processing module 152. The pre-processing module 152 removes heat from the outside air. The outside air discharged from the pre-processing module 152 flows into a pair supply air heat exchangers 156 and 157. In the summer mode 180, the supply air heat exchangers 156 and 157 operate as evaporator coils to saturate the outside air. The outside air then flows downstream to a supply air side 155 of a processing module 154. The processing module 154 removes moisture from the outside air to generate dehumidified supply air that is discharged through the supply air outlet 160 and into the space. At least one fan (not shown) may be positioned within the supply air flow path 162 to move the supply air from the supply air inlet 158 downstream to the supply air outlet 160.

In the summer mode 180, regeneration air in the form of return air flows through the return air inlet 166 and through a return air side 153 of the pre-processing module 152. The pre-processing module 152 removes heat from the outside air in the supply air side 151 and transfers the heat to the return air in the return air side 153. The return air is then channeled to a regeneration air heat exchanger 164, which preferably is shut off. The return air travels through the regeneration air heat exchanger 164 unchanged and into a regeneration air heat exchanger 165. In the summer mode 180, the regeneration air heat exchanger 165 operates as a condenser coil to lower a relative humidity of the return air to increase the air's capacity to absorb water downstream. The regeneration air heat exchanger 165 uses the heat removed from the supply air by the supply air heat exchanger 157 to dry the return air. The heated return air then flows to a return air side 159 of the processing module 154 and receives moisture from the supply air side 155. The return air discharged from the processing module 154 flows through a regeneration air heat exchanger 167, which operates as a condenser coil to further heat the return air using the heat from the supply air heat exchanger 156. The return air is then discharged through a return air outlet 168. It is understood that heat exchangers in the supply and return air flow paths could be matched differently then that stated previously. For instance, the regeneration air heat exchanger 165 could also be coupled with the supply air heat exchanger 156. Likewise the regeneration air heat exchanger 167 could also be coupled with the supply air heat exchanger 157.

Referring to FIG. 11, the winter mode 182 of the system 150 is illustrated. The supply air flow path 162 follows the same path as defined in the summer mode 180. In the winter mode 182 the function of the system components may differ from the function of the system components in the summer mode 180. Supply air enters the supply air inlet 158 and flows downstream to the pre-processing module 152 where the supply air receives heat from the return air flow path 190. The supply air discharged from the pre-processing module 152 flows into the supply air heat exchangers 156 and 157. In the winter mode 182, the supply air heat exchangers 156 and 157 operate as condenser coils to heat, lower a relative humidity of the supply air and increase the air's capacity to absorb water downstream. The dried supply air then travels to the processing module 154 where the supply air receives moisture from the return air flow path 190 to generate humidified supply air. The humidified supply air is discharged through the supply air outlet 160 and into the space.

The return air flow path 190 of the winter mode 182 differs from the return air flow path 170 of the summer mode 180. The dampers 171, 172, 173, and 174 of the system 150 are open and/or closed to change the return air flow path 170 of the summer mode 180 to the return air flow path 190 of the winter mode 182. Additionally, the functions of at least some of the system components may change in the winter mode 182. Return air enters the return air flow path 190 through the return air inlet 166. The return air flows through the pre-processing module 152 where heat is removed from the return air. The heat is discharged into the supply air flow path 162. The return air then flows to the processing module 154 where moisture is removed from the return air. The moisture from the return air is discharged into the supply air flow path 162. The return air discharged from the processing module 154 travels to the regeneration air heat exchangers 165 and 164. In the winter mode 182, the regeneration air heat exchangers 165 and 164 operate as evaporator coils to cool the return air prior to the return air being discharged through the return air outlet 192. It is understood that the return air flow path 190 of the winter mode could alternatively flow through the regeneration air heat exchanger 167, which is preferably shut off, and then to the process module 154 depending on the damper (not shown) location and operation.

In one embodiment, the heat pump system 150 senses a condition of at least one of the supply air or return air from the space to control an output of at least one of the pre-processing module 152, the processing module 154, the supply air heat exchangers 156 and/or 157, and/or the regeneration air heat exchangers 164, 165, and/or 167 to achieve a pre-determined dehumidification of the supply air in summer mode 180 and a pre-determined humidification of the supply air in the winter mode 182.

In another embodiment, the heat pump system 150 senses a condition of at least one of the supply air or return air from the space to control an output of at least one of the pre-processing module 152, the processing module 154, the supply air heat exchangers 156 and/or 157, and/or the regeneration air heat exchangers 164, 165, and/or 167 to achieve a pre-determined performance of the system 150.

In another embodiment, the heat pump system 150 senses a condition of at least one of the supply air or return air from the space to and control an output of at least one of the pre-processing module 152, the processing module 154, the supply air heat exchangers 156 and/or 157, and/or the regeneration air heat exchangers 164, 165, and/or 167 to limit frost formation in at least one of the pre-processing module 152 and/or regeneration air heat exchangers 164, 165, and/or 167 in the winter mode 182.

In another embodiment, the heat pump system 150 senses a condition of at least one of the supply air stream or the return air stream from the space to control an output of at least one of a single compressor, multiple compressors and/or variable compressor to limit frost formation in at least one of the pre-processing module 152 and/or regeneration air heat exchangers 164, 165 and/or 167 in the winter mode 182.

In another embodiment, the heat pump system 150 senses a condition of at least one of the supply air stream or the return air stream from the space to control an output of at least one of a single compressor, multiple compressors and/or variable compressor to achieve a pre-determined performance of the system 150.

Referring to FIGS. 10 and 11, the heat pump system 150 includes a first refrigerant system 143 and a second refrigerant system 145. The first refrigerant system 143 includes piping 147 that fluidly couples the supply air heat exchanger 156, the regeneration air heat exchanger 164, and the regeneration air heat exchanger 167. The first refrigerant system 143 pumps a refrigerant between the supply air heat exchanger 156 and at least one of the regeneration air heat exchanger 164 or the regeneration air heat exchanger 167. A heat exchanger switch 149 controls the flow of refrigerant to the regeneration air heat exchanger 164 and the regeneration air heat exchanger 167. In the summer mode 180, the first refrigerant system 143 pumps cooled refrigerant to the supply air heat exchanger 156 to cool the air flowing through the supply air heat exchanger 156. The cooled refrigerant is heated by the air in the supply air heat exchanger 156 to form heated refrigerant. The heated refrigerant flows through the piping 147 to at least one of the regeneration air heat exchanger 164 or the regeneration air heat exchanger 167 to heat the air flowing through the regeneration air heat exchanger 164 and/or the regeneration air heat exchanger 167. The refrigerant is cooled by at least one of the regeneration air heat exchanger 164 or the regeneration air heat exchanger 167 to form cooled refrigerant that is pumped back to the supply air heat exchanger 156.

In the winter mode 182, the first refrigerant system 143 pumps heated refrigerant to the supply air heat exchanger 156 to heat the air flowing through the supply air heat exchanger 156. The heated refrigerant is cooled by the air in the supply air heat exchanger 156 to faun cooled refrigerant. The cooled refrigerant flows through the piping 147 to at least one of the regeneration air heat exchanger 164 or the regeneration air heat exchanger 167 to cool the air flowing through the regeneration air heat exchanger 164 and/or the regeneration air heat exchanger 167. The refrigerant is heated by the air in at least one of the regeneration air heat exchanger 164 or the regeneration air heat exchanger 167 to form heated refrigerant that is pumped back to the supply air heat exchanger 156.

The first refrigerant system 143 may include a metering device and check valve system 161 to control a flow of the refrigerant between the supply air heat exchanger 156 and the regeneration air heat exchanger 164 and/or the regeneration air heat exchanger 167. Additionally, a switch 163 may be provided to reverse a flow of the refrigerant through the first refrigerant system 143. For example, the flow of the refrigerant may be reversed when the system 150 is switched between the summer mode 180 and the winter mode 182. A compressor 169 is provided to compress the refrigerant. In the summer mode 180, the refrigerant passes through the compressor 169 after exiting the supply air heat exchanger 156 and before entering the regeneration air heat exchangers 164 and/or 167. In the winter mode 182, the refrigerant passes through the compressor 169 after exiting the regeneration air heat exchangers 164 and/or 167 and before entering the supply air heat exchanger 156.

The second refrigerant system 145 includes piping 175 that fluidly couples the supply air heat exchanger 157 and the regeneration air heat exchanger 165. The second refrigerant system 145 pumps a refrigerant between the supply air heat exchanger 157 and the regeneration air heat exchanger 165. In the summer mode 180, the refrigerant system 145 pumps cooled refrigerant to the supply air heat exchanger 157 to cool the air flowing through the supply air heat exchanger 157. The cooled refrigerant is heated by the air in the supply air heat exchanger 157 to form heated refrigerant. The heated refrigerant flows through the piping 175 to the regeneration air heat exchanger 165 to heat the air flowing through the regeneration air heat exchanger 165. The refrigerant is cooled by the air in the regeneration air heat exchanger 165 to form cooled refrigerant that is pumped back to the supply air heat exchanger 157.

In the winter mode 182, the second refrigerant system 145 pumps heated refrigerant to the supply air heat exchanger 157 to heat the air flowing through the supply air heat exchanger 157. The heated refrigerant is cooled by the air in the supply air heat exchanger 157 to form cooled refrigerant. The cooled refrigerant flows through the piping 175 to the regeneration air heat exchanger 165 to cool the air flowing through the regeneration air heat exchanger 165. The refrigerant is heated by the air in the regeneration air heat exchanger 165 to form heated refrigerant that is pumped back to the supply air heat exchanger 157.

The second refrigerant system 145 may include a metering device and check valve system 177 to control a flow of the refrigerant between the supply air heat exchanger 157 and the regeneration air heat exchanger 165. Additionally, a switch 179 may be provided to reverse a flow of the refrigerant through the second refrigerant system 145. For example, the flow of the refrigerant may be reversed when the system 150 is switched between the summer mode 180 and the winter mode 182. A compressor 181 is provided to compress the refrigerant. In the summer mode 180, the refrigerant passes through the compressor 181 after exiting the supply air heat exchanger 157 and before entering the regeneration air heat exchanger 165. In the winter mode 182, the refrigerant passes through the compressor 181 after exiting the regeneration air heat exchanger 165 and before entering the supply air heat exchanger 157.

Figure 12:
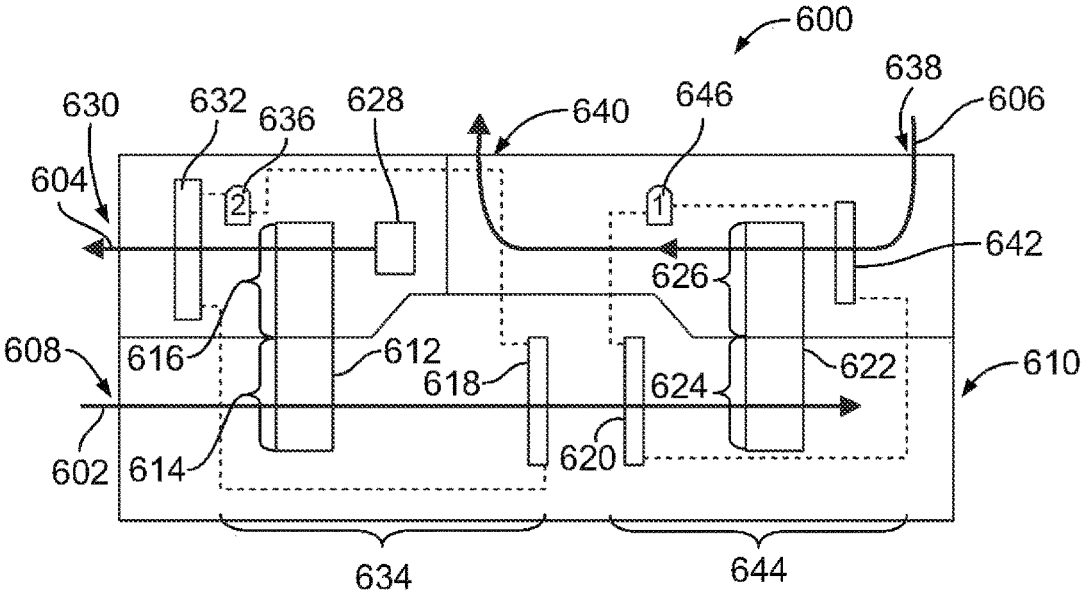
FIG. 12 is a schematic view of another heat pump system formed in accordance with an embodiment.

FIG. 12 is a schematic view of another heat pump system 600 formed in accordance with an embodiment. The system 600 is capable of switching between a summer mode and a winter mode without the need to reconfigure the components of the system 600.

The system 600 includes a supply air flow path 602, a return air flow path 604, and an outside air flow path 606. The supply air flow path 602 travels between a supply air inlet 608 and a supply air outlet 610. In one embodiment, the system 600 may include at least one fan to draw air into and move air through the supply air flow path 602. Outside air flows through the supply air inlet 608 and through a pre-processing module 612 positioned downstream of the supply air inlet 608.

The pre-processing module 612 includes a supply air side 614 and a regeneration air side 616. The supply air side 614 is positioned within the supply air flow path 602. The regeneration air side 616 is positioned within the return air flow path 604. Outside air passes through the supply air side 614 of the pre-processing module 612. The pre-processing module 612 is configured to transfer latent energy and sensible energy between the supply air flow path 602 and the return air flow path 604. The latent energy includes moisture in the flow paths 602 and 604. The pre-processing module 612 transfers heat from a warmer flow path to a cooler flow path. The pre-processing module 612 also transfers humidity from a high humidity flow path to a low humidity flow path. The outside air is cooled as the outside air passes through the pre-processing module 612.

The cooled air from the pre-processing module 612 is discharged into a supply air heat exchanger 618 positioned downstream from the pre-processing module 612. The supply air heat exchanger 618 discharges air into another supply air heat exchanger 620 positioned downstream from the supply air heat exchanger 618. The supply air heat exchangers 618 and 620 operate as evaporator coils or cooling coils in the summer mode. As evaporator coils, the supply air heat exchangers 618 and 620 condition the cooled air and further remove heat from the cooled air to produce saturated air.

A processing module 622 is positioned downstream from the supply air heat exchangers 618 and 620. The saturated air passes through the processing module 622. The processing module 622 includes a supply air side 624 and an outside air side 626. The supply air side 624 is positioned within the supply air flow path 602 and the outside air side 626 is positioned within the outside air flow path 606. The saturated air passes through the supply air side 624 to remove moisture therefrom and produce conditioned supply air that has been further dehumidified. Because the air is first saturated by the supply air heat exchangers 618 and 620, the efficiency of the processing module 622 is increased when dehumidifying the air. The dehumidified supply air flows downstream through the supply air outlet 610 and into the space.

Regeneration air in the form of return air leaves the space at a return air inlet 628 and traverses the return air flow path 604. The return air flow path 604 is defined between the return air inlet 628 and a return air outlet 630. In one embodiment, the system 600 may include at least one fan to draw air into and move air through the return air flow path 604.

The regeneration air side 616 of the pre-processing module 612 is positioned downstream from the return air inlet 628. The return air passes through the regeneration air side 616 of the pre-processing module 612. The pre-processing module 612 transfers heat and moisture into the return air passing through the regeneration air side 616, thereby removing heat from the supply air passing through the supply air side 614. The heated air flows into a regeneration air heat exchanger 632 positioned downstream from the regeneration air side 616 of the pre-processing module 612.

The regeneration air heat exchanger 632 operates as a condenser coil in the summer mode to heat and lower a relative humidity of the conditioned air. The regeneration air heat exchanger 632 is fluidly coupled to the supply air heat exchanger 618 by a refrigerant system 634. The refrigerant system 634 pumps a refrigerant between the regeneration air heat exchanger 632 and the supply air heat exchanger 618. The regeneration air heat exchanger 632 uses the heat from the supply air heat exchanger 618 to lower a relative humidity of the heated air thus increasing the air's capacity to absorb water downstream. In one embodiment, a compressor 636 may be provided in the refrigerant system 634 to condition the refrigerant flowing between the supply air heat exchanger 618 and the regeneration air heat exchanger 632. The heated air from the regeneration air heat exchanger 632 is discharged from the return air outlet 630.

Regeneration air in the form of outside air enters the system 600 at an outside air inlet 638 and traverses the outside air flow path 606. The outside air flow path 606 is defined between the outside air inlet 638 and an outside air outlet 640. In one embodiment, the system 600 may include at least one fan to draw air into and move air through the outside air flow path 606. The outside air flows into a regeneration air heat exchanger 642 positioned downstream from the outside air inlet 638.

The regeneration air heat exchanger 642 operates as a condenser coil in the summer mode to heat and lower a relative humidity of conditioned air. The regeneration air heat exchanger 642 is fluidly coupled to the supply air heat exchanger 620 by a refrigerant system 644. The refrigerant system 644 pumps a refrigerant between the regeneration air heat exchanger 642 and the supply air heat exchanger 620. The regeneration air heat exchanger 642 uses the heat from the supply air heat exchanger 620 to lower the relative humidity of the heated air thus increasing the air's capacity to absorb water downstream. In one embodiment, a compressor 646 may be provided in the refrigerant system 644 to condition the refrigerant flowing between the supply air heat exchanger 620 and the regeneration air heat exchanger 642. The heated air from the regeneration air heat exchanger 642 is discharged into the outside air side 626 of the processing module 622.

The processing module 622 transfers heat and moisture into the supply air passing through the supply air side 624, thereby removing heat from the outside air passing through the outside air side 626. The outside air is discharged from the processing module 622 through the outside air outlet 640.

In a winter mode, the system 600 may be configured to heat and humidify the supply air flowing into the building. For example, the supply air heat exchangers 618 and 620 may be reversed in the winter mode to operate as condenser coils. Additionally, the regeneration air heat exchangers 632 and 642 may be reversed in the winter mode to operate as evaporator coils.

Figure 13:
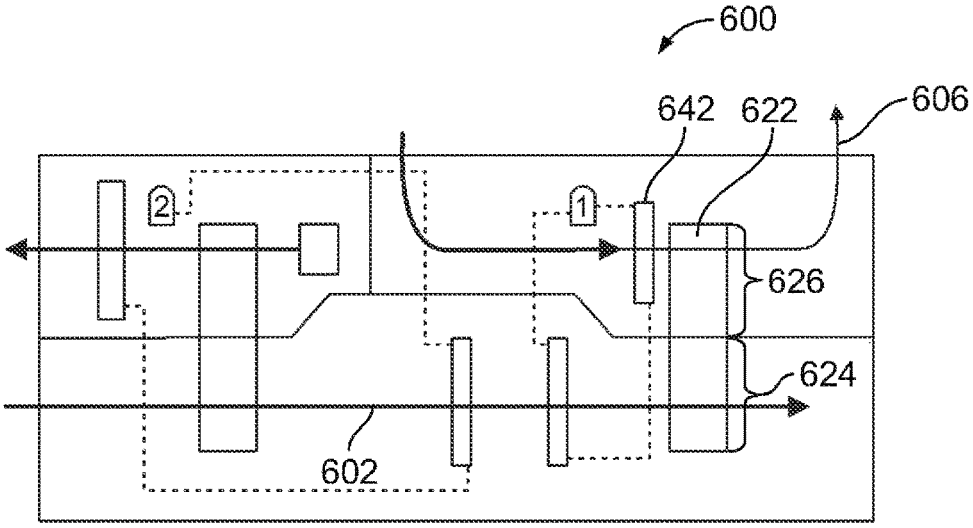
FIG. 13 is a schematic view of another heat pump system formed in accordance with an embodiment.

FIG. 13 is a schematic view of an alternative embodiment of the heat pump system 600. In FIG. 12 the outside air flow path 606 is configured to flow in a counter-flow direction with respect to the supply air flow path 602. In FIG. 13, the regeneration air heat exchanger 642 is positioned on an opposite side of the processing module 622, in comparison to FIG. 12. Accordingly, the outside air flow path 606 illustrated in FIG. 13 is reversed and flows parallel to the supply air flow path 602. Parallel air flow of the outside air flow path 606 and the supply air flow path 602 may improve the transfer of heat and moisture between the outside air side 626 and the supply air side 624 of the processing module 622.

Figure 14:
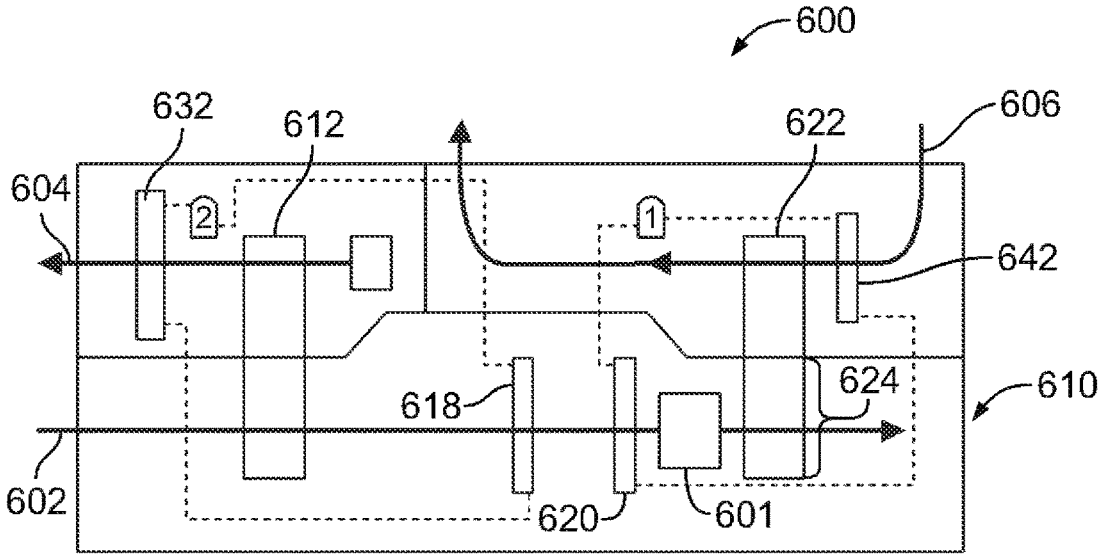
FIG. 14 is a schematic view of another heat pump system formed in accordance with an embodiment.

FIG. 14 is a schematic view of another alternative embodiment of the heat pump system 600. The heat pump system 600 includes an additional heat source 601 positioned between the supply air heat exchanger 620 and the supply air side 624 of the processing module 622. The additional heat source 601 is positioned downstream of the supply air heat exchanger 620 and upstream from the processing module 622. In one embodiment, the additional heat source 601 may be located downstream of the processing module 622. The additional heat source 601 may be a hot water coil, steam coil, electric heater, gas burner, or the like. The additional heat source 601 may be configured for operation in the winter mode. Accordingly, the additional heat source 601 may be shut-off in the summer mode so that the supply air passes through the additional heat source 601 unchanged. In one embodiment, the supply air may by-pass the additional heat source 601 in the summer mode and travel directly from the supply air heat exchanger 620 to the processing module 624.

In the winter mode, the system 600 may have multiple modes of operation. In one embodiment, the system 600 may utilize the additional heat source 601 with the processing module 622 turned off and the pre-processing module 612 turned on to heat and humidify the supply air passing therethrough. In such an embodiment, the supply air heat exchanger 618 and 620 may also be shut off so that only the additional heating source 601 would provide heat after the pre-processing module 612.

In another embodiment, the additional heat source 601 may be operated with either one or both of the supply air heat exchangers 618 and 620. In such an embodiment, the supply air heat exchangers 618 and 620 are operated as condensers to heat the supply air in the supply air flow path 602. Additionally, either one or both of the regeneration air heat exchangers 632 and 642 operate as evaporators to cool the air in the return air flow path 604 and the outside air flow path 606, respectively. In such an embodiment, the processing module 622 may be operated. Accordingly, supply air leaving the supply air heat exchanger 620 could be heated further by the additional heating source 601 before entering the processing module 622 where the supply air is humidified. The outside air flow path 606 is then heated and dehumidified as it passes through the processing module 622.

Figure 15:
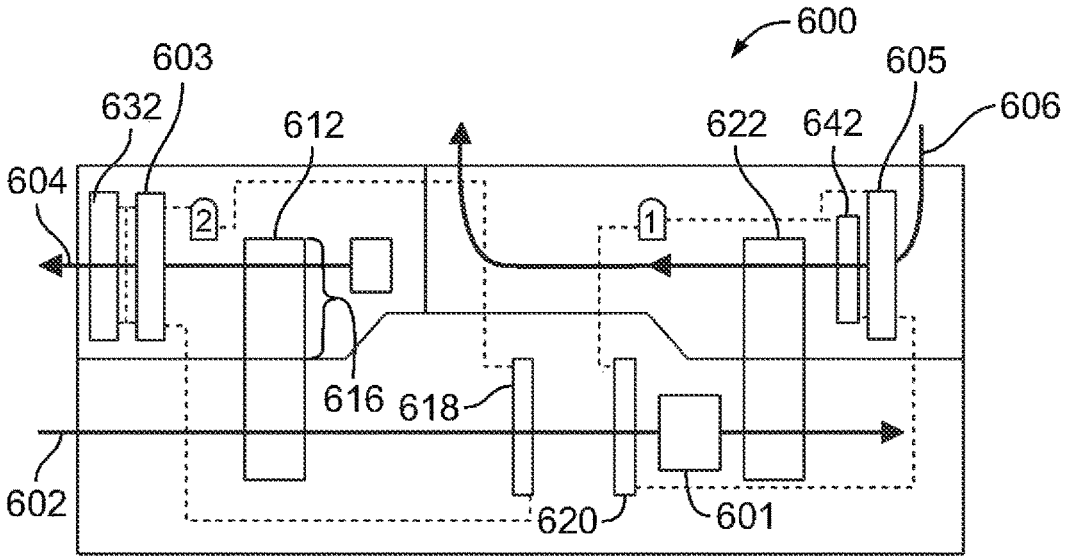
FIG. 15 is a schematic view of another heat pump system formed in accordance with an embodiment.

FIG. 15 is a schematic view of another alternative embodiment of the heat pump system 600. The heat pump system 600 includes the additional heat source 601 (as illustrated in FIG. 14) and a pair of pre-heat coils 603 and 605. The pre-heat coil 603 is positioned in the return air flow path 604 between the regeneration air heat exchanger 632 and the pre-processing module 612. The pre-heat coil 603 is positioned downstream from the regeneration air side 616 of the pre-processing module 612 and upstream from the regeneration air heat exchanger 632. The pre-heat coil 605 is positioned in the outside air flow path 606 upstream of the regeneration air heat exchanger 642 and the processing module 622. The pre-heat coils 603 and 605 may be hot water coils, steam coils, electric heaters, gas burners, heat exchangers tied to the refrigeration system or the like.

In the winter mode, the supply air in the supply air flow path 602 is heated and humidified by the pre-processing module 612 and then heated by supply air heat exchangers 618 and 620. The supply air may also be heated by the additional heat source 601 prior to being cooled and humidified by the processing module 622. The return air in the return air flow path 604 is cooled and dehumidified by the pre-processing module 612. The return air is then pre-heated by the pre-heat coil 603 and cooled by the regeneration air heat exchanger 632. The outside air in the outside air flow path 606 is pre-heated by the pre-heat coil 605 and then cooled by the regeneration air heat exchanger 642. The outside air is then reheated and dehumidified by the processing module 622.

The pre-heat coil 603 offsets a saturation point of the return air stream so that heat absorbed by the pre-processing wheel and transferred to the return air stream is recaptured by the regeneration air heat exchanger 632 without energy being lost. Optionally, a supply pre-heating coil (not shown) may be located upstream of the pre-processing module 612.

Figure 16:
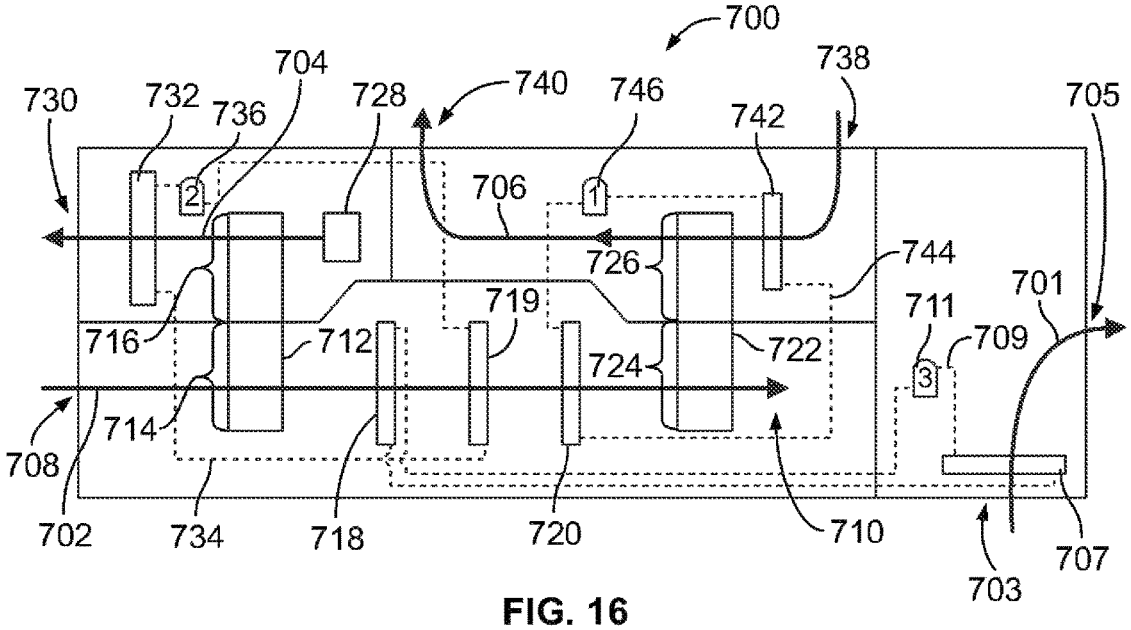
FIG. 16 is a schematic view of another heat pump system formed in accordance with an embodiment.

FIG. 16 is a schematic view of another heat pump system 700 formed in accordance with an embodiment capable of operating in a summer mode or a winter mode.

The system 700 includes a supply air flow path 702, a return air flow path 704, a first outside air flow path 706, and a second outside air flow path 701. The supply air flow path 702 travels between a supply air inlet 708 and a supply air outlet 710. Outside air flows through the supply air inlet 708 and through a pre-processing module 712 positioned downstream of the supply air inlet 708. The pre-processing module 712 includes a supply air side 714 positioned within the supply air flow path 702. Outside air passes through the supply air side 714 of the pre-processing module 712. The pre-processing module 712 is configured to transfer latent energy and sensible energy between the supply air flow path 702 and the return air flow path 704. The supply air is cooled as the supply air passes through the pre-processing module 712.

The cooled air from the pre-processing module 712 is discharged into a supply air heat exchanger 718 positioned downstream from the pre-processing module 712. The supply air heat exchanger 718 discharges air into a second supply air heat exchanger 719 positioned downstream from the supply air heat exchanger 718. The supply air heat exchanger 719 discharges air into a third supply air heat exchanger 720 positioned downstream from the supply air heat exchanger 719. The supply air heat exchangers 718, 719, and 720 operate as evaporator coils or cooling coils in the summer mode.

A processing module 722 is positioned downstream from the supply air heat exchangers 718, 719, and 720. The air passes through the processing module 722. The processing module 722 includes a supply air side 724 positioned within the supply air flow path 702. The air passes through the supply air side 724 to remove moisture therefrom and produce conditioned supply air that has been dehumidified. The dehumidified supply air flows downstream through the supply air outlet 710 and into the space.

Regeneration air in the form of return air leaves the space at return air inlet 728 and traverses the return air flow path 704. The return air flow path 704 is defined between the return air inlet 728 and a return air outlet 730. A return air side 716 of the pre-processing module 712 is positioned downstream from the return air inlet 728. The return air passes through the return air side 716 of the pre-processing module 712. The pre-processing module 712 transfers heat and moisture into the return air passing through the return air side 716, thereby removing heat from the supply air passing through the supply air side 714. The heated air flows into a regeneration air heat exchanger 732 positioned downstream from the return air side 716 of the pre-processing module 712.

The regeneration air heat exchanger 732 operates as a condenser coil in the summer mode to heat and lower a relative humidity of conditioned air. The regeneration air heat exchanger 732 is fluidly coupled to the supply air heat exchanger 719 by a refrigerant system 734. The refrigerant system 734 pumps a refrigerant between the regeneration air heat exchanger 732 and the supply air heat exchanger 719. In one embodiment, a compressor 736 may be provided in the refrigerant system 734 to condition the refrigerant flowing between the supply air heat exchanger 719 and the regeneration air heat exchanger 732. The heated air from the regeneration air heat exchanger 732 is discharged from the return air outlet 730.

Regeneration air in the form of outside air enters the system 700 at an outside air inlet 738 and traverses the outside air flow path 706. The outside air flow path 706 is defined between the outside air inlet 738 and an outside air outlet 740. The outside air flows into a regeneration air heat exchanger 742 positioned downstream from the outside air inlet 738. The regeneration air heat exchanger 742 operates as a condenser coil in the summer mode to heat and lower relative humidity of conditioned air. The regeneration air heat exchanger 742 is fluidly coupled to the supply air heat exchanger 720 by a refrigerant system 744. The refrigerant system 744 pumps a refrigerant between the regeneration air heat exchanger 742 and the supply air heat exchanger 720. In one embodiment, a compressor 746 may be provided in the refrigerant system 744 to condition the refrigerant flowing between the supply air heat exchanger 720 and the regeneration air heat exchanger 742. The heated air from the regeneration air heat exchanger 742 is discharged into an outside air side 726 of the processing module 722.

The processing module 722 transfers heat and moisture into the supply air passing through the supply air side 724, thereby removing heat from the outside air passing through the outside air side 726. The outside air is discharged from the processing module 722 through the outside air outlet 740.

Regeneration air in the form of outside air enters the system 700 at an outside air inlet 703 and traverses the outside air flow path 701. The outside air flow path 701 is defined between the outside air inlet 703 and an outside air outlet 705. The outside air flows into a regeneration air heat exchanger 707 positioned downstream from the outside air inlet 703.

The regeneration air heat exchanger 707 operates as a condenser coil in the summer mode to heat and lower relative humidity of conditioned air. The regeneration air heat exchanger 707 is fluidly coupled to the supply air heat exchanger 718 by a refrigerant system 709. The regeneration air heat exchanger 707 extracts the heat from the supply air heat exchanger 718. In one embodiment, a compressor 711 may be provided in the refrigerant system 709 to condition the refrigerant flowing between the supply air heat exchanger 718 and the regeneration air heat exchanger 707. The heated air from the regeneration air heat exchanger 707 is discharged through the outside side air outlet 705.

In a winter mode, the system 700 may be configured to humidify the supply air flowing into the building. For example, the supply air heat exchangers 718, 719, and 720 may be reversed in the winter mode to operate as condenser coils. Additionally, the regeneration air heat exchangers 707, 732 and 742 may be reversed in the winter mode to operate as evaporator coils.

Figure 17:
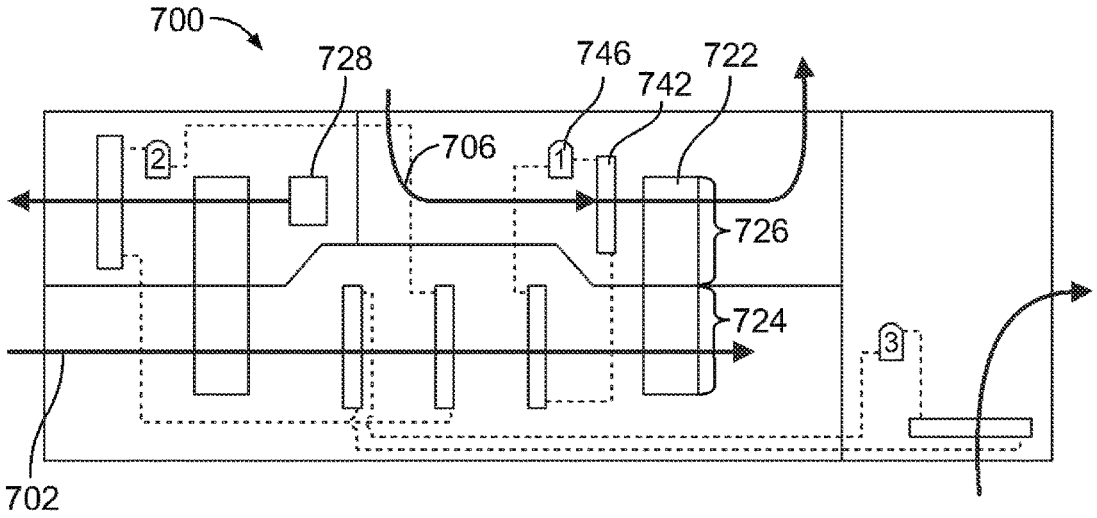
FIG. 17 is a schematic view of another heat pump system formed in accordance with an embodiment.

FIG. 17 is a schematic view of an alternative embodiment of the heat pump system 700. In FIG. 16, the outside air flow path 706 is configured to flow in a counter-flow direction with respect to the supply air flow path 702. In FIG. 17, the regeneration air heat exchanger 742 is positioned on an opposite side of the processing module 722, in comparison to FIG. 16. Accordingly, the outside air flow path 706 illustrated in FIG. 17 is reversed and flows parallel to the supply air flow path 702. Parallel air flow of the outside air flow path 706 and the supply air flow path 702 may improve the transfer of heat and moisture between the outside air side 726 and the supply air side 724 of the processing module 722.

Figure 18:
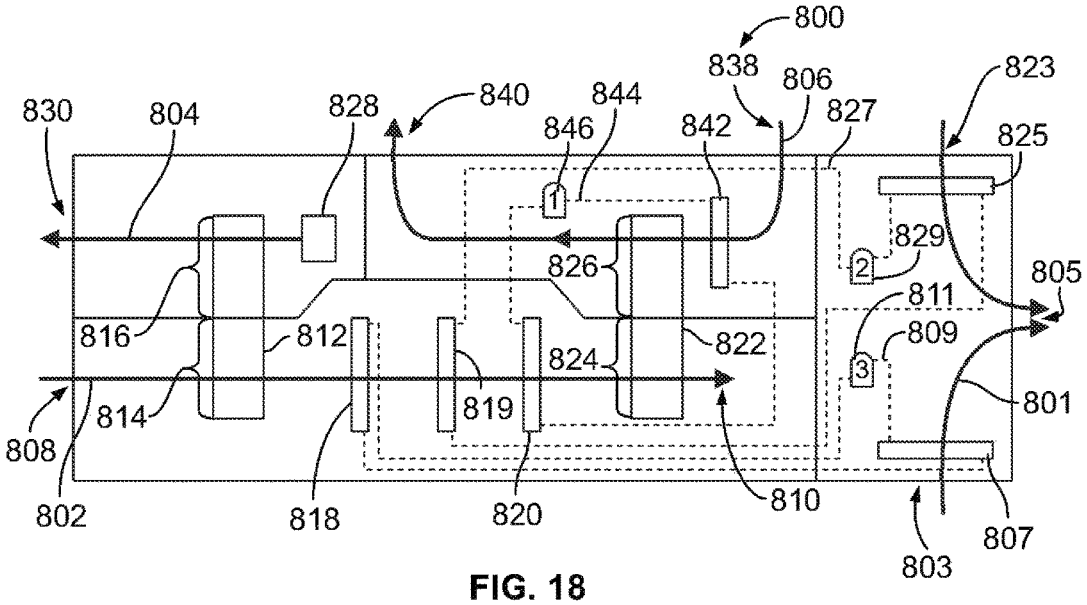
FIG. 18 is a schematic view of another heat pump system formed in accordance with an embodiment.

FIG. 18 is a schematic view of another heat pump system 800 formed in accordance with an embodiment that operates in a summer mode or a winter mode. The system 800 includes a supply air flow path 802, a return air flow path 804, a first outside air flow path 806, a second outside air flow path 801, and third outside air flow path 821. The supply air flow path 802 travels between a supply air inlet 808 and a supply air outlet 810. Outside air flows through the supply air inlet 808 and through a pre-processing module 812 positioned downstream of the supply air inlet 808.

The outside air passes through a supply air side 814 of the pre-processing module 812. The supply air is cooled as the supply air passes through the pre-processing module 812. The cooled air from the pre-processing module 812 is discharged into a supply air heat exchanger 818 positioned downstream from the pre-processing module 812. The supply air heat exchanger 818 discharges air into a second supply air heat exchanger 819 positioned downstream from the supply air heat exchanger 818. The supply air heat exchanger 819 discharges air into a third supply air heat exchanger 820 positioned downstream from the supply air heat exchanger 819. The supply air heat exchangers 818, 819, and 820 operate as evaporator coils or cooling coils in the summer mode.

A processing module 822 is positioned downstream from the supply air heat exchangers 818, 819, and 820. The saturated air passes through a supply air side 824 of the processing module 822 that is positioned within the supply air flow path 802. The air passes through the supply air side 824 to remove moisture therefrom and produce conditioned supply air that has been further dehumidified. The dehumidified supply air flows downstream through the supply air outlet 810 and into the space.

Regeneration air in the form of return air leaves the space at return air inlet 828 and traverses the return air flow path 804 defined between the return air inlet 828 and a return air outlet 830. The return air passes through a return air side 816 of the pre-processing module 812. The pre-processing module 812 transfers heat and moisture into the return air passing through the return air side 816, thereby removing heat from the supply air passing through the supply air side 814. The heated air is discharged from the return air outlet 830.

Regeneration air in the form of outside air enters the system 800 at an outside air inlet 838 and traverses the outside air flow path 806 that is defined between the outside air inlet 838 and an outside air outlet 840. The outside air flows into a regeneration air heat exchanger 842 positioned downstream from the outside air inlet 838. The regeneration air heat exchanger 842 operates as a condenser coil in the summer mode to heat and lower relative humidity of conditioned air. The regeneration air heat exchanger 842 is fluidly coupled to the supply air heat exchanger 820 by a refrigerant system 844. In one embodiment, a compressor 846 may be provided in the refrigerant system 844 to condition the refrigerant flowing between the supply air heat exchanger 820 and the regeneration air heat exchanger 842. The heated air from the regeneration air heat exchanger 842 is discharged into the outside air side 826 of the processing module 822.

The processing module 822 transfers heat and moisture into the supply air passing through the supply air side 824, thereby removing heat from the outside air passing through the outside air side 826. The outside air is discharged from the processing module 822 through the outside air outlet 840.

Regeneration air in the form of outside air enters the system 800 at an outside air inlet 803 and traverses the outside air flow path 801 defined between the outside air inlet 803 and an outside air outlet 805. The outside air flows into a regeneration air heat exchanger 807 positioned downstream from the outside air inlet 803. The regeneration air heat exchanger 807 operates as a condenser coil in the summer mode. The regeneration air heat exchanger 807 is fluidly coupled to the supply air heat exchanger 818 by a refrigerant system 809. The refrigerant system 809 pumps a refrigerant between the regeneration air heat exchanger 807 and the supply air heat exchanger 818. In one embodiment, a compressor 811 may be provided in the refrigerant system 809 to condition the refrigerant flowing between the supply air heat exchanger 818 and the regeneration air heat exchanger 807. The heated air from the regeneration air heat exchanger 807 is discharged through the outside side air outlet 805.

Regeneration air in the form of outside air enters the system 800 at an outside air inlet 823 and traverses the outside air flow path 821 defined between the outside air inlet 823 and the outside air outlet 805. The outside air flows into a regeneration air heat exchanger 825 positioned downstream from the outside air inlet 823.

The regeneration air heat exchanger 825 operates as a condenser coil in the summer mode to heat and lower relative humidity of conditioned air. The regeneration air heat exchanger 825 is fluidly coupled to the supply air heat exchanger 819 by a refrigerant system 827. In one embodiment, a compressor 829 may be provided in the refrigerant system 827 to condition the refrigerant flowing between the supply air heat exchanger 819 and the regeneration air heat exchanger 825. The heated air from the regeneration air heat exchanger 825 is discharged through the outside side air outlet 805.

In a winter mode, the system 800 may be configured to humidify the supply air flowing into the building. For example, the supply air heat exchangers 818, 819, and 820 may be reversed in the winter mode to operate as condenser coils. Additionally, the regeneration air heat exchangers 807, 825 and 842 may be reversed in the winter mode to operate as evaporator coils.

Figure 19:
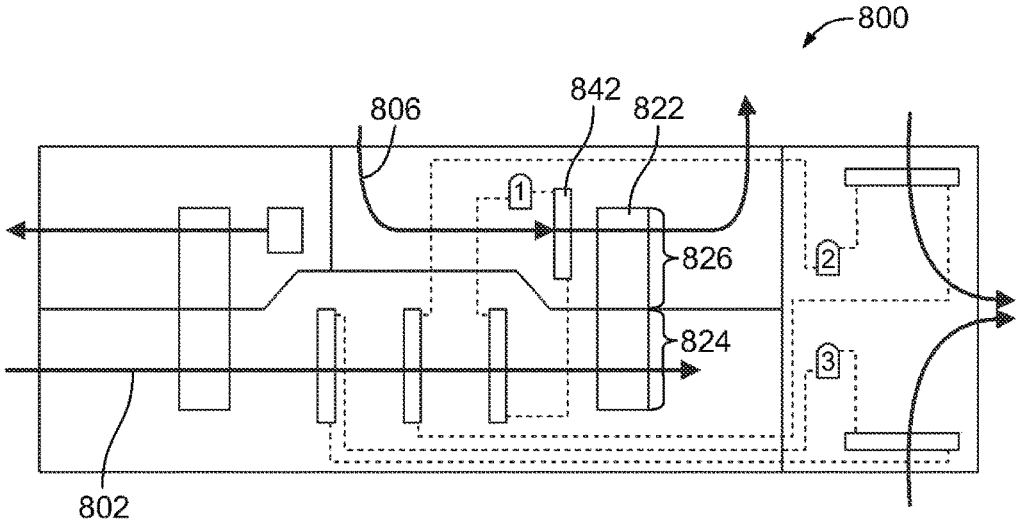
FIG. 19 is a schematic view of another heat pump system formed in accordance with an embodiment.

FIG. 19 is a schematic view of an alternative embodiment of the heat pump system 800. In FIG. 18, the outside air flow path 806 is configured to flow in a counter-flow direction with respect to the supply air flow path 802. In FIG. 19, the regeneration air heat exchanger 842 is positioned on an opposite side of the processing module 822, in comparison to FIG. 18. Accordingly, the outside air flow path 806 illustrated in FIG. 19 is reversed and flows parallel to the supply air flow path 802. Parallel air flow of the outside air flow path 806 and the supply air flow path 802 may improve the transfer of heat and moisture between the outside air side 826 and the supply air side 824 of the processing module 822.

Figure 20:
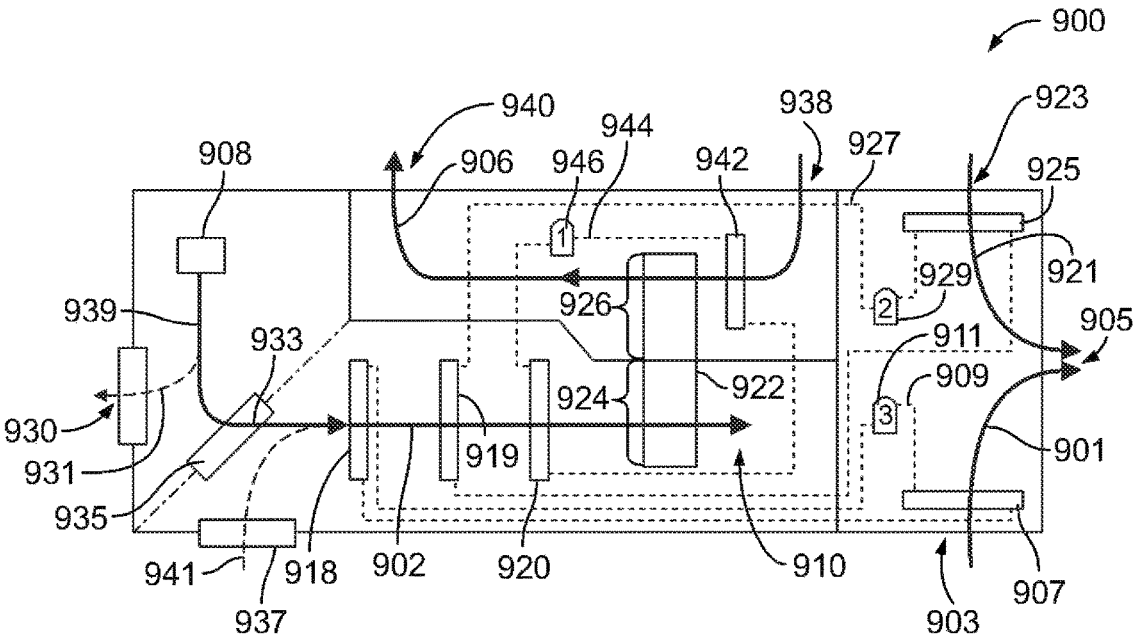
FIG. 20 is a schematic view of another heat pump system formed in accordance with an embodiment.

FIG. 20 is a schematic view of another heat pump system 900 formed in accordance with an embodiment. The system 900 includes a supply air flow path 902, a first outside air flow path 906, a second outside air flow path 901, and third outside air flow path 921. The supply air flow path 902 includes return air 939 that enters the supply air flow path 902 through a return air inlet 908. A portion 931 of the return air is discharged through a return air outlet 930 as exhaust air. Another portion 933 of the return air enters a mixing box 935. The supply air flow path 902 also includes outside air 941 that enters an outside air inlet 937 and mixes with the portion 933 of the return air to form the supply air.

The supply air flows into a supply air heat exchanger 918. The supply air heat exchanger 918 discharges air into a second supply air heat exchanger 919 positioned downstream from the supply air heat exchanger 918. The supply air heat exchanger 919 discharges air into a third supply air heat exchanger 920 positioned downstream from the supply air heat exchanger 919. The supply air heat exchangers 918, 919, and 920 operate as evaporator coils or cooling coils in the summer mode. The air passes through a supply air side 924 of the processing module 922 and then flows downstream through a supply air outlet 910 and into the space.

Regeneration air in the form of outside air enters the system 900 at an outside air inlet 938 and traverses the outside air flow path 906 that is defined between the outside air inlet 938 and an outside air outlet 940. The outside air flows into a regeneration air heat exchanger 942 positioned downstream from the outside air inlet 938.

The regeneration air heat exchanger 942 operates as a condenser coil in the summer mode. The regeneration air heat exchanger 942 is fluidly coupled to the supply air heat exchanger 920 by a refrigerant system 944. In one embodiment, a compressor 946 may be provided in the refrigerant system 944 to condition the refrigerant flowing between the supply air heat exchanger 920 and the regeneration air heat exchanger 942. The heated air from the regeneration air heat exchanger 942 is discharged into an outside air side 926 of the processing module 922.

The processing module 922 transfers heat and moisture into the supply air passing through the supply air side 924, thereby removing heat from the outside air passing through the outside air side 926. The outside air is discharged from the processing module 922 through the outside air outlet 940.

Regeneration air in the form of outside air enters the system 900 at an outside air inlet 903 and traverses the outside air flow path 901 defined between the outside air inlet 903 and an outside air outlet 905. The outside air flows into a regeneration air heat exchanger 907 positioned downstream from the outside air inlet 903.

The regeneration air heat exchanger 907 operates as a condenser coil in the summer mode. The regeneration air heat exchanger 907 is fluidly coupled to the supply air heat exchanger 918 by a refrigerant system 909 having a compressor 911 to condition the refrigerant flowing between the supply air heat exchanger 918 and the regeneration air heat exchanger 907. The heated air from the regeneration air heat exchanger 907 is discharged through the outside side air outlet 905.

Regeneration air in the form of outside air enters the system 900 at an outside air inlet 923 and traverses the outside air flow path 921 defined between the outside air inlet 923 and the outside air outlet 905. The outside air flows into a regeneration air heat exchanger 925 positioned downstream from the outside air inlet 923 and fluidly coupled to the supply air heat exchanger 919 by a refrigerant system 927 having a compressor 929. The heated air from the regeneration air heat exchanger 925 is discharged through the outside side air outlet 905.

In a winter mode, the system 900 may be configured to humidify the supply air flowing into the building. For example, the supply air heat exchangers 918, 919, and 920 may be reversed in the winter mode to operate as condenser coils. Additionally, the regeneration air heat exchangers 907, 925 and 942 may be reversed in the winter mode to operate as evaporator coils.

Figure 21:
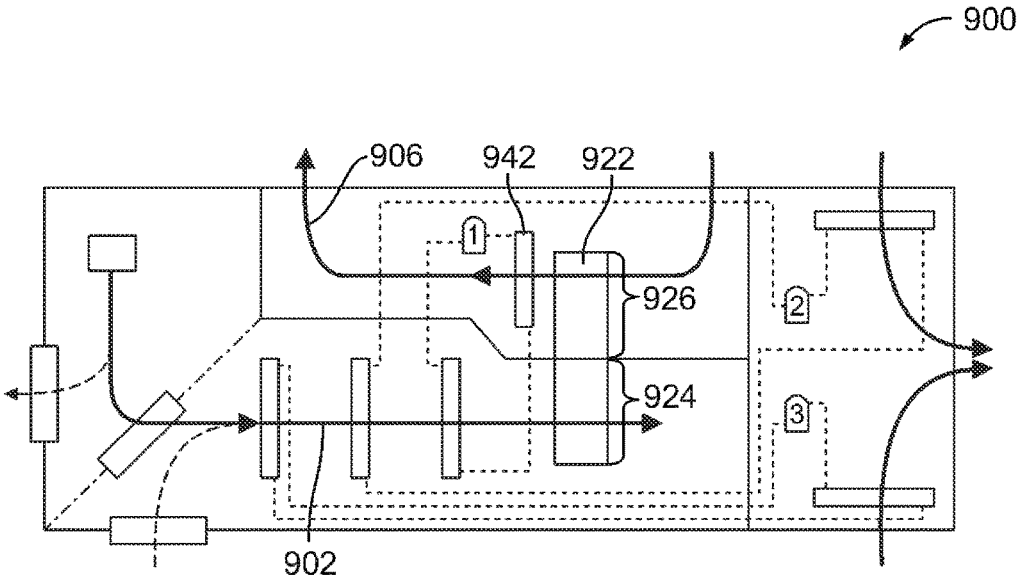
FIG. 21 is a schematic view of another heat pump system formed in accordance with an embodiment.

FIG. 21 is a schematic view of an alternative embodiment of the heat pump system 900. In FIG. 20, the outside air flow path 906 is configured to flow in a counter-flow direction with respect to the supply air flow path 902. In FIG. 21, the regeneration air heat exchanger 942 is positioned on an opposite side of the processing module 922, in comparison to FIG. 20. Accordingly, the outside air flow path 906 illustrated in FIG. 21 is reversed and flows parallel to the supply air flow path 902. Parallel air flow of the outside air flow path 906 and the supply air flow path 902 may improve the transfer of heat and moisture between the outside air side 926 and the supply air side 924 of the processing module 922.

Figure 22:
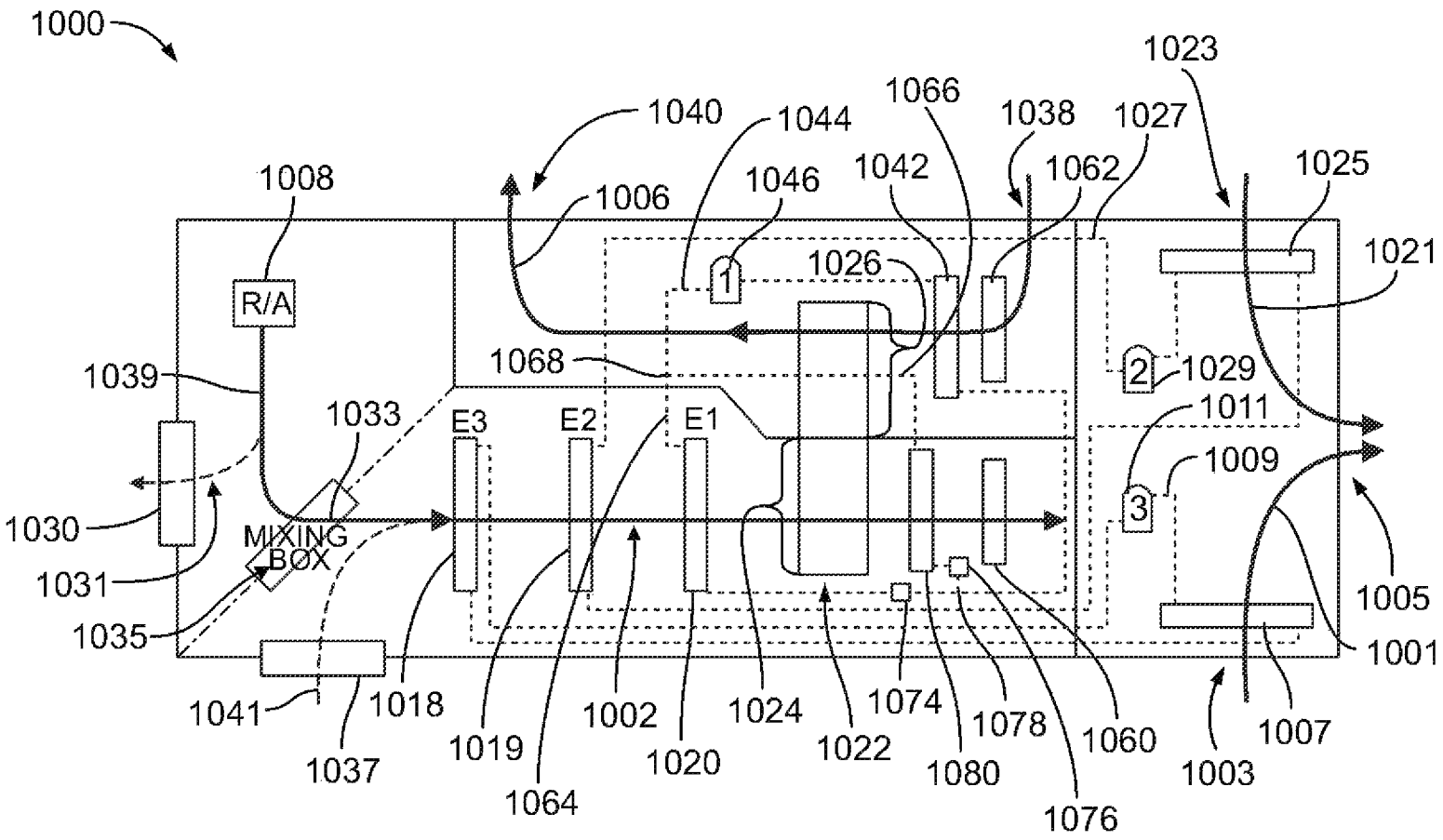
FIG. 22 is a schematic view of another heat pump system formed in accordance with an embodiment.

FIG. 22 is a schematic view of another heat pump system 1000 formed in accordance with an embodiment. The system 1000 includes a supply air flow path 1002, a first outside air flow path 1006, a second outside air flow path 1001, and third outside air flow path 1021. The supply air flow path 1002 includes return air 1039 that enters the supply air flow path 1002 through a return air inlet 1008. A portion 1031 of the return air is discharged through a return air outlet 1030 as exhaust air. Another portion 1033 of the return air enters a mixing box 1035. The supply air flow path 1002 also includes outside air 1041 that enters an outside air inlet 1037 and mixes with the portion 1033 of the return air to form the supply air.

The supply air flows into a supply air heat exchanger 1018. The supply air heat exchanger 1018 discharges air into a second supply air heat exchanger 1019 positioned downstream from the supply air heat exchanger 1018. The supply air heat exchanger 1019 discharges air into a third supply air heat exchanger 1020 positioned downstream from the supply air heat exchanger 1019. The supply air heat exchangers 1018, 1019, and 1020 operate as evaporator coils or cooling coils in the summer mode. The air passes through a supply air side 1024 of the processing module 1022 and then flows downstream to a fourth supply air heat exchanger 1080. The supply air heat exchanger 1080 also operates as evaporator coils or cooling coils in the summer mode. The air passes from the supply air heat exchanger 1080 to a reheat coil 1060 that reheats the supply air during the winter mode.

Regeneration air in the form of outside air enters the system 1000 at an outside air inlet 1038 and traverses the outside air flow path 1006 that is defined between the outside air inlet 1038 and an outside air outlet 1040. The outside air flows into a regeneration pre-reheat coil 1062 positioned downstream from the outside air inlet 1038. The air leaving the regeneration pre-reheat coil 1062 then passes into a regeneration air heat exchanger 1042 positioned downstream from the regeneration pre-reheat coil 1062.

The regeneration air heat exchanger 1042 operates as a condenser coil in the summer mode. The regeneration air heat exchanger 1042 is fluidly coupled to the supply air heat exchanger 1020 and the supply air heat exchanger 1080 by a refrigerant system 1044. In one embodiment, a compressor 1046 may be provided in the refrigerant system 1044 to condition the refrigerant flowing between the supply air heat exchangers 1020 and 1080, and the regeneration air heat exchanger 1042. The heated air from the regeneration air heat exchanger 1042 is discharged into an outside air side 1026 of the processing module 1022.

The refrigerant system 1044 includes a node branch 1068 located downstream, along the fluid flow path, from the compressor 1046. At the node branch 1068, the fluid path splits along parallel refrigerant branches 1064 and 1066. The refrigerant branch 1064 extends to and from the heat exchanger 1020 that is located upstream of the process module 1022, while the refrigerant branch 1066 extends to and from the heat exchanger 1080 that is located downstream of the process module 1022. Valves 1074 and 1076 are located along the branches 1064 and 1066, respectively, to permit and inhibit flow of the coolant fluid through one or both of the branches 1064 and 1066. The outlets of the valves 1074 and 1076 merge again at node 1078 and re-circulate to the heat exchanger 1042. The valves 1074 and 1076 may be automatically controlled by a controller module. The valves 1074 and 1076 may be adjusted between fully open, fully closed, partially open and partially closed positions to vary the amount of coolant fluid that flows along each of the branches 1064 and 1066. The valves 1074 and 1076 may be adjusted based upon summer versus winter mode.

The processing module 1022 transfers heat and moisture into the supply air passing through the supply air side 1024, thereby removing heat from the outside air passing through the outside air side 1026. The outside air is discharged from the processing module 1022 through the outside air outlet 1040.

Regeneration air in the form of outside air enters the system 1000 at an outside air inlet 1003 and traverses the outside air flow path 1001 defined between the outside air inlet 1003 and an outside air outlet 1005. The outside air flows into a regeneration air heat exchanger 1007 positioned downstream from the outside air inlet 1003.

The regeneration air heat exchanger 1007 operates as a condenser coil in the summer mode. The regeneration air heat exchanger 1007 is fluidly coupled to the supply air heat exchanger 1018 by a refrigerant system 1009 having a compressor 1011 to condition the refrigerant flowing between the supply air heat exchanger 1018 and the regeneration air heat exchanger 1007. The heated air from the regeneration air heat exchanger 1007 is discharged through the outside side air outlet 1005.

Regeneration air in the form of outside air enters the system 1000 at an outside air inlet 1023 and traverses the outside air flow path 1021 defined between the outside air inlet 1023 and the outside air outlet 1005. The outside air flows into a regeneration air heat exchanger 1025 positioned downstream from the outside air inlet 1023 and fluidly coupled to the supply air heat exchanger 1019 by a refrigerant system 1027 having a compressor 1029. The heated air from the regeneration air heat exchanger 1025 is discharged through the outside side air outlet 1005.

In a winter mode, the system 1000 may be configured to humidify the supply air flowing into the building. For example, the supply air heat exchangers 1018, 1019, 1020 and 1080 may be reversed in the winter mode to operate as condenser coils. Additionally, the regeneration air heat exchangers 1007, 1025 and 1042 may be reversed in the winter mode to operate as evaporator coils.

Figure 23:
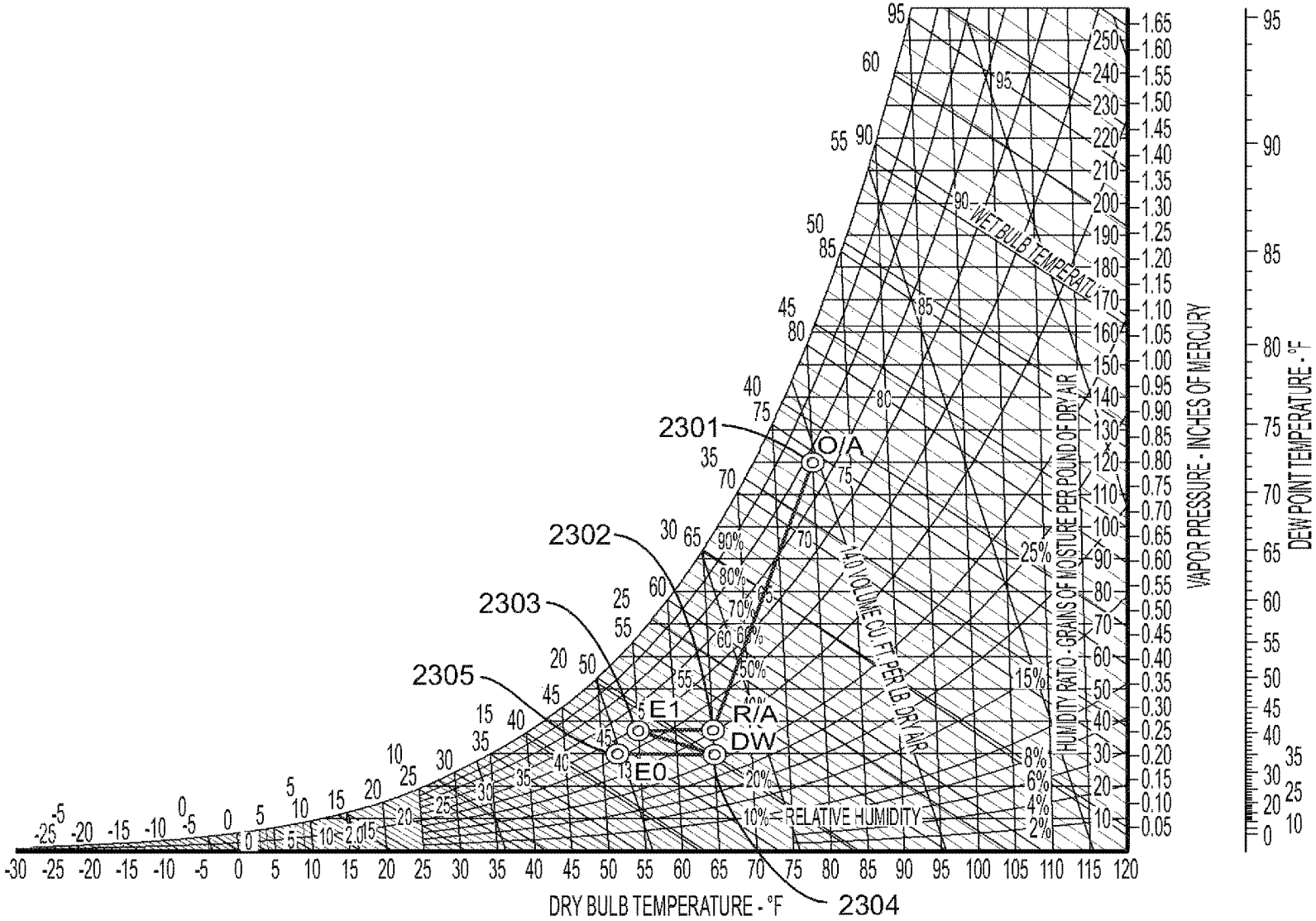
FIG. 23 is a psychrometric chart of the supply air of a heat pump system operating in a summer mode.

FIGS. 23-30 illustrates psychrometric charts for the system 1000 when operating in various configurations. FIGS. 23-30 illustrate exemplary data points representative of the air condition when passing between designated regions within system 1000. FIG. 23 illustrates the system 1000 when using 100% return air as the entering air while configured to perform pre-cooling with postdehumidification and sensible cooling. In this configuration, the outside air inlet 1037 is closed such that return air through return air inlet 1008 provides all of the supply air. The supply air heat exchangers 1018 and 1019 are turned off and only the supply air heat exchanger 1020 is active. FIG. 23 illustrates outside air at data point 2301 with a dry bulb temperature of 80° F., a wet bulb temperature of approximately 74° F. and a relative humidity of approximately 78%. FIG. 23 also illustrates return air at data point 2302 with a dry bulb temperature of 65° F., a wet bulb temperature of approximately 52° F. and a relative humidity of approximately 40%. As the air passes through the supply air heat exchanger 1020, the humidity and temperature of the return air is changed to data point 2303, and as the air passes through the processing module 1022, the air conditions are adjusted to data point 2304 (dry bulb temperature of 65° F., wet bulb temperature of 50° F. and 31% relative humidity). As the air passes through the supply air heat exchanger 1080, the conditions are further changed to data point 2305 and supplied to the controlled space (dry bulb temperature of 52° F., wet bulb temperature of 44° F. and relative humidity 50%). The heat exchanger 1080 performs post-dehumidification sensible cooling only without changing the humidity of the supply air.

Figure 24:
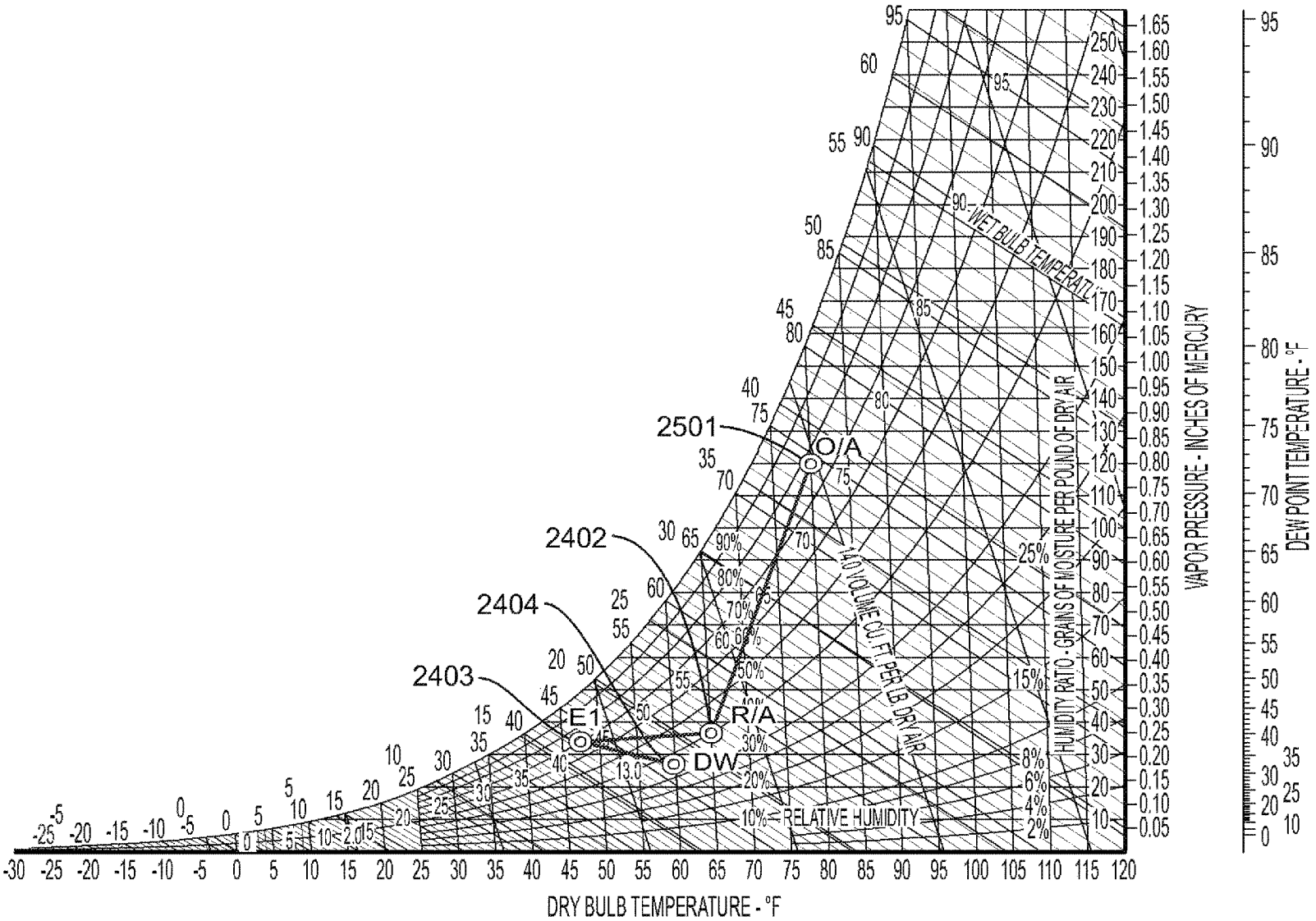
FIG. 24 is a psychrometric chart of the supply air of a heat pump system operating in a summer mode.

FIG. 24 illustrates a psychrometric chart for the system 1000 when operating with 100% return air as the entering supply air. In this configuration, the outside air inlet 1037 is closed such that return air through return air inlet 1008 provides all of the supply air. The supply air heat exchangers 1018 and 1019 are turned off and only the supply air heat exchanger 1020 is active. The supply air heat exchanger 1020 changes the supply air condition from the data point 2402 (dry bulb temperature of 65° F., wet bulb temperature of 52° F. relative humidity 40%) to the conditions at data point 2403 (dry bulb temperature of 46° F., wet bulb temperature of 43° F. relative humidity 80%). Next as the air passes downstream from the heat exchanger 1020 through the processing module 1022, the conditions of the supply air are moved from data point 2403 to the conditions at data point 2404 (dry bulb temperature of 60° F., wet bulb temperature of 47° F. and relative humidity approximately 36%). There is no post-dehumidification sensible cooling.

Figure 25:
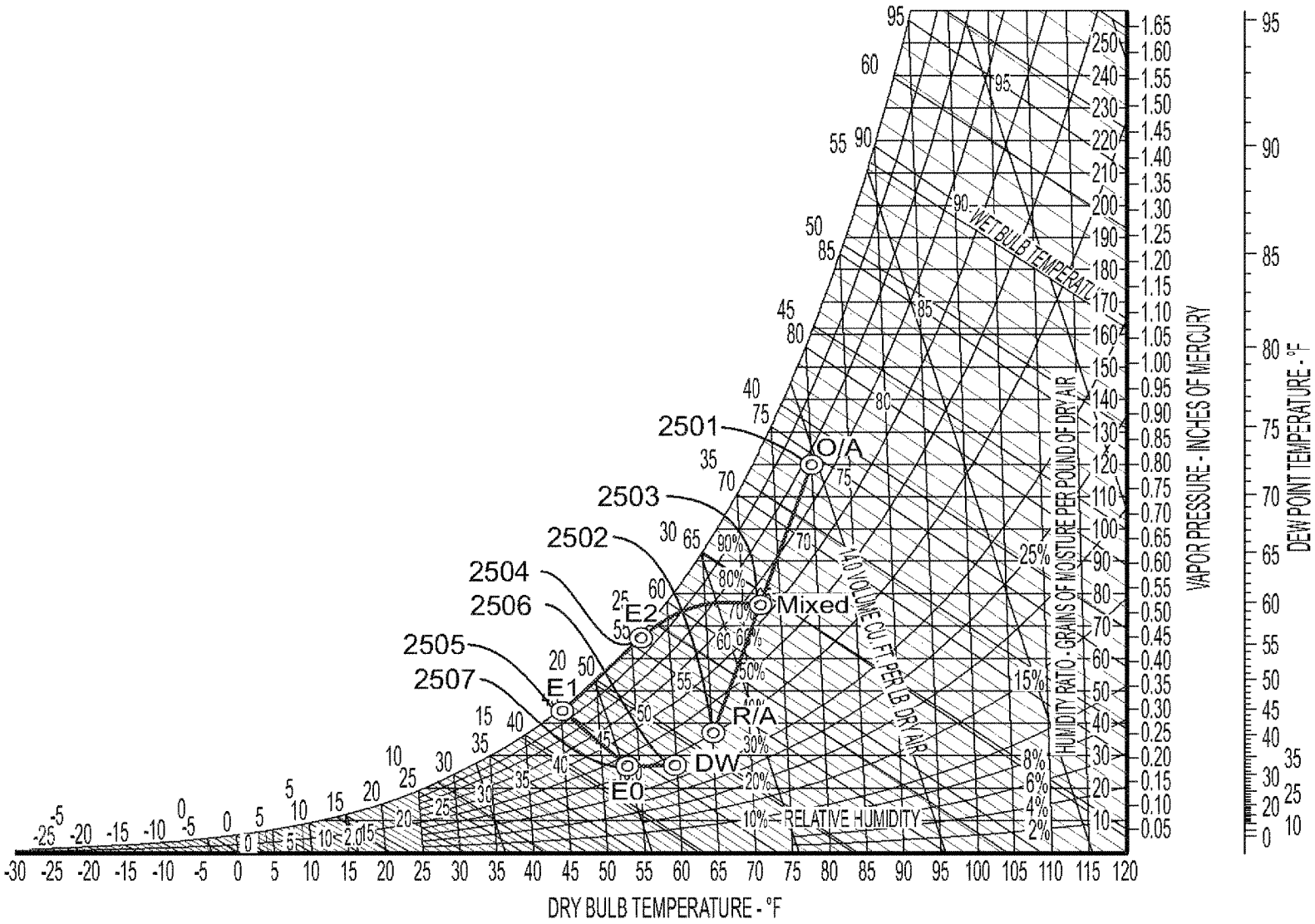
FIG. 25 is a psychrometric chart of the supply air of a heat pump system operating in a summer mode.

FIG. 25 illustrates a psychrometric chart for the system 1000 when operating in the summer mode with 50% return air and 50% outside air combined as the entering air at the mixing box 1035. The psychrometric chart of FIG. 25 is representative of the supply air processing when the system 1000 performs pre-cooling with post-dehumidification and sensible cooling. As shown in FIG. 25, the outside air conditions may begin at data point 2501 (dry bulb temperature of 80° F., wet bulb temperature of 74° F. and relative humidity of 78%), while the return air begins with the conditions at data point 2502 (dry bulb temperature of 65° F., wet bulb temperature of 52° F. and relative humidity of 40%). When the outside air and return air are mixed at the mixing box 1035, the air conditions are representative of data point 2503 (dry bulb temperature of 72° F., wet bulb temperature of 64° F. and relative humidity of 67%). In the example of FIG. 25, the system 1000 operates supply air heat exchanges 1019 and 1020, as well as heat exchanger 1080. The air passing from the mixing box 1035 is conditioned by the heat exchanger 1019 to change the conditions of the air to data point 2504 (dry bulb temperature of 57° F., wet bulb temperature of 57° F. and approximately 100% relative humidity, mainly at saturation), as the air exits downstream of the heat exchanger 1019. The heat exchanger 1020 then further processes the supply air to the conditions denoted at data point 2505 (dry bulb temperature of 46° F., wet bulb temperature of 46° F. and 100% relative humidity, mainly at saturation). The air exiting the heat exchanger 1020 passes through the processing module 1022 and is conditioned to the state denoted at data point 2506 when discharged from the processing module 1022 (dry bulb temperature of 59° F., wet bulb temperature of 47° F. and relative humidity of 37%). Next, the air on the discharge side of the processing module 1022 passes through the heat exchanger 1080 and its condition is changed to the state denoted at data point 2507 (dry bulb temperature of 53° F., wet bulb temperature of 44° F. and relative humidity 44%). The heat exchanger 1080 performs post-dehumidification sensible cooling.

Figure 26:
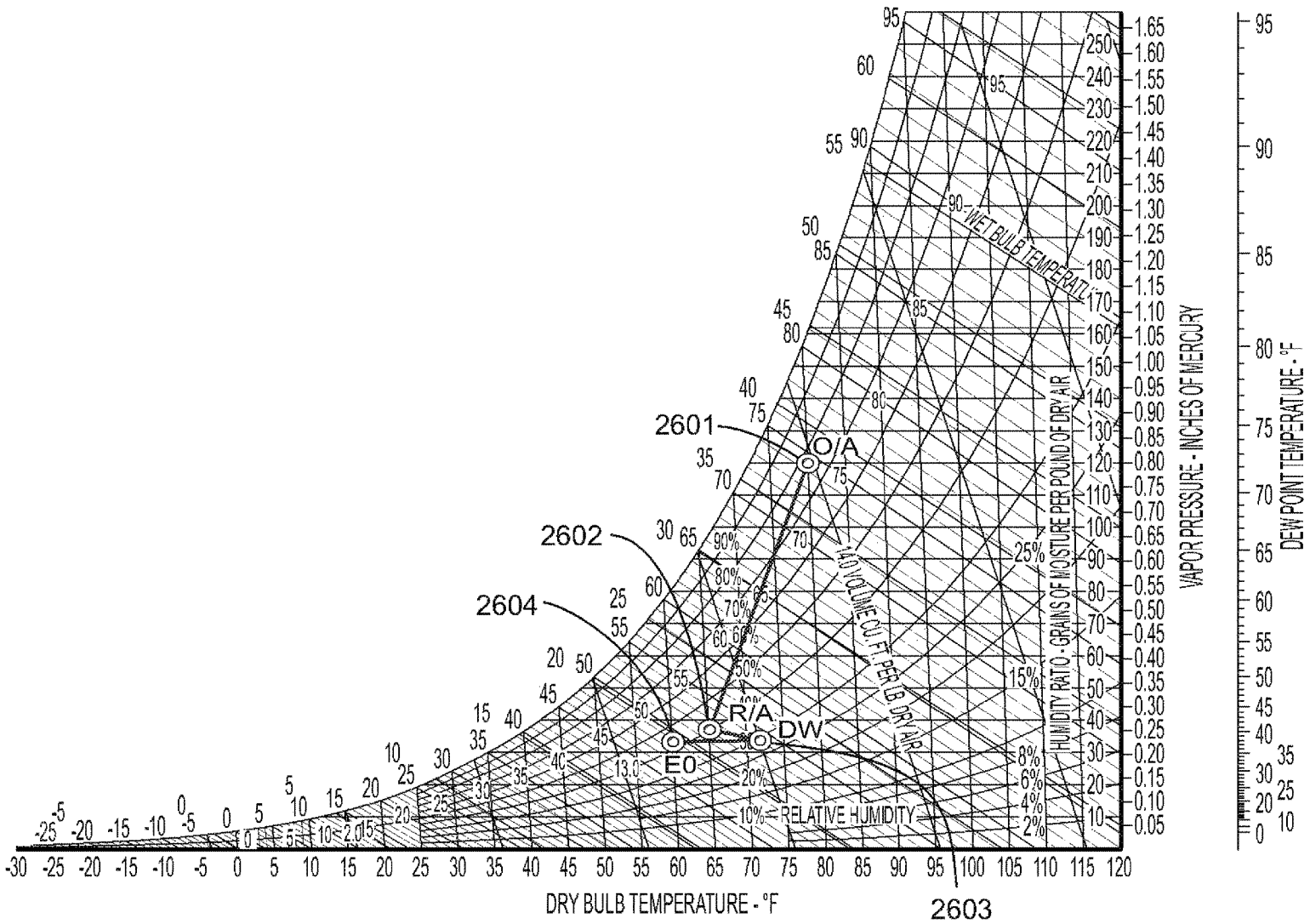
FIG. 26 is a psychrometric chart of the supply air of a heat pump system operating in a summer mode.

FIG. 26 illustrates a psychrometric chart for the operation of the system 1000 when utilizing 100% return air as the entering air and without using any pre-cooling from any of heat exchangers 1018, 1019 and 1020, but while using post-dehumidification sensible cooling at heat exchanger 1080. The outside air conditions are the same as denoted in previous examples at data point 2601, while the return air conditions are as denoted at data point 2602. The supply air with the conditions of data point 2602 are passed through the processing module 1022 and adjusted to the state denoted at data point 2603 (dry bulb temperature of 72° F., wet bulb temperature of 54° F. and relative humidity 28%). Next the supply air at the discharge side of the processing module 1022 passes through the heat exchanger 1080 at which post-dehumidification sensible cooling is performed to reduce the state of the supply air to the point denoted at data point 2604 (dry bulb temperature of 60° F., wet bulb temperature of 49° F. and relative humidity 42%).

Figure 27:
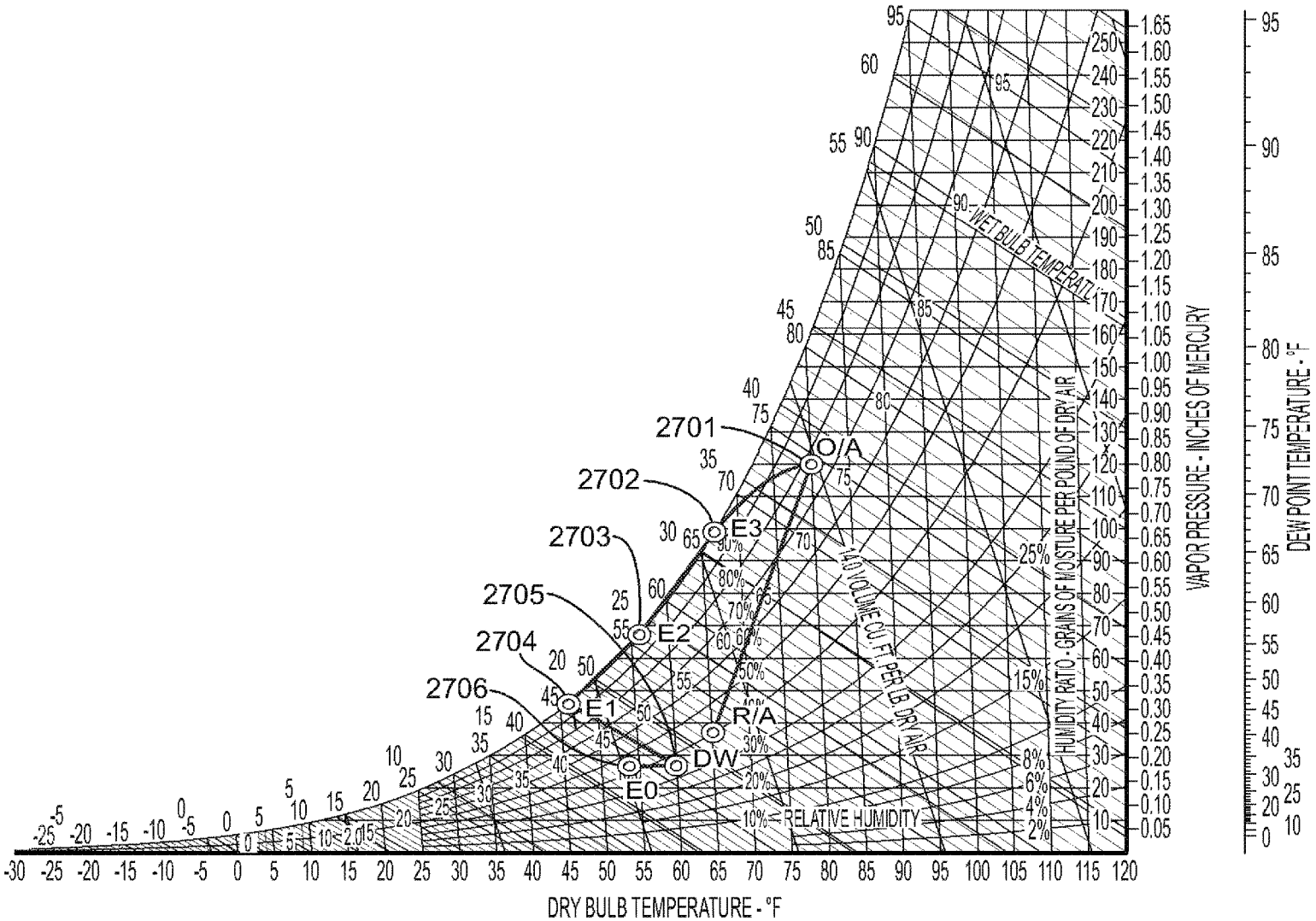
FIG. 27 is a psychrometric chart of the supply air of a heat pump system operating in a summer mode.

FIG. 27 illustrates a psychrometric chart for the operation of the system 1000 when utilizing 100% outside air and no return air at entering air. The psychrometric chart of FIG. 27 reflects the operation of the system 1000 when performing pre-cooling at each of heat exchangers 1018, 1019 and 1020, and while performing post-dehumidification sensible cooling at heat exchanger 1080. Beginning at data point 2701, the conditions of the entering air are changed at heat exchangers 1018, 1019 and 1020 as denoted at data point 2702, 2703 and 2704, respectively. The air conditions at the discharge side of heat exchanger 1020 (as denoted at data point 2704) are at a humidity saturation point (e.g. 100% relative humidity). The air discharged from heat exchanger 1020 then passes through the processing module 1022 where the condition of the air is changed to the conditions at data point 2705 (60° F. dry bulb temperature, 47° F. wet bulb temperature and 38% relative humidity). The air discharged from the processing module 1022 then passes through the heat exchanger 1080 at which post-dehumidification sensible cooling is performed to change the conditions of the air to the conditions state denoted at data point 2706 (dry bulb temperature of 54° F., wet bulb temperature of 44° F. and relative humidity 42%).

Figure 28:
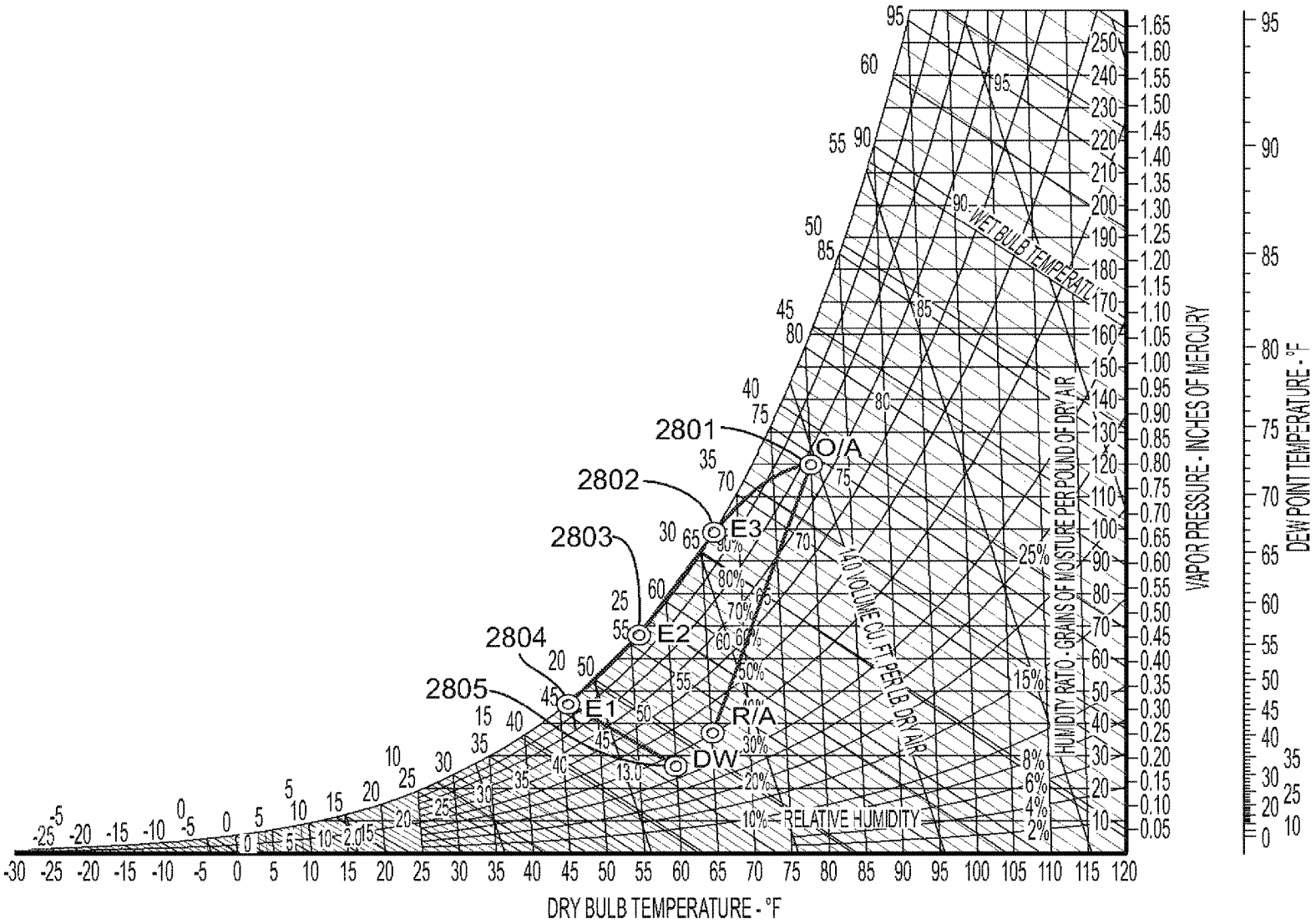
FIG. 28 is a psychrometric chart of the supply air of a heat pump system operating in a summer mode.

FIG. 28 illustrates a psychrometric chart of the operation of the processing module 1000 when using 100% outside air and no return air at the entering air. The psychrometric chart of FIG. 28 illustrates the configuration of the system 1000 when each of heat exchangers 1018, 1019 and 1020 are operated, but while heat exchanger 1080 is turned off and does not perform any post-dehumidification sensible cooling. As shown in FIG. 28, the outside air conditions begin at data point 2801 and are changed to correspond to data point 2802, 2803 and 2804 when passing through each of the heat exchangers 1018, 1019 and 1020, respectively. The conditions at the downstream side of the heat exchanger 1020 (data point 2804) have a dry bulb temperature of 46° F., wet bulb temperature of 46° F. and is saturated along the moisture saturation line. As the air passes through the processing module 1022, the conditions of the air are changed to the state denoted at data point 2805 (dry bulb temperature of 59° F., wet bulb temperature of 47° F. and relative humidity of 37%). The air conditions at the discharge side of the processing module 1022 remain steady as the air is passed into the conditioned space without any further post-dehumidification sensible cooling.

Figure 29:
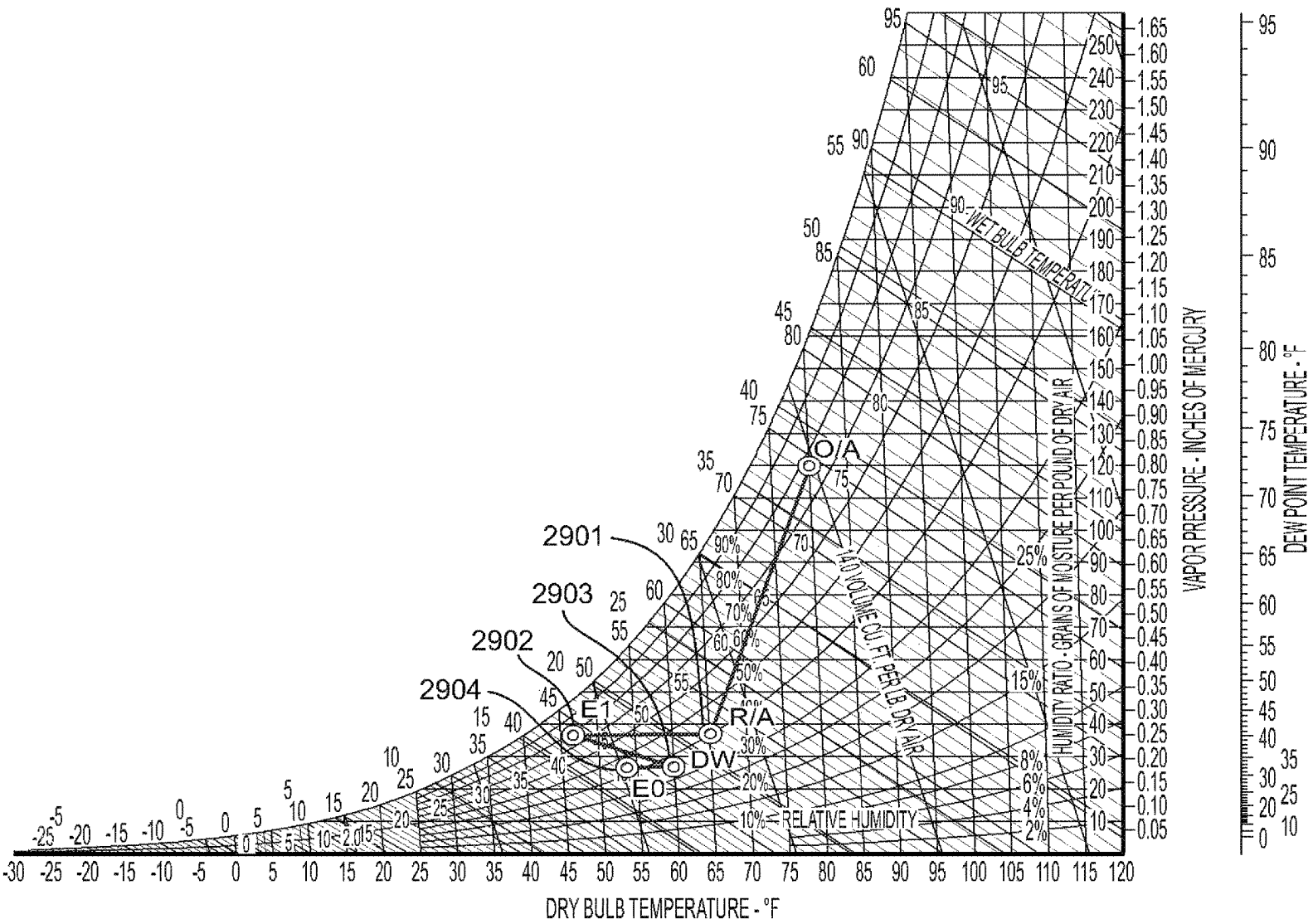
FIG. 29 is a psychrometric chart of the supply air of a heat pump system operating in a summer mode.

FIG. 29 illustrates a configuration in which the system 1000 utilizes 100% return air as the entering air with no outside air being introduced. In FIG. 29, the system 1000 is configured to perform pre-cooling, only utilizing the heat exchanger 1020, while the heat exchangers 1018 and 1019 are turned off. The system 1000 is also configured in the example of FIG. 29 to perform post-dehumidification sensible cooling at heat exchanger 1080. As shown in FIG. 29 the entering air beings at the conditions denoted at data point 2901 corresponding to the conditions of return air. As the entering air passes through the heat exchanger 1020, the conditions are changed to the state denoted at data point 2902 (dry bulb temperature of 47° F., wet bulb temperature of 43° F. and relative humidity 80%). As the air passes from the heat exchanger in 1020 through the processing module 1022, the conditions of the air are changed to the state denoted at data point 2903 (dry bulb temperature of 60° F., wet bulb temperature of 47° F. and relative humidity 27%). As the air passes from the discharge side of the processing module at 1022 through the heat exchanger 1080, the conditions of the air are changed to the state denoted at data point 2904 (dry bulb temperature of 54° F., wet bulb temperature of 44° F. and relative humidity 43%).

Figure 30:
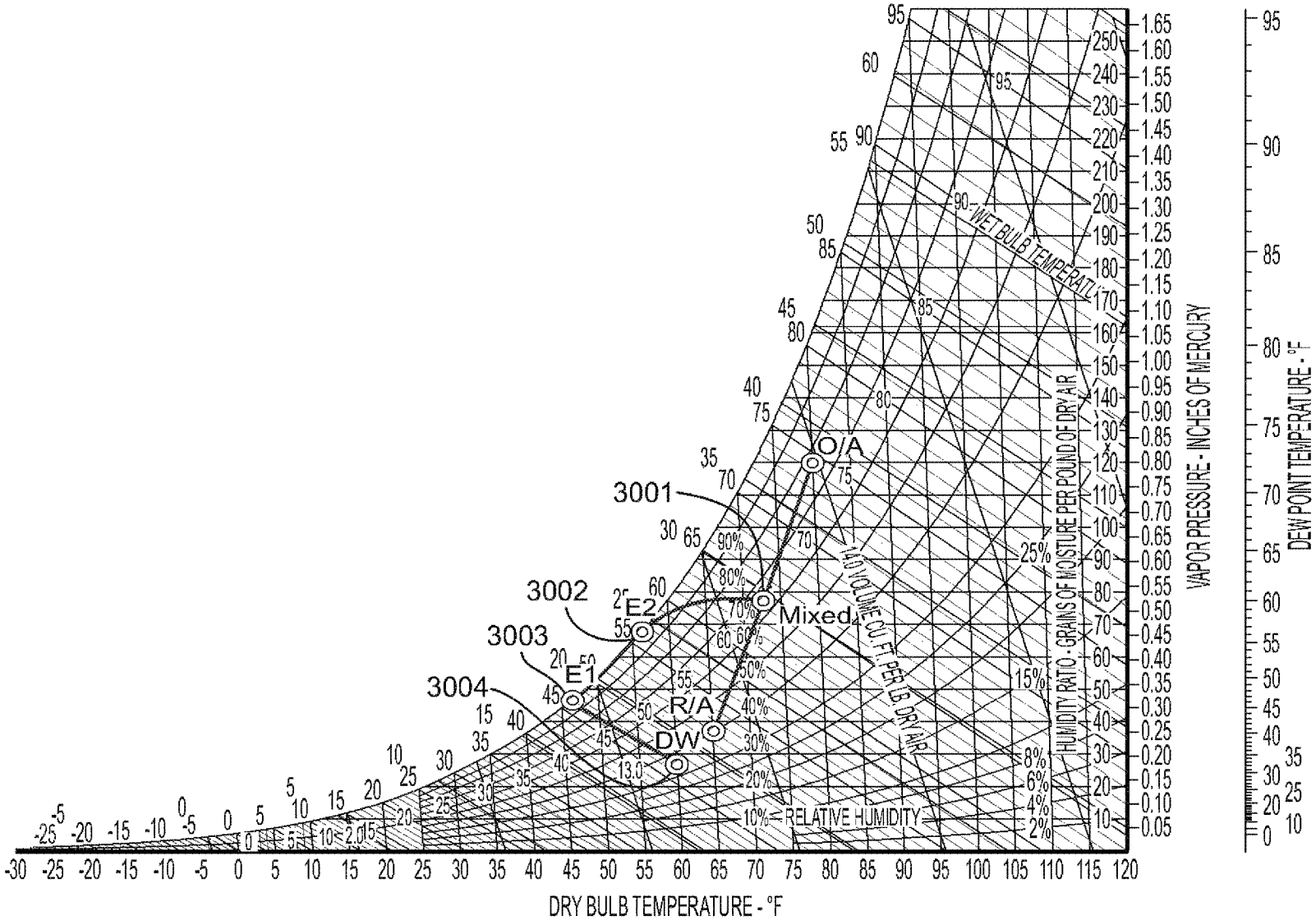
FIG. 30 is a psychrometric chart of the supply air of a heat pump system operating in a summer mode.

FIG. 30 illustrates a psychrometric chart for the operation of the system 1000 when utilizing 50% outside air and 50% return air as the entering air at the mixing box 1035. Once the desired portions of outside and return air are mixed at the mixing box, the mixed air has the conditions denoted at data point 3001 (dry bulb temperature of 73° F., wet bulb temperature of 64° F. and relative humidity 67%). In the example of FIG. 30, the system 1000 utilizes the heat exchangers 1019 and 1020 to perform pre-cooling and turns off the heat exchanger 1080 to perform no post-dehumidification sensible cooling (e.g. without post-dehumidification sensible cooling). The entering air is adjusted from the conditions at data point 3001 to the conditions denoted at data point 3002 and then 3003 as the entering air passes through the heat exchanger 1019 and then 1020, respectively. The air discharged from the heat exchanger 1020 has a dry bulb temperature of 47° F. and has a saturation moisture content. As the air passes from the heat exchanger 1020 through the pre-processor 1022, the conditions of the air are adjusted to the state at 3004 (dry bulb temperature of 59° F., wet bulb temperature of 47° F. and relative humidity 38%).

The embodiments described herein utilize a pre-processing module in both summer and winter modes for energy recovery. The embodiments further utilize a processing module for both dehumidification in the summer mode and humidification in the winter mode. Additionally, in the winter mode the processing module dehumidifies the return air, by reduction of grains in moisture and an increase in sensible dry bulb temperature, prior to the return air entering the cooling coil in the air source heat pump. The return air is first dehumidified by entering the pre-processing module, where the source air is heated and humidified. The return air is further dehumidified prior to entering the evaporator coil by the processing module. Additionally, as the return air is dehumidified by the processing module, the dry bulb temperature of the return air is increased which increases the efficiency of the heat pump. The evaporator can then run at lower temperatures without freezing the evaporator fins. In winter mode the energy in the return air is used in the reverse air source heat pump cycle.

Additionally, in the embodiments described herein, supply air is humidified by both the pre-processing module and the processing module to reduce humidification load requirements and energy consumption for the buildings in the winter mode. The embodiments also provide an efficient air source heat pump for winter heating in lieu of electric, gas, HW, or stream. The return air also provides stable and optimum regenerative air temperatures and conditions for the processing module reactivation in the summer mode.

Figure 31:
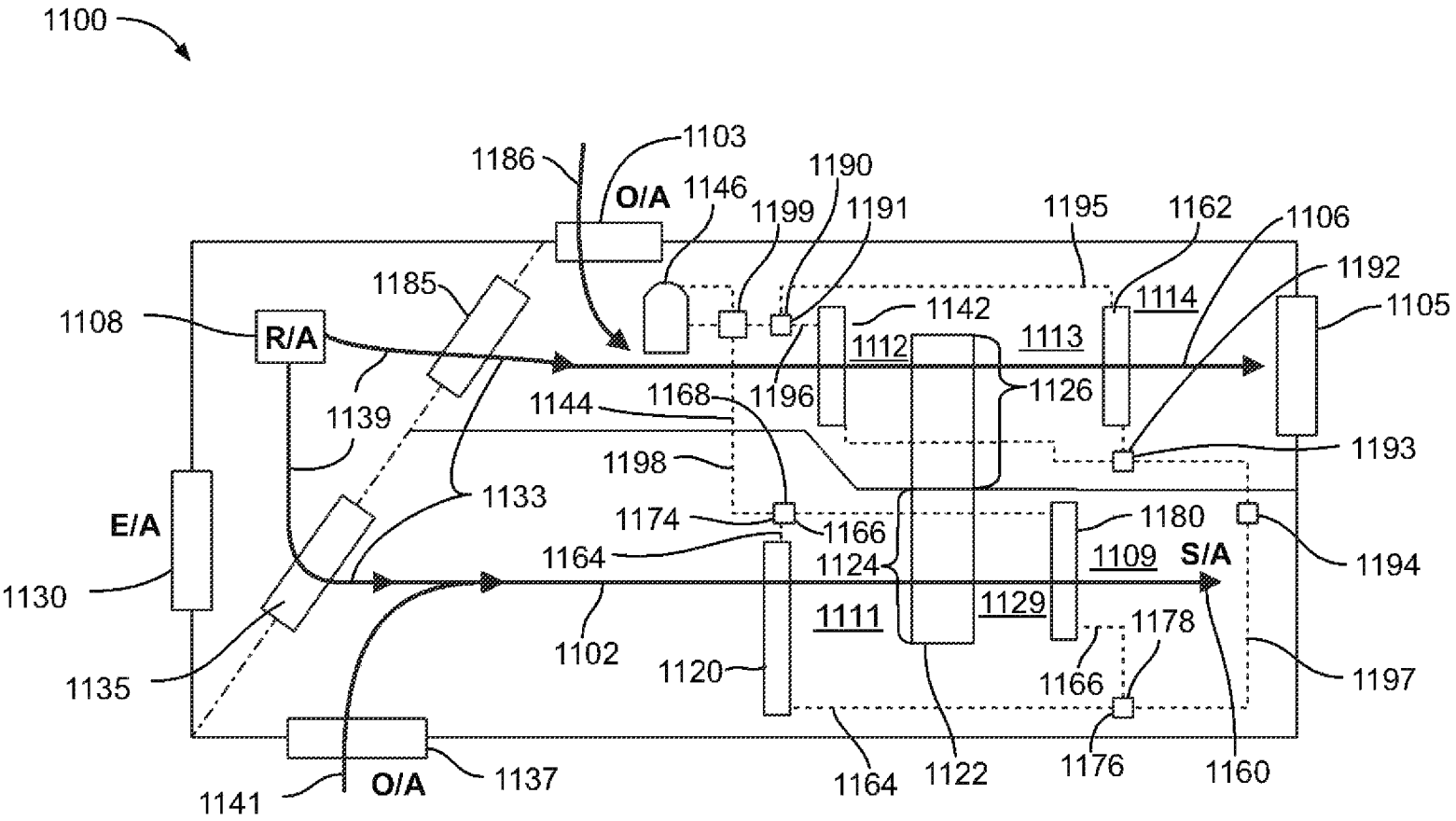
FIG. 31 is a schematic view of another heat pump system formed in accordance with an embodiment.

FIG. 31 is a schematic view of another heat pump system 1100 formed in accordance with an embodiment. The system 1100 is configured to condition supply air flowing into a building or space and return air channeled from within the building or space. When in the summer, among other things, the system 1100 dehumidifies the supply air flowing into the building. When in the winter mode, among other things, the system humidifies the supply air flowing into the building. The system 1100 is capable of switching between the summer mode and the winter mode without the need to reconfigure the components of the system 1100. The system includes a supply air flow path 1102 and a regeneration air flow path 1106. The supply air flow path 1102 includes return air flow path 1139 that enters the supply air flow path 1102 through a return air inlet 1108. A portion 1131 of the return air may be discharged through a return air outlet 1130 as exhaust air. Another portion 1133 of the return air enters a mixing box 1135. The supply air flow path 1102 also includes outside air 1141 that enters an outside air inlet 1137 and mixes with the portion 1133 of the return air to form the supply air.

The supply air flows into a supply air heat exchanger 1120. The supply air heat exchanger 1120 operates as an evaporator coil or cooling coil in the summer mode. As an evaporator coil, the supply air heat exchanger 1120 conditions the air and removes heat from the air to produce saturated air that is discharged into a conditioned air region 1111. A processing module 1122 is positioned downstream from the conditioned air region 1111. The saturated air passes through a supply air side 1124 of the processing module 1122 to remove moisture there from and produce supply air that has been further dehumidified and heated. Because the air is first saturated by the supply air heat exchanger 1120, the efficiency of the processing module 1122 is increased when dehumidifying the air. The dehumidified supply air then flows downstream into a processed air region 1129. The supply air heat exchanger 1180 also operates as an evaporator coil or cooling coil in the summer mode. From the processed air region 1129, the dehumidified supply air flows through the second supply air heat exchanger 1180 that further conditions the air and removes heat from the air to produce conditioned supply air. The conditioned air passes from the supply air heat exchanger 1180 to the supply air outlet 1160 and into the space.

Regeneration air flow path 1106 includes return air flow path 1139 that enters the regeneration air flow path 1106 through a return air inlet 1108. A portion 1131 of the return air may be discharged through a return air outlet 1130 as exhaust air. Another portion 1133 of the return air enters a mixing box 1185. The regeneration air flow path 1106 also includes outside air 1186 that enters an outside air inlet 1103 and mixes with the portion 1133 of the return air to form the regeneration air.

The regeneration air flows into a regeneration air heat exchanger 1142. The regeneration air heat exchanger 1142 operates as a condenser coil in the summer mode to heat and lower a relative humidity of the air. The heat exchanger 1142 uses the heat from the supply air heat exchangers 1120 and 1180 to lower the relative humidity of regeneration air thus increasing the air's capacity to absorb water downstream. The heated air flows into a conditioned air region 1112. The lowered relative humidity air in the conditioned air region 1112 is channeled downstream to the regeneration air side 1126 of the processing module 1122. The lowered relative humidity air passing through the regeneration air side 1126 of the processing module 1122 regenerates the processing module 1122 by receiving moisture from the saturated air in the supply air side 1124 and adding humidity to the regeneration air that flows into a processed air region 1113. The regeneration air flows from the processed air region 1113 to the second regeneration air heat exchanger 1162. The second regeneration air heat exchanger 1162 operates as a very efficient condenser coil in the summer mode to dissipate heat from the refrigeration system 1144 in which heat was absorbed by the supply heat exchangers 1120 and 1180. The regeneration air passes from the regeneration air heat exchanger 1162 into a processed air region 1114. The regeneration air flows from the processed air region 1114 to the regeneration air outlet 1105. The regeneration air heat exchangers 1142 and 1162 are fluidly coupled to the supply air heat exchangers 1120 and 1180 by a refrigerant system 1144. In one embodiment, a compressor 1146 may be provided in the refrigerant system 1144 to condition the refrigerant flowing between the supply air heat exchangers 1120 and 1180, and the regeneration air heat exchangers 1142 and 1162.

The refrigerant system 1144 includes a node branch 1191 located downstream, along the fluid flow path, from the compressor 1146. At the node branch 1191, the fluid path splits along parallel refrigerant branches 1195 and 1196. The refrigerant branch 1195 extends to and from the heat exchanger 1162 that is located downstream of the process module 1122 in the regeneration air stream, while the refrigerant branch 1196 extends to and from the heat exchanger 1142 that is located upstream of the process module 1122 in the regeneration air stream. Valves 1190 and 1192 permit and inhibit flow of the coolant fluid through one or both of the branches 1195 and 1196. The outlet of the valve 1192 merges at node 1193 along branch 1197. Branch 1197 includes a metering device and check valve system 1194 to control a flow of the refrigerant between the supply air heat exchangers 1120 and 1180 and the regeneration air heat exchangers 1142 and 1162. At the node branch 1178, the fluid path splits again along parallel refrigerant branches 1164 and 1166. The refrigerant branch 1164 extends to and from the heat exchanger 1120 that is located upstream of the process module 1122 in the supply air stream, while the refrigerant branch 1166 extends to and from the heat exchanger 1180 that is located downstream of the process module 1122 in the supply air stream. Valves 1176 and 1174 permit and inhibit flow of the coolant fluid through one or both of the branches 1164 and 1166. The outlet of the valve 1174 merges at node 1168 along branch 1198. Branch 1198 includes a switch 1199 to permit reversing the flow of the refrigerant through the refrigerant system 1144. For example, the flow of the refrigerant may be reversed between the summer mode and the winter mode. The valves 1174, 1176, 1190 and 1192 may be automatically controlled by a controller module. The valves 1174, 1176, 1190 and 1192 may be adjusted between fully open, fully closed, partially open and partially closed positions to vary the amount of coolant fluid that flows along each of the branches 1164, 1166, 1195 and 1196. The valves 1174, 1176, 1190 and 1192 may be adjusted independently one from the other based upon summer versus winter mode.

The heat pump system 1100 includes a refrigerant system 1144 which includes a series of pipes, branches, metering devices, check valves and switching device that fluidly couples the supply air heat exchanger 1120, the supply air heat exchanger 1180, the regeneration air heat exchanger 1142 and the regeneration air heat exchanger 1162. The refrigerant system 1144 pumps a refrigerant between at least one of the supply air heat exchanger 1120 or the supply air exchanger 1180 and at least one of the regeneration air heat exchanger 1142 or the regeneration air heat exchanger 1162. Alternatively, the refrigerant system 1144 pumps a refrigerant between the supply air heat exchanger 1120 and both the regeneration air heat exchanger 1142 and the regeneration heat exchanger 1162. Heat exchanger switches 1190 and 1192 controls the flow of refrigerant to the regeneration air heat exchangers 1142 and 1162. Whereas heat exchanger switches 1174 and 1176 controls the flow of refrigerant to the supply air heat exchangers 1120 and 1180. In the summer mode, the refrigerant system 1144 pumps cooled refrigerant to at least one of the supply air heat exchanger 1120 or the supply air heat exchanger 1180 to cool the air flowing through the supply air heat exchanger 1120 and/or the supply air heat exchanger 1180. The cooled refrigerant is heated by the air in at least one of the supply air heat exchangers 1120 or the supply air heat exchanger 1180 to form heated refrigerant. The heated refrigerant flows through the piping to at least one of the regeneration air heat exchanger 1142 or the regeneration air heat exchanger 1162 to heat the air flowing through the regeneration air heat exchanger 1142 and/or the regeneration air heat exchanger 1162. The refrigerant is cooled by the air in at least one of the regeneration air heat exchanger 1142 or the regeneration air heat exchanger 1162 to form cooled refrigerant that is pumped back to the supply air heat exchangers 1120 and/or 1180.

In the winter mode, the refrigerant system 1144 pumps heated refrigerant to at least one of the supply air heat exchanger 1120 or the supply air heat exchanger 1180 to heat the air flowing through the supply air heat exchanger 1120 and/or the supply air heat exchanger 1180. The heated refrigerant is cooled by the air in at least one of the supply air heat exchanger 1120 or the supply air heat exchanger 1180 to form cooled refrigerant. The cooled refrigerant flows through the piping to at least one of the regeneration air heat exchanger 1142 or the regeneration air heat exchanger 1162 to cool the air flowing through the regeneration air heat exchanger 1142 and/or the regeneration air heat exchanger 1162. The refrigerant is heated by the air in at least one of the regeneration air heat exchanger 1142 or the regeneration air heat exchanger 1162 to form heated refrigerant that is pumped back to the supply air heat exchangers 1120 and/or 1180.

The refrigerant system 1144 may include a metering device and check valve system 1194 to control a flow of the refrigerant between the supply air heat exchanger 1120 and/or the supply air heat exchanger 1180 and the regeneration air heat exchanger 1142 and/or the regeneration air heat exchanger 1162. Additionally, a switch 1199 may be provided to reverse a flow of the refrigerant through the refrigerant system 1144. For example, the flow of the refrigerant may be reversed when the system 1100 is switched between the summer mode and the winter mode. A compressor 1146 is provided to compress the refrigerant. In the summer mode, the refrigerant passes through the compressor 1146 after exiting the supply air heat exchangers 1120 and/or 1180 and before entering the regeneration air heat exchangers 1142 and/or 1162. In the winter mode, the refrigerant passes through the compressor 1146 after exiting the regeneration air heat exchangers 1142 and/or 1162 and before entering the supply air heat exchangers 1120 and/or 1180.

In a winter mode, the system 1100 may be configured to humidify and heat the supply air flowing into the building. For example, the supply air heat exchanger 1120 and the supply air heat exchanger 1180 may be reversed in the winter mode to operate as condenser coils. Additionally, the regeneration air heat exchangers 1142 and 1162 may be reversed in the winter mode to operate as evaporator coils.

Figure 32:
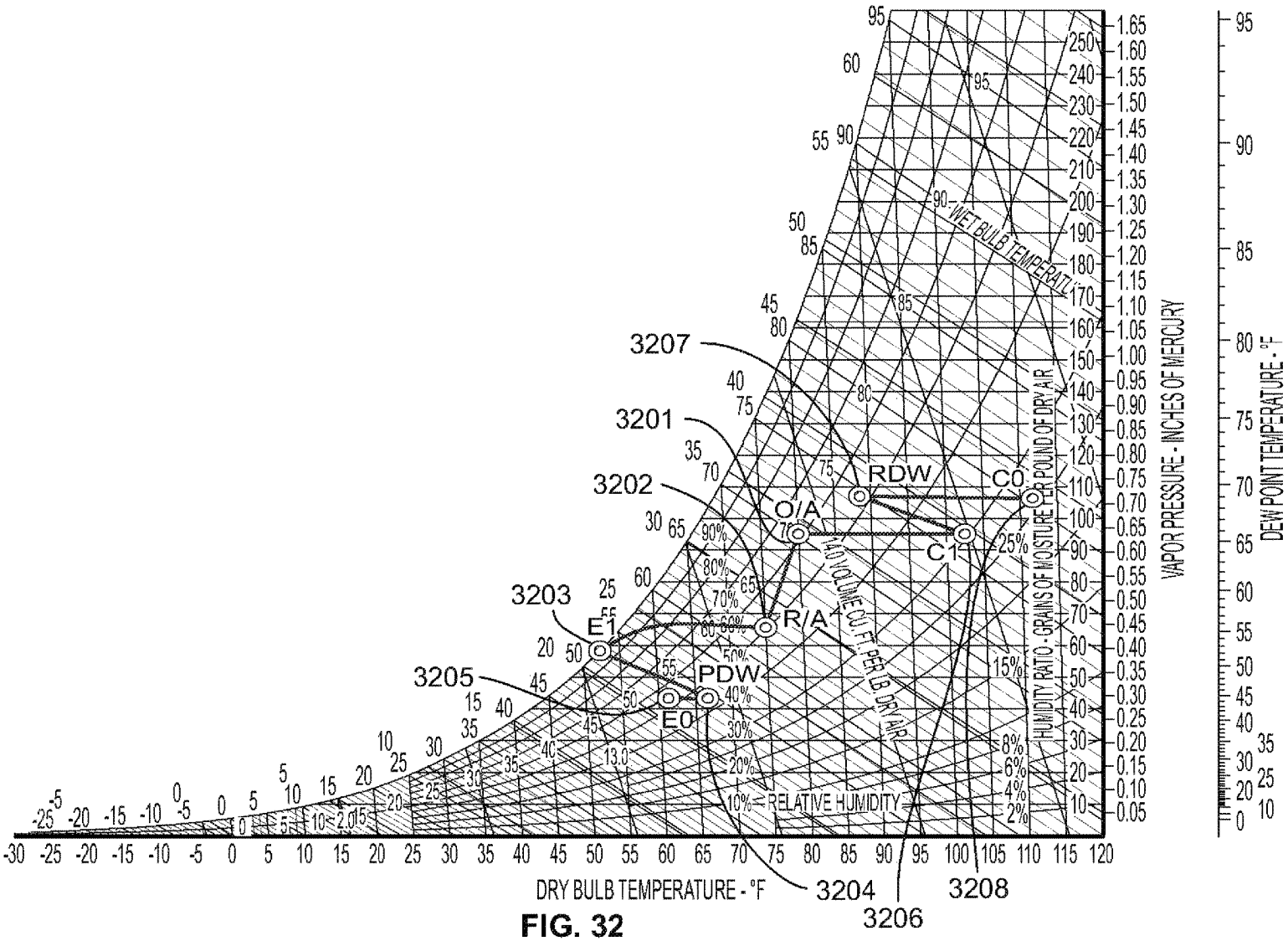
FIG. 32 is a psychrometric chart of the supply air and regeneration air of a heat pump system operating in a summer mode.

FIGS. 32-43 illustrates psychrometric charts for the system 1100 when operating in various configurations. FIGS. 32-43 illustrate exemplary data point's representative of the air condition when passing between designated regions within system 1100. FIG. 32 illustrates the system 1100 in the summer mode when using 100% return air as the entering supply air while configured to perform pre-cooling, dehumidification and sensible cooling. In this configuration, the outside air inlet 1137 is closed, the return air outlet 1130 is closed, the mixing box damper 1135 is open, the mixing box damper 1185 is closed and the outside air inlet 1103 is closed such that all the return air through return air inlet 1108 provides all of the supply air. Correspondingly the entering regeneration air is comprised of 100% outside air. FIG. 32 illustrates return air at data point 3202 with a dry bulb temperature of 75° F., a wet bulb temperature of approximately 63° F. and a relative humidity of approximately 50%. As the supply air passes through the active supply air heat exchanger 1120, the humidity and temperature of the return air is changed to data point 3203 (dry bulb temperature of 52° F., wet bulb temperature of 52° F. and 100% relative humidity), and as the air passes through the processing module 1122, the air conditions are adjusted to data point 3204 (dry bulb temperature of 66° F., wet bulb temperature of 54° F. and 45% relative humidity). As the air passes through the active supply air heat exchanger 1180, the conditions are further changed to data point 3205 and supplied to the controlled space (dry bulb temperature of 61° F., wet bulb temperature of 52° F. and relative humidity 55%). The heat exchanger 1180 performs sensible cooling only without changing the humidity of the supply air. The regeneration air is also illustrated in FIG. 32, where outside air at data point 3201 with a dry bulb temperature of 80° F., a wet bulb temperature of approximately 70° F. and a relative humidity of approximately 60%. As the regeneration air passes through the active regeneration air heat exchanger 1142, the humidity and temperature of the regeneration air is changed to data point 3206 (dry bulb temperature of 103° F., wet bulb temperature of 76° F. and 30% relative humidity), and as the air passes through the processing module 1122, the air conditions are adjusted to data point 3207 (dry bulb temperature of 88° F., wet bulb temperature of 74° F. and 53% relative humidity). As the air passes through the second active regeneration air heat exchanger 1162, the conditions are further changed to data point 3208 and discharges to ambient (dry bulb temperature of 112° F., wet bulb temperature of 81° F. and relative humidity 27%). Because the heat absorbed in the refrigeration system is released in two separate condenser coils, with the second condenser coil located after the processing module 1122 where the temperature is reduced this substantially improves the performance of the refrigeration system 1144 because operation discharge pressures are lowered.

Figure 33:
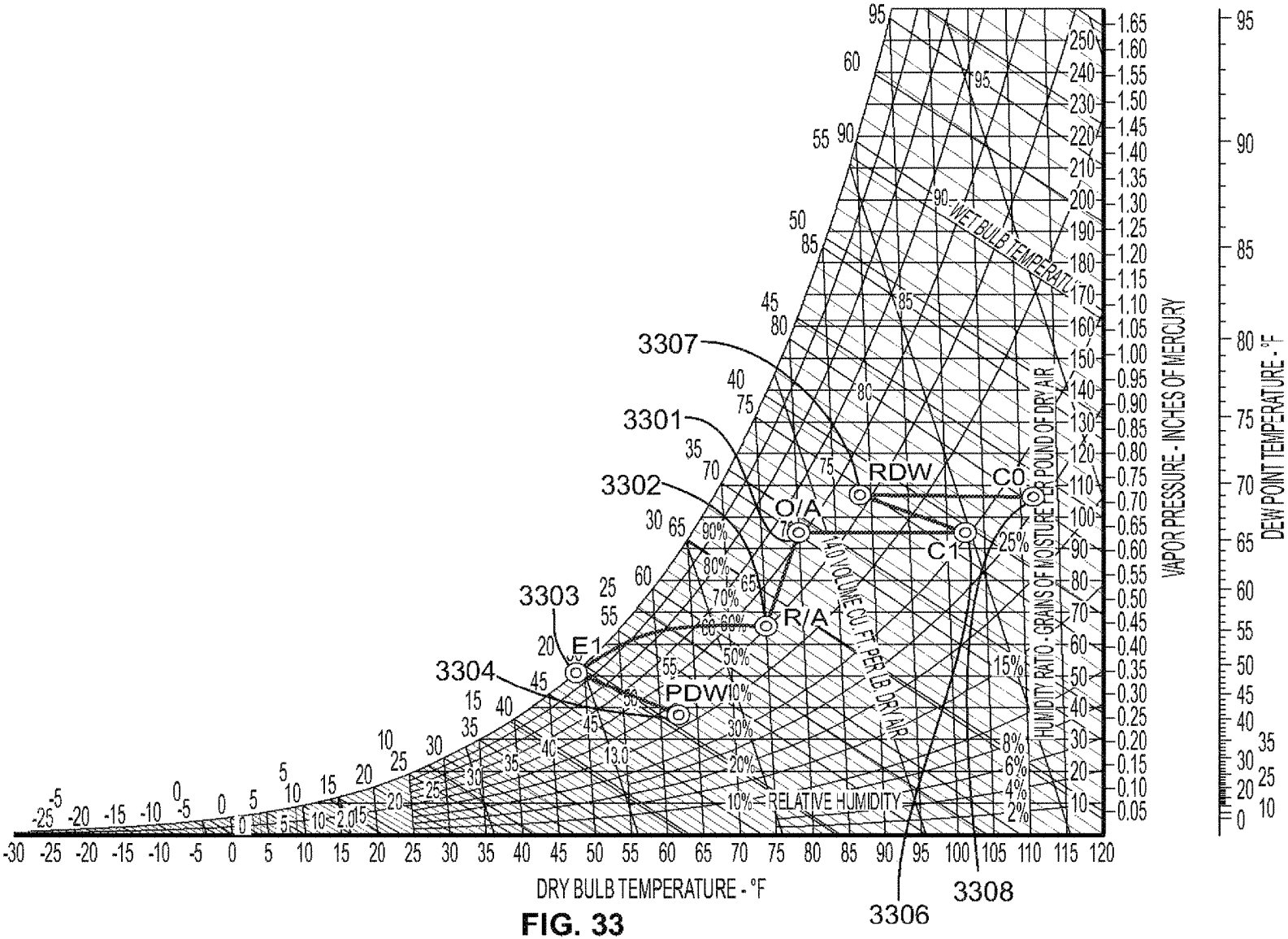
FIG. 33 is a psychrometric chart of the supply air and regeneration air of a heat pump system operating in a summer mode.

FIG. 33 illustrates the system 1100 in the summer mode when using 100% return air as the entering supply air while configured to perform pre-cooling, dehumidification and no post-dehumidification sensible cooling. In this configuration, the outside air inlet 1137 is closed, the return air outlet 1130 is closed, the mixing box damper 1135 is open, the mixing box damper 1185 is closed and the outside air inlet 1103 is closed such that all the return air through return air inlet 1108 provides all of the supply air. Correspondingly the entering regeneration air is comprised of 100% outside air. FIG. 33 illustrates return air at data point 3302 with a dry bulb temperature of 75° F., a wet bulb temperature of approximately 63° F. and a relative humidity of approximately 50%. As the supply air passes through the active supply air heat exchanger 1120, the humidity and temperature of the return air is changed to data point 3303 (dry bulb temperature of 49° F., wet bulb temperature of 49° F. and 100% relative humidity), and as the air passes through the processing module 1122, the air conditions are adjusted to data point 3304 (dry bulb temperature of 63° F., wet bulb temperature of 51° F. and 45% relative humidity). As the air passes through the inactive supply air heat exchanger 1180, the supply air conditions are unchanged. The regeneration air is also illustrated in FIG. 33, where outside air at data point 3301 with a dry bulb temperature of 80° F., a wet bulb temperature of approximately 70° F. and a relative humidity of approximately 60%. As the regeneration air passes through the active regeneration air heat exchanger 1142, the humidity and temperature of the regeneration air is changed to data point 3306 (dry bulb temperature of 103° F., wet bulb temperature of 76° F. and 30% relative humidity), and as the air passes through the processing module 1122, the air conditions are adjusted to data point 3307 (dry bulb temperature of 88° F., wet bulb temperature of 74° F. and 53% relative humidity). As the air passes through the second active regeneration air heat exchanger 1162, the conditions are further changed to data point 3308 and discharges to ambient (dry bulb temperature of 112° F., wet bulb temperature of 81° F. and relative humidity 27%). Because the heat absorbed in the refrigeration system is released in two separate condenser coils, with the second condenser coil located after the processing module 1122 where the temperature is reduced this substantially improves the performance of the refrigeration system 1144 because operation discharge pressures are lowered.

Figure 34:
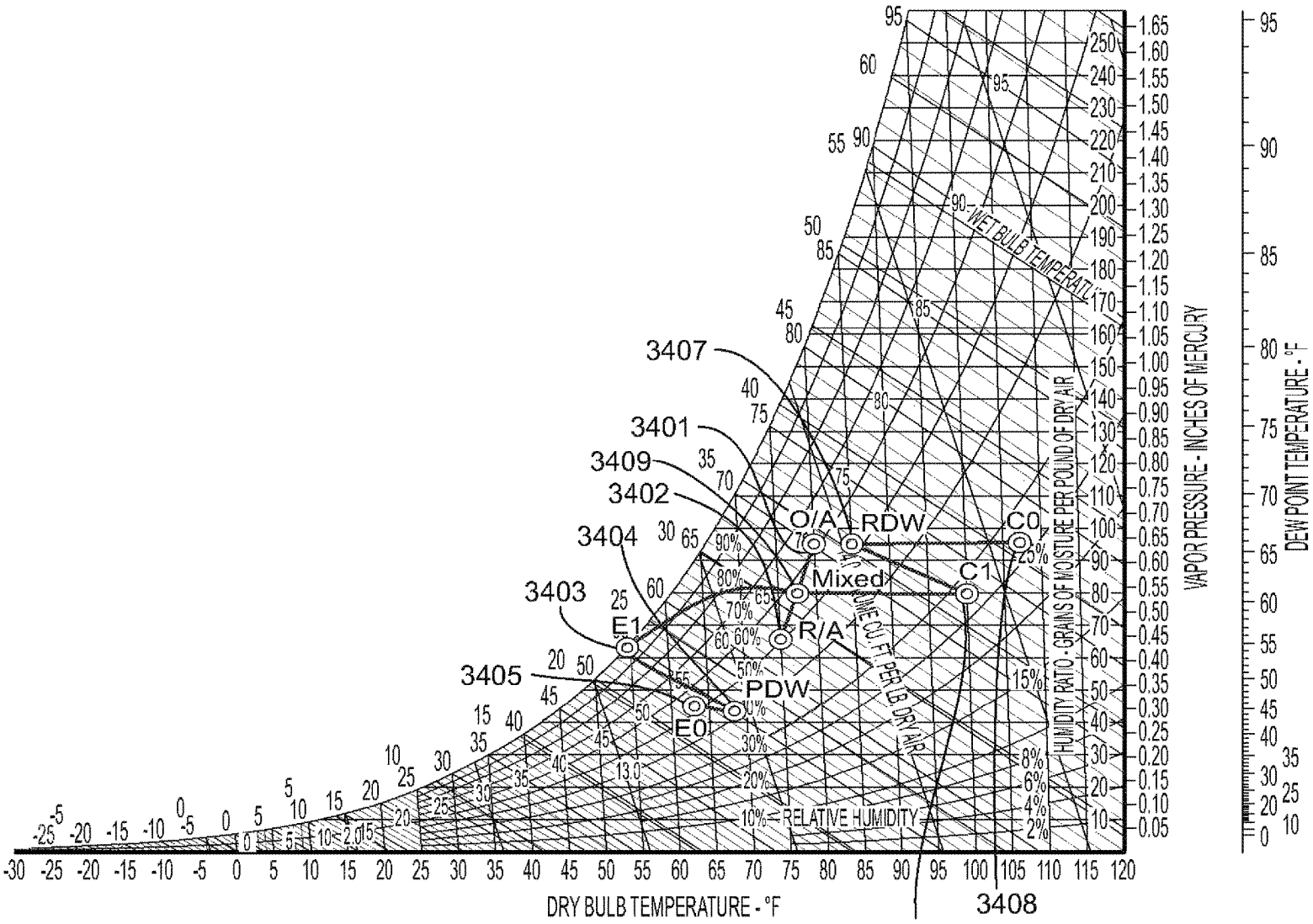
FIG. 34 is a psychrometric chart of the supply air and regeneration air of a heat pump system operating in a summer mode.

FIG. 34 illustrates the system 1100 in the summer mode when using 50% return air and 50% outside air as the mixed entering supply air while the system is configured to perform pre-cooling, dehumidification and post-dehumidification sensible cooling. In this configuration, the outside air inlet 1137 is open, the return air outlet 1130 is closed, the mixing box damper 1135 is half open, the mixing box damper 1185 is half open and the outside air inlet 1103 is open such that both the supply air and the regeneration is comprised of 50% return air and 50% outside air. Once the desired portions of outside and return air are mixed at the mixing boxes, the mixed air has the conditions denoted at data point 3409 (dry bulb temperature of 77° F., wet bulb temperature of 66° F. and relative humidity 57%). As the supply air passes through the active supply air heat exchanger 1120, the humidity and temperature of the air is changed to data point 3403 (dry bulb temperature of 54° F., wet bulb temperature of 54° F. and 100% relative humidity), and as the air passes through the processing module 1122, the air conditions are adjusted to data point 3404 (dry bulb temperature of 68° F., wet bulb temperature of 55° F. and 43% relative humidity). As the air passes through the active supply air heat exchanger 1180, the conditions are further changed to data point 3405 and supplied to the controlled space (dry bulb temperature of 63° F., wet bulb temperature of 53° F. and relative humidity 52%). The heat exchanger 1180 performs sensible cooling only without changing the humidity of the supply air. The regeneration air is also illustrated in FIG. 34, where the mixed regeneration air at data point 3409 with a dry bulb temperature of 77° F., a wet bulb temperature of approximately 66° F. and a relative humidity of approximately 57%. As the regeneration air passes through the active regeneration air heat exchanger 1142, the humidity and temperature of the regeneration air is changed to data point 3406 (dry bulb temperature of 100° F., wet bulb temperature of 73° F. and 25% relative humidity), and as the air passes through the processing module 1122, the air conditions are adjusted to data point 3407 (dry bulb temperature of 85° F., wet bulb temperature of 71° F. and 52% relative humidity). As the air passes through the second active regeneration air heat exchanger 1162, the conditions are further changed to data point 3408 and discharges to ambient (dry bulb temperature of 108° F., wet bulb temperature of 78° F. and relative humidity 32%).

Figure 35:
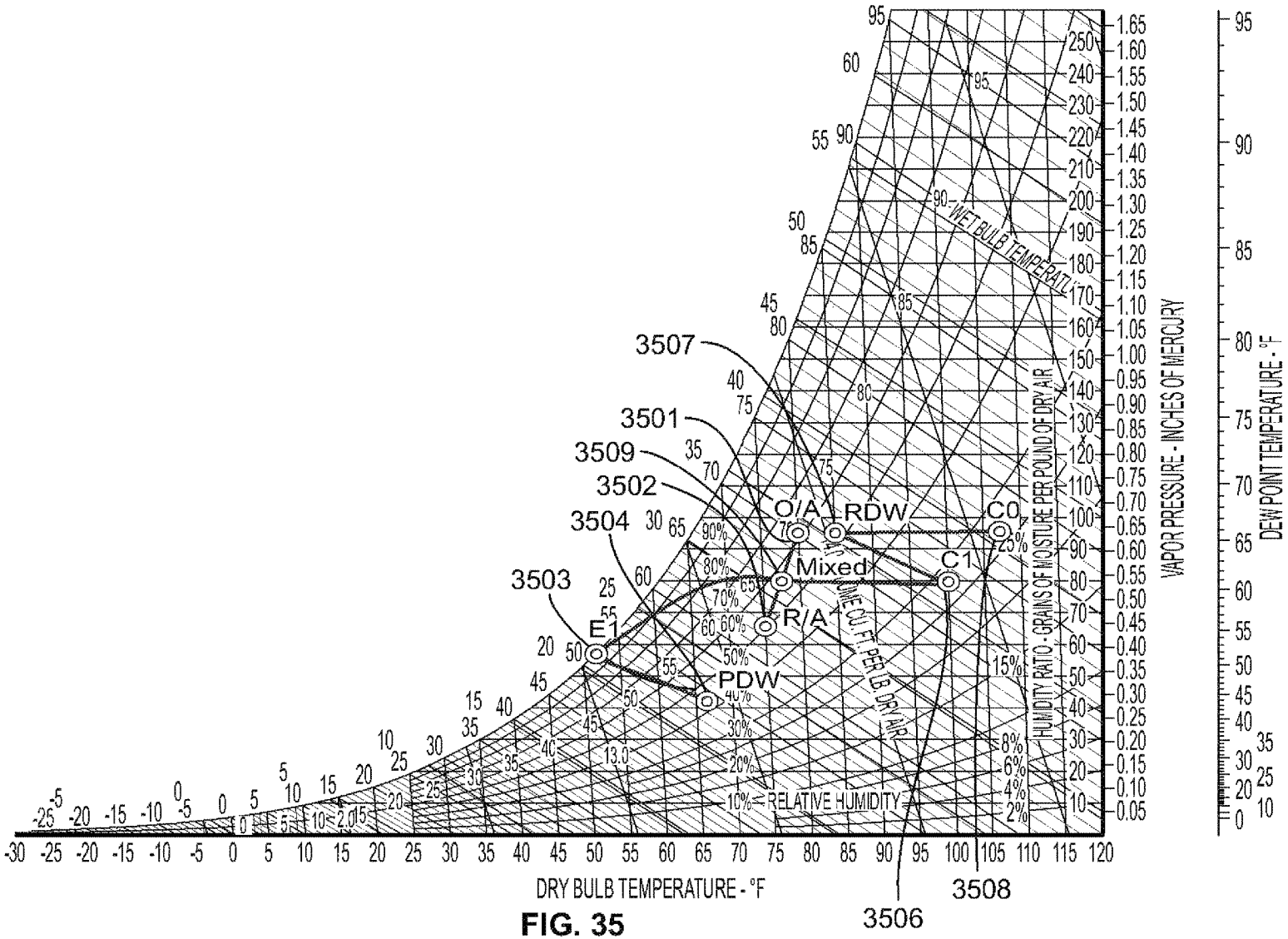
FIG. 35 is a psychrometric chart of the supply air and regeneration air of a heat pump system operating in a summer mode.

FIG. 35 illustrates the system 1100 in the summer mode when using 50% return air and 50% outside air as the mixed entering supply air while the system is configured to perform pre-cooling, dehumidification and no post-dehumidification sensible cooling. In this configuration, the outside air inlet 1137 is open, the return air outlet 1130 is closed, the mixing box damper 1135 is half open, the mixing box damper 1185 is half open and the outside air inlet 1103 is open such that both the supply air and the regeneration is comprised of 50% return air and 50% outside air. Once the desired portions of outside and return air are mixed at the mixing boxes, the mixed air has the conditions denoted at data point 3509 (dry bulb temperature 77° F., wet bulb temperature 66° F. and relative humidity 57%). As the supply air passes through the active supply air heat exchanger 1120, the humidity and temperature of the air is changed to data point 3503 (dry bulb temperature of 51° F., wet bulb temperature of 51° F. and 100% relative humidity), and as the air passes through the processing module 1122, the air conditions are adjusted to data point 3504 (dry bulb temperature of 66° F., wet bulb temperature of 54° F. and 43% relative humidity). As the air passes through the inactive supply air heat exchanger 1180, the supply air conditions are unchanged. The regeneration air is also illustrated in FIG. 35, where the mixed regeneration air at data point 3509 with a dry bulb temperature of 77° F., a wet bulb temperature of approximately 66° F. and a relative humidity of approximately 57%. As the regeneration air passes through the active regeneration air heat exchanger 1142, the humidity and temperature of the regeneration air is changed to data point 3506 (dry bulb temperature of 100° F., wet bulb temperature of 73° F. and 25% relative humidity), and as the air passes through the processing module 1122, the air conditions are adjusted to data point 3507 (dry bulb temperature of 85° F., wet bulb temperature of 71° F. and 52% relative humidity). As the air passes through the second active regeneration air heat exchanger 1162, the conditions are further changed to data point 3508 and discharges to ambient (dry bulb temperature of 108° F., wet bulb temperature of 78° F. and relative humidity 32%).

Figure 36:
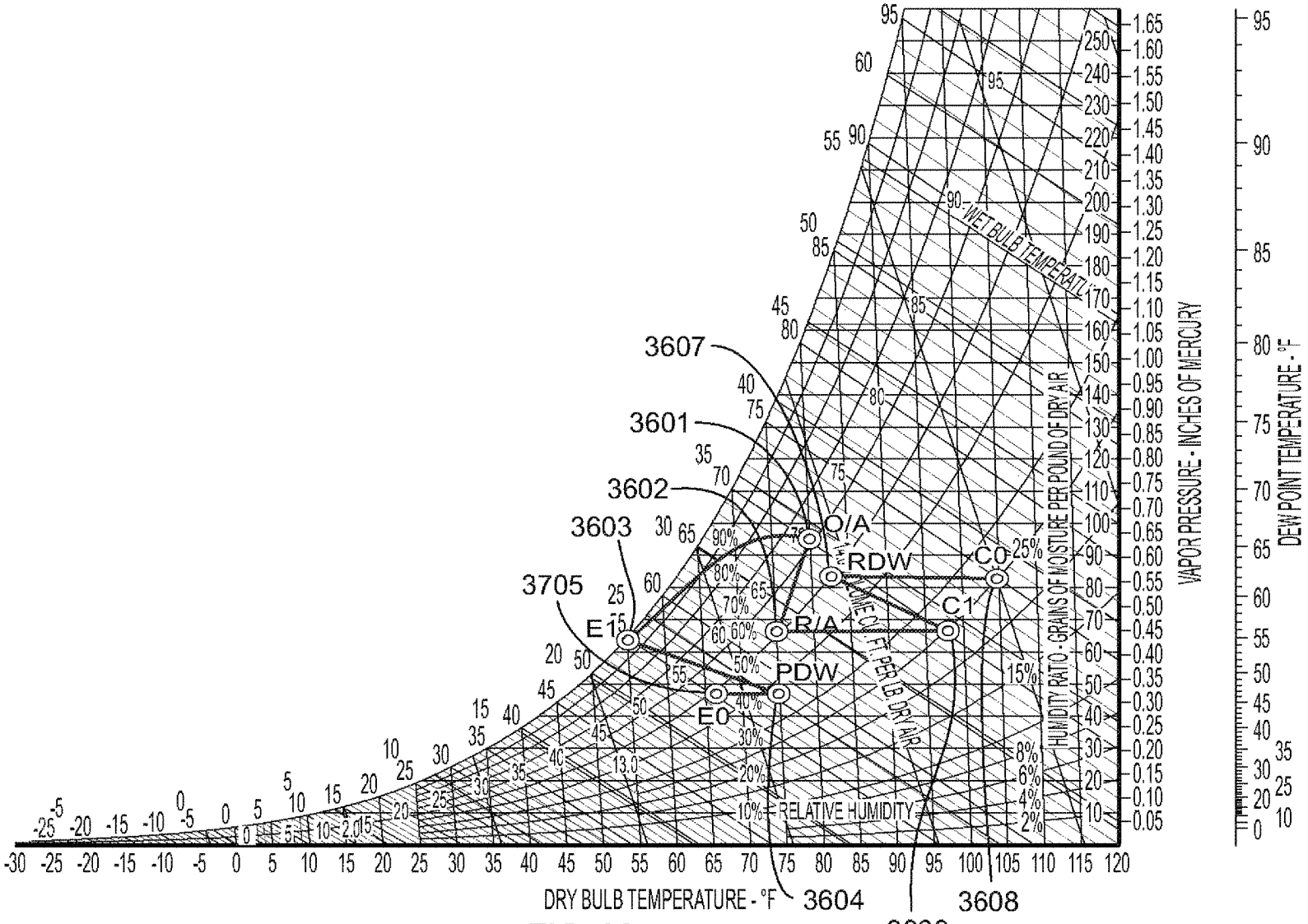
FIG. 36 is a psychrometric chart of the supply air and regeneration air of a heat pump system operating in a summer mode.

FIG. 36 illustrates the system 1100 in the summer mode when using 100% outside air as the entering supply air while configured to perform pre-cooling, dehumidification and sensible cooling. In this configuration, the outside air inlet 1137 is open, the return air outlet 1130 is close, the mixing box damper 1135 is close, the mixing box damper 1185 is close and the outside air inlet 1103 is close such that all the outside air through supply air inlet 1137 provides all of the supply air. Correspondingly the entering regeneration air is comprised of 100% return air. FIG. 36 illustrates outside air at data point 3601 with a dry bulb temperature of 80° F., a wet bulb temperature of approximately 70° F. and a relative humidity of approximately 60%. As the supply air passes through the active supply air heat exchanger 1120, the humidity and temperature of the outside air is changed to data point 3603 (dry bulb temperature of 56° F., wet bulb temperature of 56° F. and 100% relative humidity), and as the air passes through the processing module 1122, the air conditions are adjusted to data point 3604 (dry bulb temperature of 72° F., wet bulb temperature of 57° F. and 40% relative humidity). As the air passes through the active supply air heat exchanger 1180, the conditions are further changed to data point 3605 and supplied to the controlled space (dry bulb temperature of 66° F., wet bulb temperature of 55° F. and relative humidity 50%). The heat exchanger 1180 performs sensible cooling only without changing the humidity of the supply air. The regeneration air is also illustrated in FIG. 36, where return air at data point 3602 with a dry bulb temperature of 75° F., a wet bulb temperature of approximately 62° F. and a relative humidity of approximately 50%. As the regeneration air passes through the active regeneration air heat exchanger 1142, the humidity and temperature of the regeneration air is changed to data point 3606 (dry bulb temperature of 98° F., wet bulb temperature of 69° F. and 28% relative humidity), and as the air passes through the processing module 1122, the air conditions are adjusted to data point 3607 (dry bulb temperature of 82° F., wet bulb temperature of 68° F. and 50% relative humidity). As the air passes through the second active regeneration air heat exchanger 1162, the conditions are further changed to data point 3608 and discharges to ambient (dry bulb temperature of 105° F., wet bulb temperature of 75° F. and relative humidity 25%). Because the regeneration air is 100% return air (which is typically drier then the outside air in the summer) the system 1100 is able to improve the performance of the processing module to extract additional moisture from the supply air stream and further dry the supply air in the summer mode. The performance of the refrigeration system is also improved as the discharge pressures are lowered.

Figure 37:
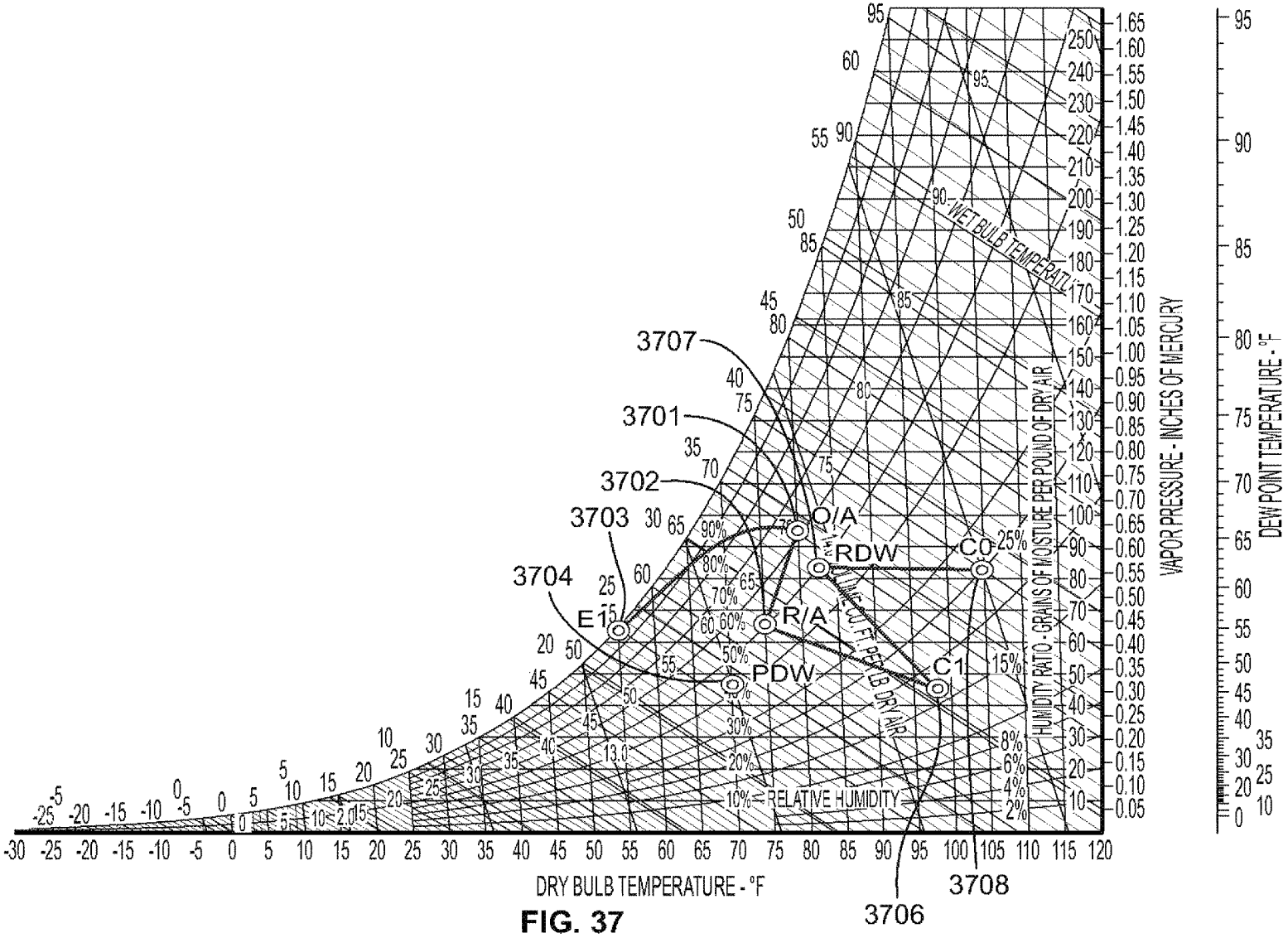
FIG. 37 is a psychrometric chart of the supply air and regeneration air of a heat pump system operating in a summer mode.

FIG. 37 illustrates the system 1100 in the summer mode when using 100% outside air as the entering supply air while configured to perform pre-cooling, dehumidification and no post dehumidification sensible cooling. In this configuration, the outside air inlet 1137 is open, the return air outlet 1130 is close, the mixing box damper 1135 is close, the mixing box damper 1185 is close and the outside air inlet 1103 is close such that all the outside air through supply air inlet 1137 provides all of the supply air. Correspondingly the entering regeneration air is comprised of 100% return air. FIG. 37 illustrates outside air at data point 3701 with a dry bulb temperature of 80° F., a wet bulb temperature of approximately 70° F. and a relative humidity of approximately 60%. As the supply air passes through the active supply air heat exchanger 1120, the humidity and temperature of the outside air is changed to data point 3703 (dry bulb temperature of 55° F., wet bulb temperature of 55° F. and 100% relative humidity), and as the air passes through the processing module 1122, the air conditions are adjusted to data point 3704 (dry bulb temperature of 70° F., wet bulb temperature of 57° F. and 42% relative humidity). As the air passes through the inactive supply air heat exchanger 1180, the supply air conditions are unchanged. The regeneration air is also illustrated in FIG. 37, where return air at data point 3702 with a dry bulb temperature of 75° F., a wet bulb temperature of approximately 62° F. and a relative humidity of approximately 50%. As the regeneration air passes through the active regeneration air heat exchanger 1142, the humidity and temperature of the regeneration air is changed to data point 3706 (dry bulb temperature of 98° F., wet bulb temperature of 70° F. and 28% relative humidity), and as the air passes through the processing module 1122, the air conditions are adjusted to data point 3707 (dry bulb temperature of 82° F., wet bulb temperature of 68° F. and 50% relative humidity). As the air passes through the second active regeneration air heat exchanger 1162, the conditions are further changed to data point 3708 and discharges to ambient (dry bulb temperature of 105° F., wet bulb temperature of 75° F. and relative humidity 25%). Because the regeneration air is 100% return air (which is typically drier then the outside air in the summer) the system 1100 is able to improve the performance of the processing module to extract additional moisture from the supply air stream and further dry the supply air in the summer mode. The performance of the refrigeration system is also improved as the discharge pressures are lowered.

Figure 38:
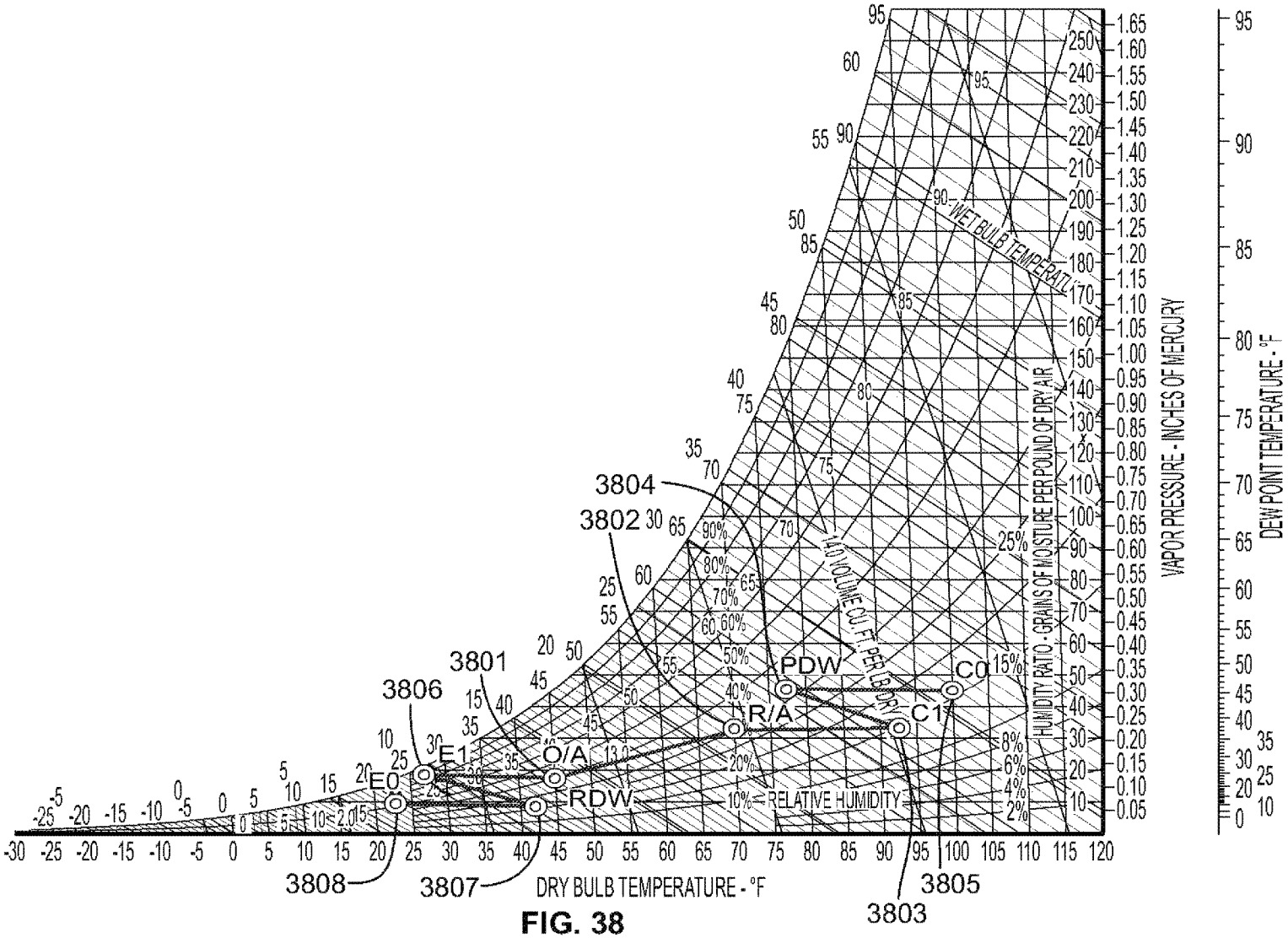
FIG. 38 is a psychrometric chart of the supply air and regeneration air of a heat pump system operating in a winter mode.

FIG. 38 illustrates the system 1100 in the winter mode when using 100% return air as the entering supply air while configured to perform pre-heating, humidification and post sensible heating. In this configuration, the outside air inlet 1137 is closed, the return air outlet 1130 is closed, the mixing box damper 1135 is open, the mixing box damper 1185 is closed and the outside air inlet 1103 is closed such that all the return air through return air inlet 1108 provides all of the supply air. Correspondingly the entering regeneration air is comprised of 100% outside air. FIG. 38 illustrates return air at data point 3802 with a dry bulb temperature of 70° F., a wet bulb temperature of approximately 53° F. and a relative humidity of approximately 30%. As the supply air passes through the active supply air heat exchanger 1120, the humidity and temperature of the return air is changed to data point 3803 (dry bulb temperature of 92° F., wet bulb temperature of 62° F. and 15% relative humidity), and as the air passes through the processing module 1122, the air conditions are adjusted to data point 3804 (dry bulb temperature of 77° F., wet bulb temperature of 59° F. and 33% relative humidity). As the air passes through the active supply air heat exchanger 1180, the conditions are further changed to data point 3805 and supplied to the controlled space (dry bulb temperature of 100° F., wet bulb temperature of 67° F. and relative humidity 16%). The heat exchanger 1180 performs post sensible heating. The regeneration air is also illustrated in FIG. 38, where outside air at data point 3801 with a dry bulb temperature of 45° F., a wet bulb temperature of approximately 37° F. and a relative humidity of approximately 40%. As the regeneration air passes through the active regeneration air heat exchanger 1142, the humidity and temperature of the regeneration air is changed to data point 3806 (dry bulb temperature of 26° F., wet bulb temperature of 25° F. and 90% relative humidity), and as the air passes through the processing module 1122, the air conditions are adjusted to data point 3807 (dry bulb temperature of 41° F., wet bulb temperature of 31° F. and 28% relative humidity). As the air passes through the second active regeneration air heat exchanger 1162, the conditions are further changed to data point 3808 and discharges to ambient (dry bulb temperature of 23° F., wet bulb temperature of 20° F. and relative humidity 60%). Because the refrigeration system 1144 includes heat exchanger switches 1190 and 1192 that control the flow of refrigerant independently to the regeneration air heat exchangers 1142 and 1162 this improved the performance of the processing module 1122 to absorb moisture and heat the regeneration air stream thus substantially improving the performance of the refrigeration system 1144 because the suction pressures are higher, improving the coefficient of performance (COP) of the system. Additionally the processing module offsets humidification load requirement in the space.

Figure 39:
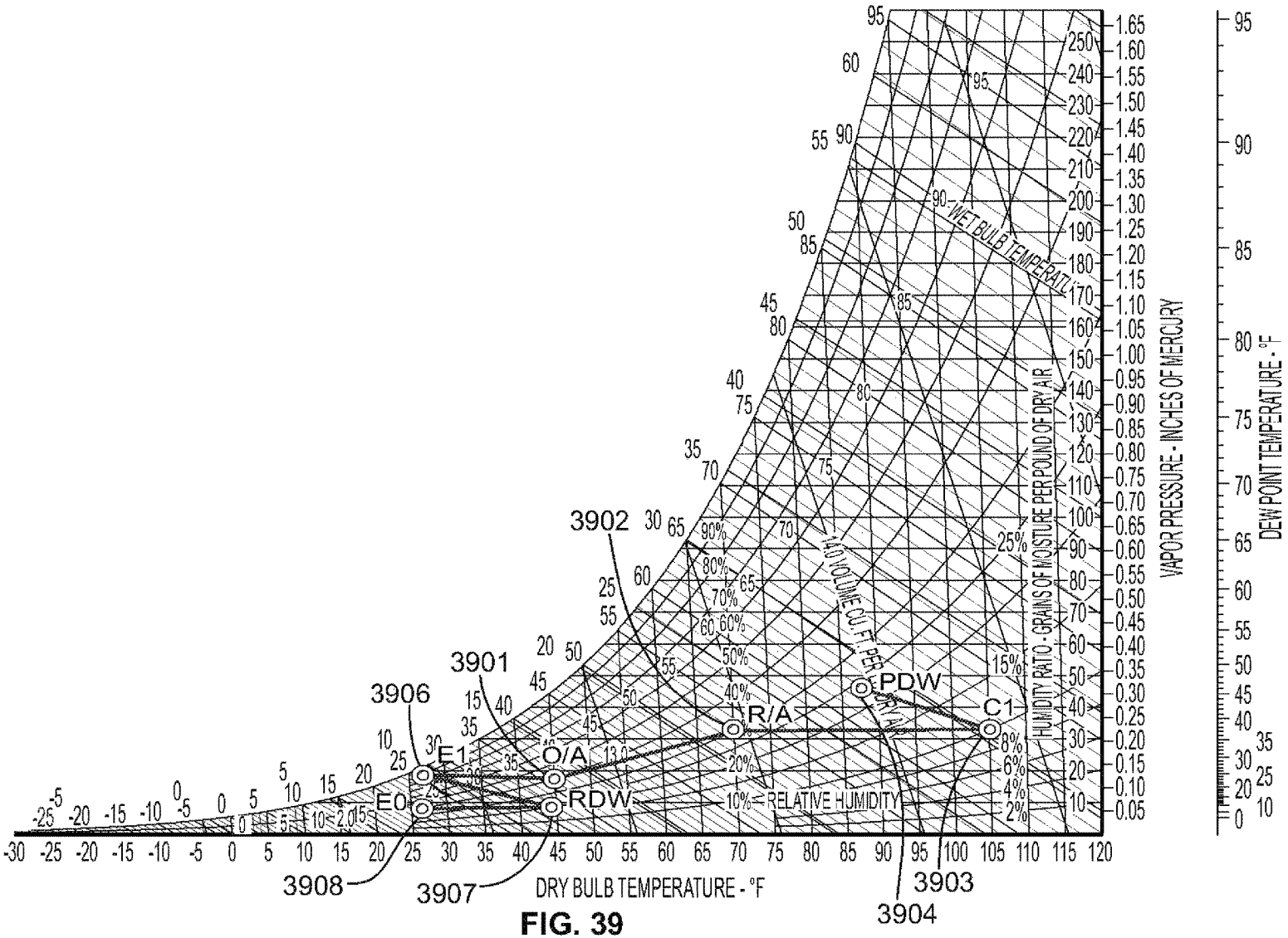
FIG. 39 is a psychrometric chart of the supply air and regeneration air of a heat pump system operating in a winter mode.

FIG. 39 illustrates the system 1100 in the winter mode when using 100% return air as the entering supply air while configured to perform pre-heating, humidification and no post sensible heating. In this configuration, the outside air inlet 1137 is closed, the return air outlet 1130 is closed, the mixing box damper 1135 is open, the mixing box damper 1185 is closed and the outside air inlet 1103 is closed such that all the return air through return air inlet 1108 provides all of the supply air. Correspondingly the entering regeneration air is comprised of 100% outside air. FIG. 39 illustrates return air at data point 3902 with a dry bulb temperature of 70° F., a wet bulb temperature of approximately 53° F. and a relative humidity of approximately 30%. As the supply air passes through the active supply air heat exchanger 1120, the humidity and temperature of the return air is changed to data point 3903 (dry bulb temperature of 105° F., wet bulb temperature of 66° F. and 9% relative humidity), and as the air passes through the processing module 1122, the air conditions are adjusted to data point 3904 (dry bulb temperature of 87° F., wet bulb temperature of 63° F. and 25% relative humidity). As the air passes through the inactive supply air heat exchanger 1180, the supply air conditions are unchanged. The regeneration air is also illustrated in FIG. 39, where outside air at data point 3901 with a dry bulb temperature of 45° F., a wet bulb temperature of approximately 37° F. and a relative humidity of approximately 40%. As the regeneration air passes through the active regeneration air heat exchanger 1142, the humidity and temperature of the regeneration air is changed to data point 3906 (dry bulb temperature of 26° F., wet bulb temperature of 25° F. and 90% relative humidity), and as the air passes through the processing module 1122, the air conditions are adjusted to data point 3907 (dry bulb temperature of 45° F., wet bulb temperature of 32° F. and 20% relative humidity). As the air passes through the second active regeneration air heat exchanger 1162, the conditions are further changed to data point 3908 and discharges to ambient (dry bulb temperature of 26° F., wet bulb temperature of 21° F. and relative humidity 45%). Because the refrigeration system 1144 includes heat exchanger switches 1190 and 1192 that control the flow of refrigerant independently to the regeneration air heat exchangers 1142 and 1162 this improved the performance of the processing module 1122 to absorb moisture and heat the regeneration air stream thus substantially improving the performance of the refrigeration system 1144 because the suction pressures are higher, improving the coefficient of performance (COP) of the system. Additionally the processing module offsets humidification load requirement in the space. Furthermore, because the refrigeration system 1144 includes heat exchanger switches 1174 and 1176 that control the flow of refrigerant independently to the supply air heat exchangers 1120 and 1180 this allows to the system to control the space sensible load independently from the latent load.

Figure 40:
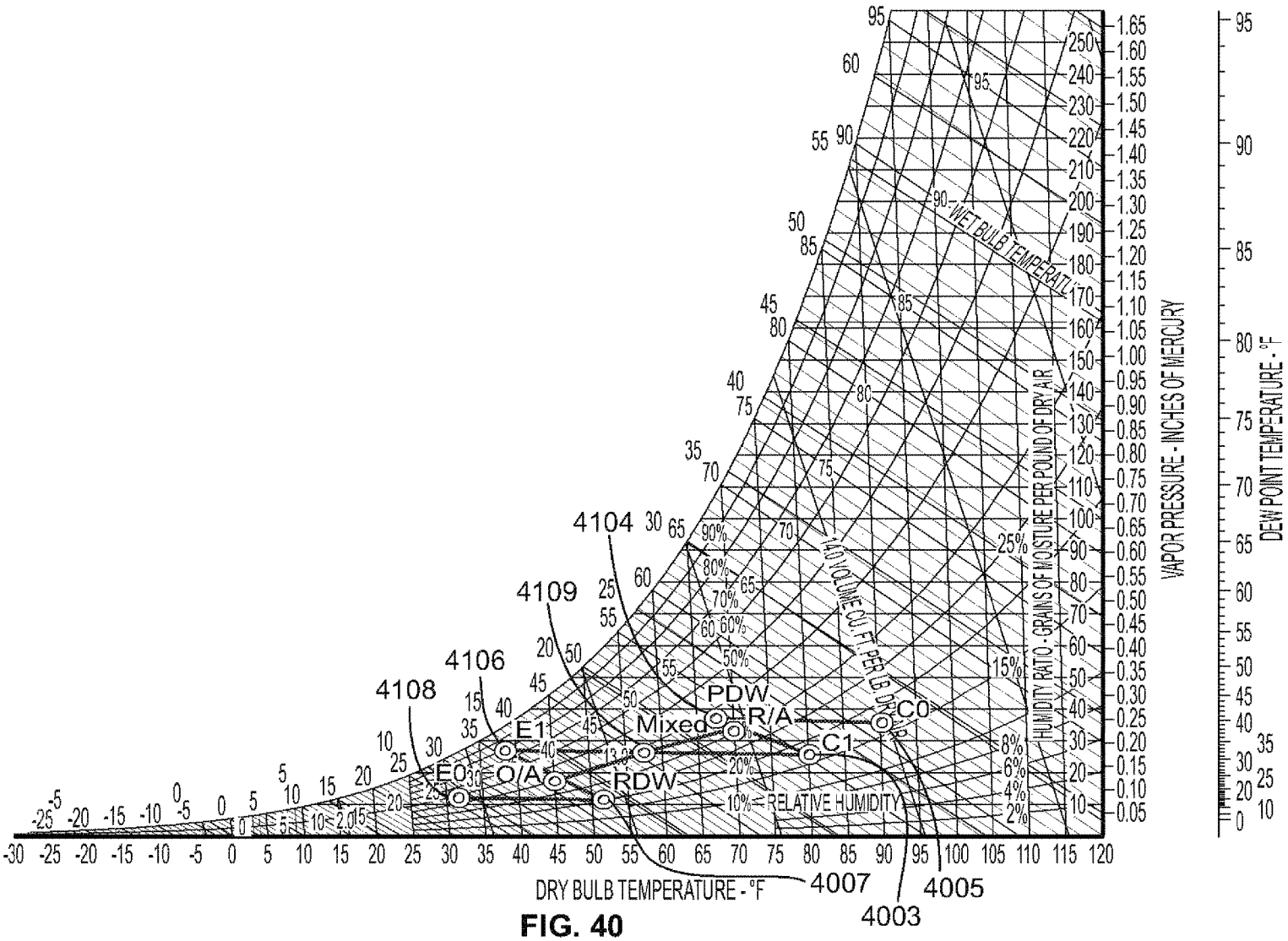
FIG. 40 is a psychrometric chart of the supply air and regeneration air of a heat pump system operating in a winter mode.

FIG. 40 illustrates the system 1100 in the winter mode when using 50% return air and 50% outside air as the mixed entering supply air while the system is configured to perform pre-heating, humidification and post-sensible heating. In this configuration, the outside air inlet 1137 is open, the return air outlet 1130 is closed, the mixing box damper 1135 is half open, the mixing box damper 1185 is half open and the outside air inlet 1103 is open such that both the supply air and the regeneration is comprised of 50% return air and 50% outside air. Once the desired portions of outside and return air are mixed at the mixing boxes, the mixed air has the conditions denoted at data point 4009 (dry bulb temperature of 57° F., wet bulb temperature of 45° F. and relative humidity 37%). As the supply air passes through the active supply air heat exchanger 1120, the humidity and temperature of the air is changed to data point 4003 (dry bulb temperature of 80° F., wet bulb temperature of 55° F. and 17% relative humidity), and as the air passes through the processing module 1122, the air conditions are adjusted to data point 4004 (dry bulb temperature of 68° F., wet bulb temperature of 53° F. and 36% relative humidity). As the air passes through the active supply air heat exchanger 1180, the conditions are further changed to data point 4005 and supplied to the controlled space (dry bulb temperature of 90° F., wet bulb temperature of 61° F. and relative humidity 17%). The heat exchanger 1180 performs sensible heating. The regeneration air is also illustrated in FIG. 40, where the mixed regeneration air at data point 4009 with a dry bulb temperature of 57° F., a wet bulb temperature of approximately 45° F. and a relative humidity of approximately 37%. As the regeneration air passes through the active regeneration air heat exchanger 1142, the humidity and temperature of the regeneration air is changed to data point 4006 (dry bulb temperature of 38° F., wet bulb temperature of 35° F. and 70% relative humidity), and as the air passes through the processing module 1122, the air conditions are adjusted to data point 4007 (dry bulb temperature of 51° F., wet bulb temperature of 38° F. and 24% relative humidity). As the air passes through the second active regeneration air heat exchanger 1162, the conditions are further changed to data point 4008 and discharges to ambient (dry bulb temperature of 32° F., wet bulb temperature of 26° F. and relative humidity 50%). Because the refrigeration system 1144 includes heat exchanger switches 1190 and 1192 that control the flow of refrigerant independently to the regeneration air heat exchangers 1142 and 1162 this improved the performance of the processing module 1122 to absorb moisture and heat the regeneration air stream thus substantially improving the performance of the refrigeration system 1144 because the suction pressures are higher, improving the coefficient of performance (COP) of the system. Additionally the processing module offsets humidification load requirement in the space.

Figure 41:
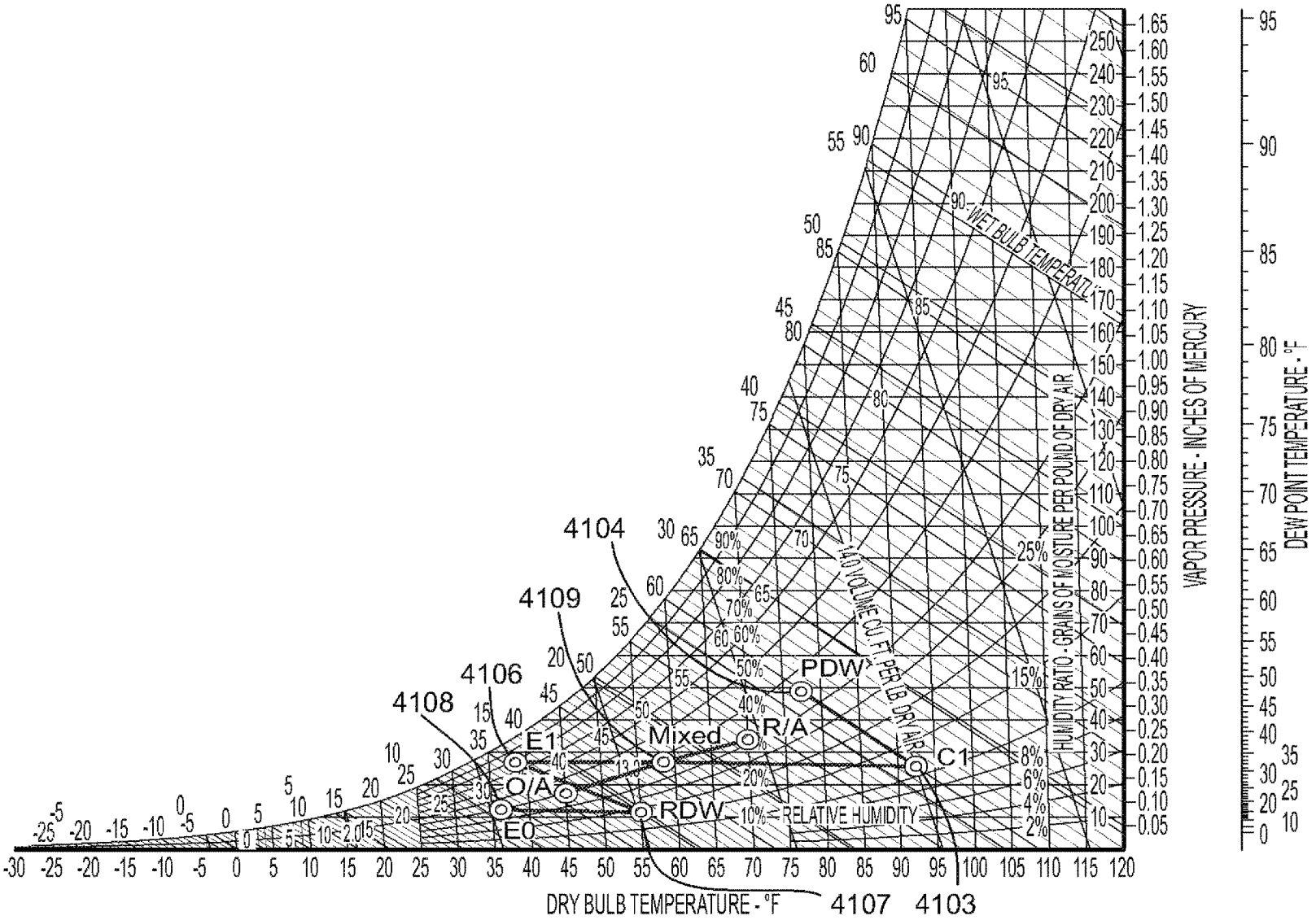
FIG. 41 is a psychrometric chart of the supply air and regeneration air of a heat pump system operating in a winter mode.

FIG. 41 illustrates the system 1100 in the winter mode when using 50% return air and 50% outside air as the mixed entering supply air while the system is configured to perform pre-heating, humidification and no post-sensible heating. In this configuration, the outside air inlet 1137 is open, the return air outlet 1130 is closed, the mixing box damper 1135 is half open, the mixing box damper 1185 is half open and the outside air inlet 1103 is open such that both the supply air and the regeneration is comprised of 50% return air and 50% outside air. Once the desired portions of outside and return air are mixed at the mixing boxes, the mixed air has the conditions denoted at data point 4109 (dry bulb temperature of 57° F., wet bulb temperature of 45° F. and relative humidity 37%). As the supply air passes through the active supply air heat exchanger 1120, the humidity and temperature of the air is changed to data point 4103 (dry bulb temperature of 92° F., wet bulb temperature of 60° F. and 12% relative humidity), and as the air passes through the processing module 1122, the air conditions are adjusted to data point 4104 (dry bulb temperature of 77° F., wet bulb temperature of 52° F. and 28% relative humidity). As the air passes through the inactive supply air heat exchanger 1180, the supply air conditions are unchanged. The regeneration air is also illustrated in FIG. 41, where the mixed regeneration air at data point 4109 with a dry bulb temperature of 57° F., a wet bulb temperature of approximately 45° F. and a relative humidity of approximately 37%. As the regeneration air passes through the active regeneration air heat exchanger 1142, the humidity and temperature of the regeneration air is changed to data point 4106 (dry bulb temperature of 38° F., wet bulb temperature of 35° F. and 70% relative humidity), and as the air passes through the processing module 1122, the air conditions are adjusted to data point 4107 (dry bulb temperature of 55° F., wet bulb temperature of 39° F. and 17% relative humidity). As the air passes through the second active regeneration air heat exchanger 1162, the conditions are further changed to data point 4108 and discharges to ambient (dry bulb temperature of 36° F., wet bulb temperature of 28° F. and relative humidity 38%). Because the refrigeration system 1144 includes heat exchanger switches 1190 and 1192 that control the flow of refrigerant independently to the regeneration air heat exchangers 1142 and 1162 this improved the performance of the processing module 1122 to absorb moisture and heat the regeneration air stream thus substantially improving the performance of the refrigeration system 1144 because the suction pressures are higher, improving the coefficient of performance (COP) of the system. Additionally the processing module offsets humidification load requirement in the space. Furthermore, because the refrigeration system 1144 includes heat exchanger switches 1174 and 1176 that control the flow of refrigerant independently to the supply air heat exchangers 1120 and 1180 this allows to the system to control the space sensible load independently from the latent load.

Figure 42:
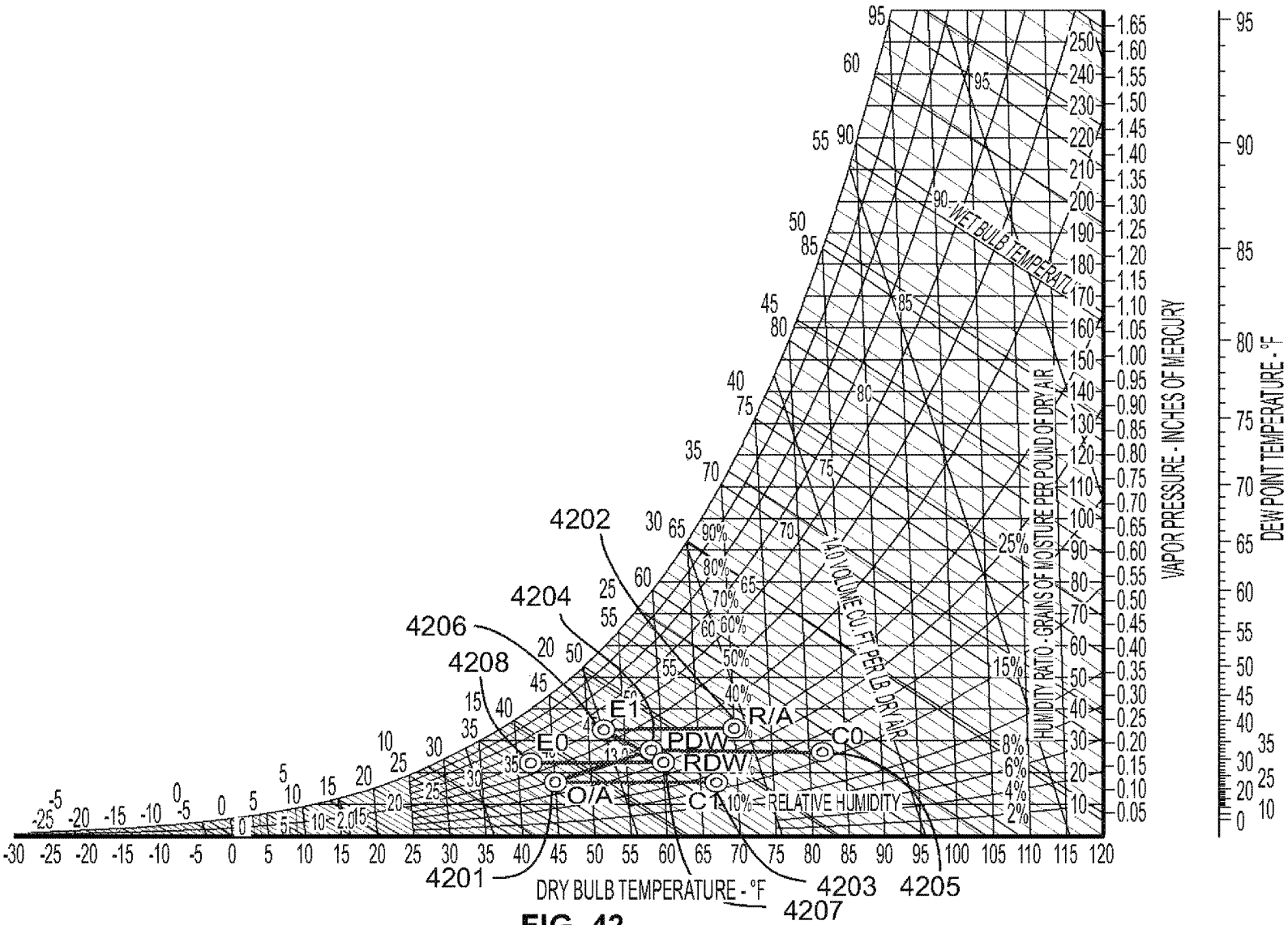
FIG. 42 is a psychrometric chart of the supply air and regeneration air of a heat pump system operating in a winter mode.

FIG. 42 illustrates the system 1100 in the winter mode when using 100% outside air as the entering supply air while configured to perform pre-heating, humidification and post-sensible heating. In this configuration, the outside air inlet 1137 is open, the return air outlet 1130 is close, the mixing box damper 1135 is close, the mixing box damper 1185 is close and the outside air inlet 1103 is close such that all the outside air through supply air inlet 1137 provides all of the supply air. Correspondingly the entering regeneration air is comprised of 100% return air. FIG. 42 illustrates outside air at data point 4201 with a dry bulb temperature of 45° F., a wet bulb temperature of approximately 36° F. and a relative humidity of approximately 40%. As the supply air passes through the active supply air heat exchanger 1120, the humidity and temperature of the outside air is changed to data point 4203 (dry bulb temperature of 67° F., wet bulb temperature of 48° F. and 18% relative humidity), and as the air passes through the processing module 1122, the air conditions are adjusted to data point 4204 (dry bulb temperature of 59° F., wet bulb temperature of 47° F. and 38% relative humidity). As the air passes through the active supply air heat exchanger 1180, the conditions are further changed to data point 4205 and supplied to the controlled space (dry bulb temperature of 82° F., wet bulb temperature of 56° F. and relative humidity 17%). The heat exchanger 1180 performs post sensible heating. The regeneration air is also illustrated in FIG. 42, where return air at data point 4202 with a dry bulb temperature of 70° F., a wet bulb temperature of approximately 53° F. and a relative humidity of approximately 30%. As the regeneration air passes through the active regeneration air heat exchanger 1142, the humidity and temperature of the regeneration air is changed to data point 4206 (dry bulb temperature of 52° F., wet bulb temperature of 45° F. and 58% relative humidity), and as the air passes through the processing module 1122, the air conditions are adjusted to data point 4207 (dry bulb temperature of 60° F., wet bulb temperature of 45° F. and 30% relative humidity). As the air passes through the second active regeneration air heat exchanger 1162, the conditions are further changed to data point 4208 and discharges to ambient (dry bulb temperature of 41° F., wet bulb temperature of 36° F. and relative humidity 60%). Because the refrigeration system 1144 includes heat exchanger switches 1190 and 1192 that control the flow of refrigerant independently to the regeneration air heat exchangers 1142 and 1162 this improved the performance of the processing module 1122 to absorb moisture and heat the regeneration air stream thus substantially improving the performance of the refrigeration system 1144 because the suction pressures are higher, improving the coefficient of performance (COP) of the system. Additionally the processing module offsets humidification load requirement in the space. Furthermore, the system utilizes return air from the space to regenerate the processing module improving yet further the overall performance of system 1100.

Figure 43:
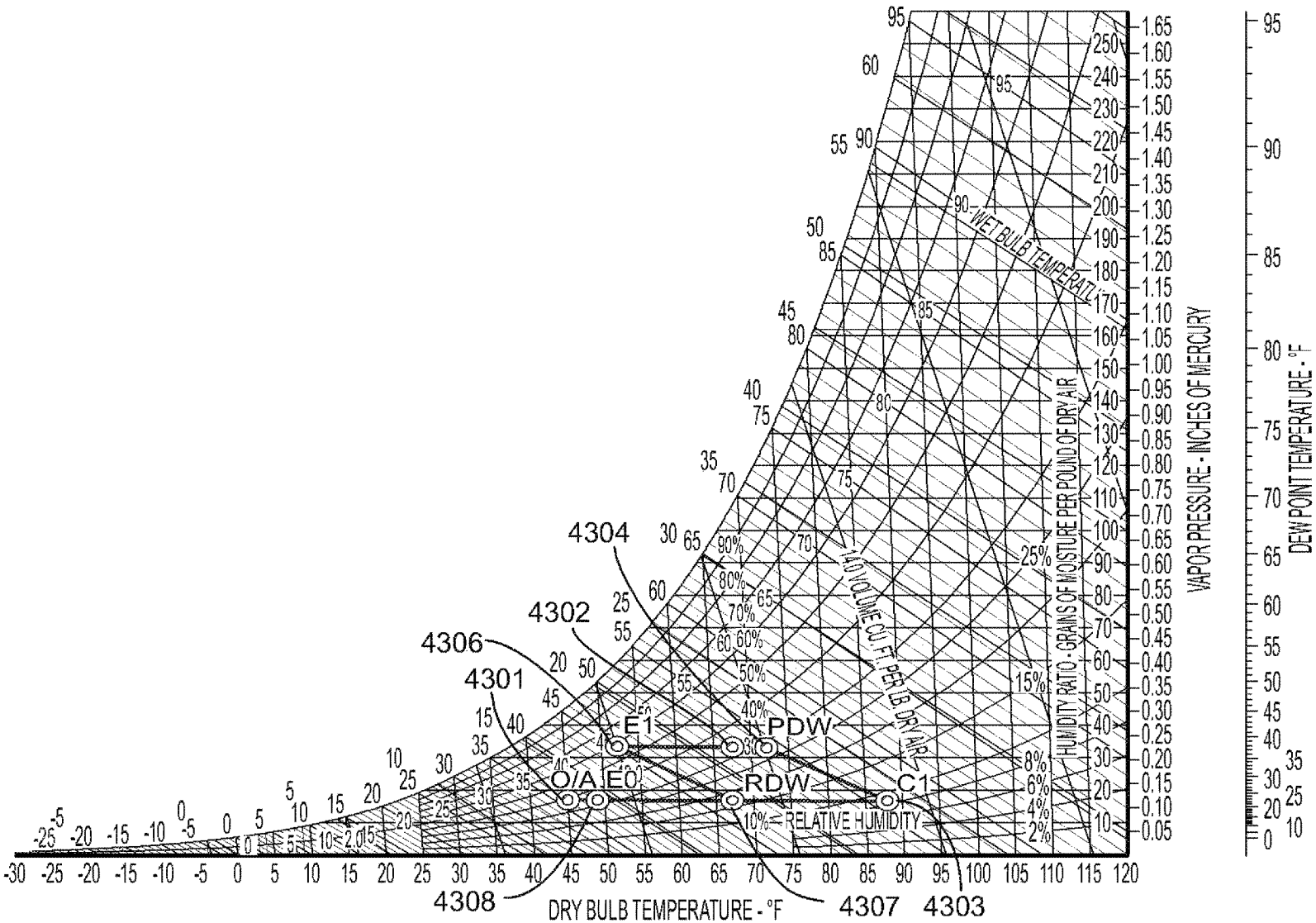
FIG. 43 is a psychrometric chart of the supply air and regeneration air of a heat pump system operating in a winter mode.

FIG. 43 illustrates the system 1100 in the winter mode when using 100% outside air as the entering supply air while configured to perform pre-heating, humidification and no post-sensible heating. In this configuration, the outside air inlet 1137 is open, the return air outlet 1130 is close, the mixing box damper 1135 is close, the mixing box damper 1185 is close and the outside air inlet 1103 is close such that all the outside air through supply air inlet 1137 provides all of the supply air. Correspondingly the entering regeneration air is comprised of 100% return air. FIG. 43 illustrates outside air at data point 4301 with a dry bulb temperature of 45° F., a wet bulb temperature of approximately 36° F. and a relative humidity of approximately 40%. As the supply air passes through the active supply air heat exchanger 1120, the humidity and temperature of the outside air is changed to data point 4303 (dry bulb temperature of 88° F., wet bulb temperature of 56° F. and 9% relative humidity), and as the air passes through the processing module 1122, the air conditions are adjusted to data point 4304 (dry bulb temperature of 73° F., wet bulb temperature of 54° F. and 28% relative humidity). As the air passes through the inactive supply air heat exchanger 1180, the supply air conditions are unchanged. The heat exchanger 1180 performs no post sensible heating. The regeneration air is also illustrated in FIG. 43, where return air at data point 4302 with a dry bulb temperature of 70° F., a wet bulb temperature of approximately 53° F. and a relative humidity of approximately 30%. As the regeneration air passes through the active regeneration air heat exchanger 1142, the humidity and temperature of the regeneration air is changed to data point 4306 (dry bulb temperature of 52° F., wet bulb temperature of 45° F. and 58% relative humidity), and as the air passes through the processing module 1122, the air conditions are adjusted to data point 4307 (dry bulb temperature of 66° F., wet bulb temperature of 47° F. and 18% relative humidity). As the air passes through the second active regeneration air heat exchanger 1162, the conditions are further changed to data point 4308 and discharges to ambient (dry bulb temperature of 48° F., wet bulb temperature of 37° F. and relative humidity 35%). Because the refrigeration system 1144 includes heat exchanger switches 1190 and 1192 that control the flow of refrigerant independently to the regeneration air heat exchangers 1142 and 1162 this improved the performance of the processing module 1122 to absorb moisture and heat the regeneration air stream thus substantially improving the performance of the refrigeration system 1144 because the suction pressures are higher, improving the coefficient of performance (COP) of the system. Additionally the processing module offsets humidification load requirement in the space. Additionally, because the refrigeration system 1144 includes heat exchanger switches 1174 and 1176 that control the flow of refrigerant independently to the supply air heat exchangers 1120 and 1180 this allows to the system to control the space sensible load independently from the latent load. Furthermore, the system utilizes return air from the space to regenerate the processing module improving yet further the overall performance of system 1100.

In one embodiment, the heat pump system 1100 senses a condition of at least one of the supply air or return air from the space to control an output of at least one of the supply air heat exchangers 1120 and/or 1180, the supply heat exchanger switches 1174 and/or 1176, the regeneration air heat exchangers 1142 and/or 1162, the regeneration heat exchanger switches 1190 and/or 1192, the processing module 1122, the mixing boxes 1135 and/or 1185 to achieve a pre-determined dehumidification in the summer mode and pre-determined humidification in a winter mode.

In another embodiment, the heat pump system 1100 senses a condition of at least one of the supply air or return air from the space to control an output of at least one of the supply air heat exchangers 1120 and/or 1180, the supply heat exchanger switches 1174 and/or 1176, the regeneration air heat exchangers 1142 and/or 1162, the regeneration heat exchanger switches 1190 and/or 1192, the processing module 1122, the mixing boxes 1135 and/or 1185 to achieve a pre-determined performance of the system 1100.

In another embodiment, the heat pump system 1100 senses a condition of at least one of the supply air or return air from the space to control an output of at least one of the supply air heat exchangers 1120 and/or 1180, the supply heat exchanger switches 1174 and/or 1176, the regeneration air heat exchangers 1142 and/or 1162, the regeneration heat exchanger switches 1190 and/or 1192, the processing module 1122, the mixing boxes 1135 and/or 1185 to limit frost formation in the regeneration air heat exchangers 1142 and/or 1162 in the winter mode.

In another embodiment, the heat pump system 1100 senses a condition of at least one of a supply air stream or a return air stream to control the output of at least one of a single compressor or variable compressor to limit frost formation in the regeneration heat exchangers 1142 and/or 1162 in winter mode.

In another embodiment, the heat pump system 1100 senses a condition of at least one of a supply air stream or a return air stream to control the output of at least one of a single compressor or variable compressor to achieve a pre-determined performance of the system 1100.

In another embodiment, the heat pump system 1100 is used for conditioning air supplied to a space. The system includes conditioning supply air with a processing module. The system also includes at least one of heating or cooling the air prior to or after the processing module with one or more supply air heat exchangers in flow communication with the processing module. The system 1100 also includes at least one heat exchanger switch in flow communication with the supply air heat exchangers that is fluidly coupled to a refrigerant system and a control system that allows the space sensible load and latent load to be maintained independently.

In another embodiment, the heat pump system 1100 described herein utilizes a plurality of heat exchangers and a refrigeration system in both summer and winter modes for energy recovery. The embodiment further utilizes a plurality of heat exchanger switches to control the flow of cold and hot refrigerant in the refrigeration system. Additionally, as the return air is dehumidified by the processing module, the dry bulb temperature of the return air is increased which increases the efficiency of the heat pump. The evaporator can then run at lower temperatures without freezing the evaporator fins. In winter mode the energy in the return air is used in the reverse air source heat pump cycle.

In another embodiment, the heat pump system 1100 described herein, supply air is humidified by the processing module to reduce humidification load requirements and energy consumption for the buildings in the winter mode. The embodiments also provide an efficient air source heat pump for winter heating in lieu of electric, gas, HW, or stream. The return air also provides stable and optimum regenerative air temperatures and conditions for the processing module reactivation in both the summer and winter mode.

Figure 44:
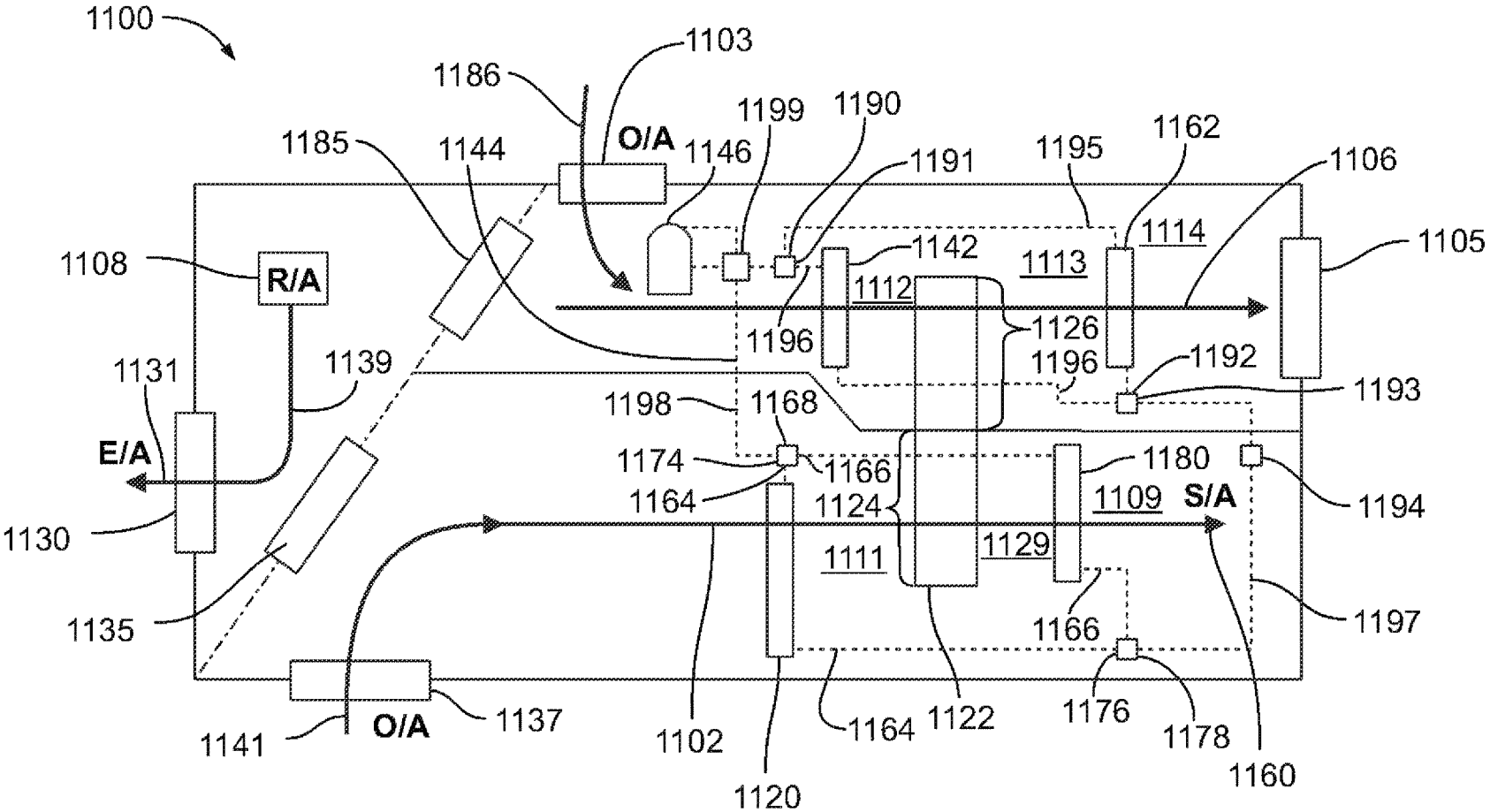
FIG. 44 is a schematic view of another heat pump system formed in accordance with an embodiment.

FIG. 44 is a schematic view of an alternative embodiment of the heat pump system 1100. In FIG. 31, the return air flow path 1139 is configured to flow in either one of or both mixing box dampers 1135 and/or 1185 depending on the different operation mode of system 1100 to form the portion of the return air flow path 1133. In FIG. 44, the portion return air flow paths 1133 are none existent. Accordingly, the return air flow path 1139 is configured to flow completely through the return air opening 1130 forming the exhaust air flow path 1131. In FIG. 31, the mixing box damper 1135 and/or mixing box damper 1185 can be open, whereas in FIG. 44 both the mixing box dampers 1135 and 1185 are closed. In FIG. 44, both the outside air inlet 1137 and outside air inlet 1103 are fully open providing 100% outside air to both the supply air flow path 1102 and the regeneration air flow path 1106. Providing 100% outside air to both the supply air flow path 1102 and the regeneration air flow path 1106 may improve the transfer of heat and moisture between the supply air side 1124 and the regeneration air side 1126 of the processing module 1122. Additionally, providing 100% outside air to both the supply air flow path 1102 and the regeneration air flow path 1106 may improve the coefficient of performance (COP) of the system as the suction pressure may be increased and the discharge pressure may be decreased. Furthermore, because the refrigeration system 1144 includes and switch 1199, heat exchanger switches 1174, 1176, 1190 and 1192 that are all in flow communication with compressor 1146 as well as heat exchangers 1120, 1180, 1142 and 1162 positioned on the upstream side and downstream side of the processing module 1122 also in flow communication with compressor 1146 the overall system 1100 can be controlled very efficiently to maintain building heating, cooling, humidification and dehumidification loads through the year. While it is preferred in most instances to include a return air flow path, it is also understood that system 1100 in FIG. 44 may not contain a return air inlet 1108, return air flow path 1139, a return air outlet 1130, an exhaust air flow path 1131 and mixing boxes 1135 and 1185 and system 1100 would still function as described herein.

Figure 45:
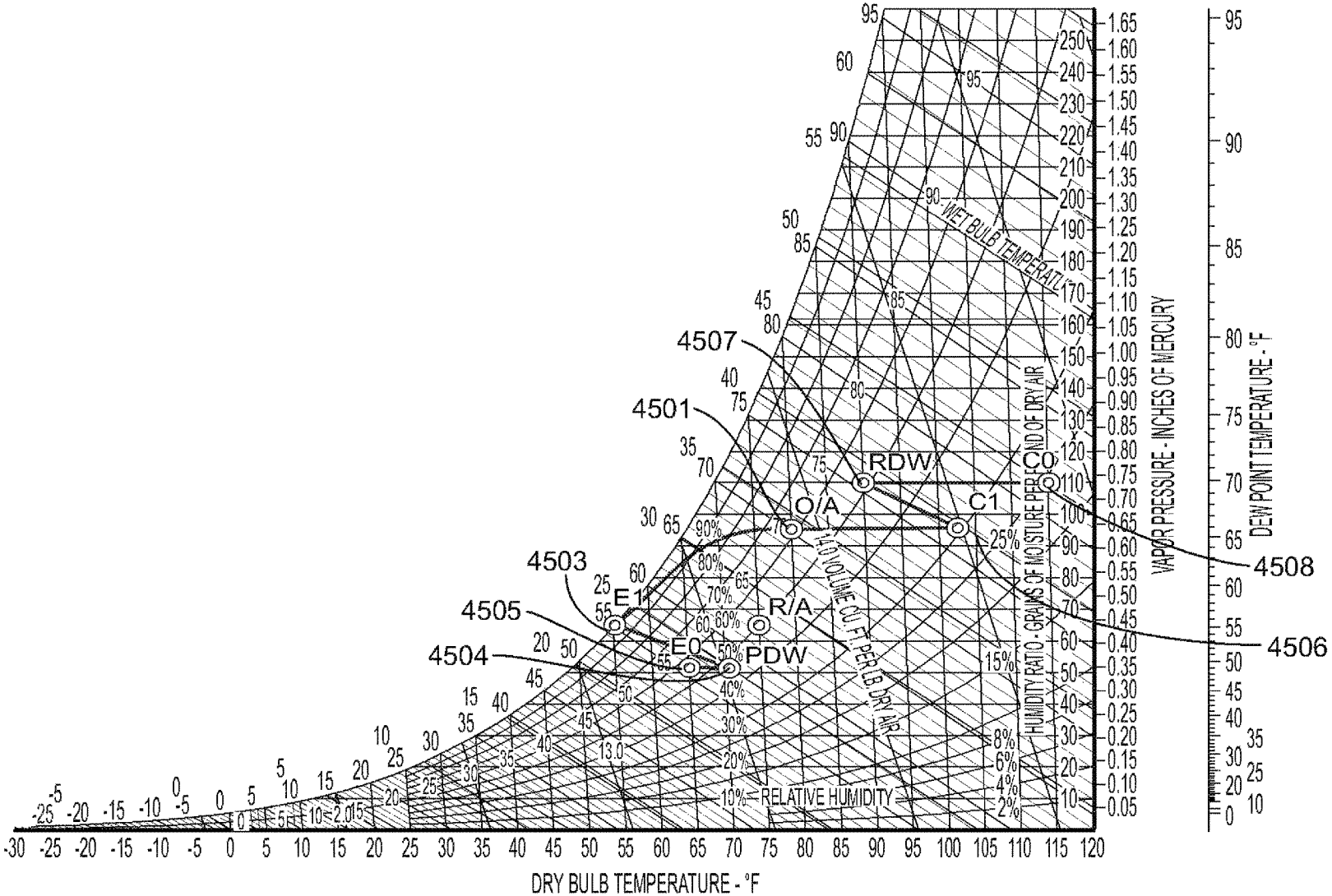
FIG. 45 is a psychrometric chart of the supply air and regeneration air of a heat pump system operating in a summer mode.

FIGS. 45-48 illustrates psychrometric charts for the system 1100 when operating in various configurations. FIGS. 45-48 illustrate exemplary data point's representative of the air condition when passing between designated regions within system 1100. FIG. 45 illustrates the system 1100 in the summer mode when using 100% outside air as the entering supply air while configured to perform pre-cooling, dehumidification and sensible cooling. In this configuration, the outside air inlet 1137 is open, the return air outlet 1130 is open, the mixing box damper 1135 is close, the mixing box damper 1185 is closed and the outside air inlet 1103 is open such that all the outside air through outside air inlet 1137 provides all of the supply air and all the outside air through outside air inlet 1103 provides all of the regeneration air. FIG. 45 illustrates outside air at data point 4501 with a dry bulb temperature of 80° F., a wet bulb temperature of approximately 70° F. and a relative humidity of approximately 60%. As the supply air passes through the active supply air heat exchanger 1120, the humidity and temperature of the outside air is changed to data point 4503 (dry bulb temperature of 56° F., wet bulb temperature of 56° F. and 100% relative humidity), and as the air passes through the processing module 1122, the air conditions are adjusted to data point 4504 (dry bulb temperature of 71° F., wet bulb temperature of 58° F. and 47% relative humidity). As the air passes through the active supply air heat exchanger 1180, the conditions are further changed to data point 4505 and supplied to the controlled space (dry bulb temperature of 65° F., wet bulb temperature of 56° F. and relative humidity 56%). The heat exchanger 1180 performs sensible cooling only without changing the humidity of the supply air. The regeneration air is also illustrated in FIG. 45, where outside air at data point 4501 with a dry bulb temperature of 80° F., a wet bulb temperature of approximately 70° F. and a relative humidity of approximately 60%. As the regeneration air passes through the active regeneration air heat exchanger 1142, the humidity and temperature of the regeneration air is changed to data point 4506 (dry bulb temperature of 103° F., wet bulb temperature of 76° F. and 30% relative humidity), and as the air passes through the processing module 1122, the air conditions are adjusted to data point 4507 (dry bulb temperature of 88° F., wet bulb temperature of 75° F. and 53% relative humidity). As the air passes through the second active regeneration air heat exchanger 1162, the conditions are further changed to data point 4508 and discharges to ambient (dry bulb temperature of 115° F., wet bulb temperature of 81.5° F. and relative humidity 24%). Because the heat absorbed in the refrigeration system is released in two separate condenser coils, with the second condenser coil located after the processing module 1122 where the temperature is reduced this substantially improves the performance of the refrigeration system 1144 because operation discharge pressures are lowered. Furthermore, since the supply heat exchanger 1180 is active the sensible load and latent load of the space can be maintained independently.

Figure 46:
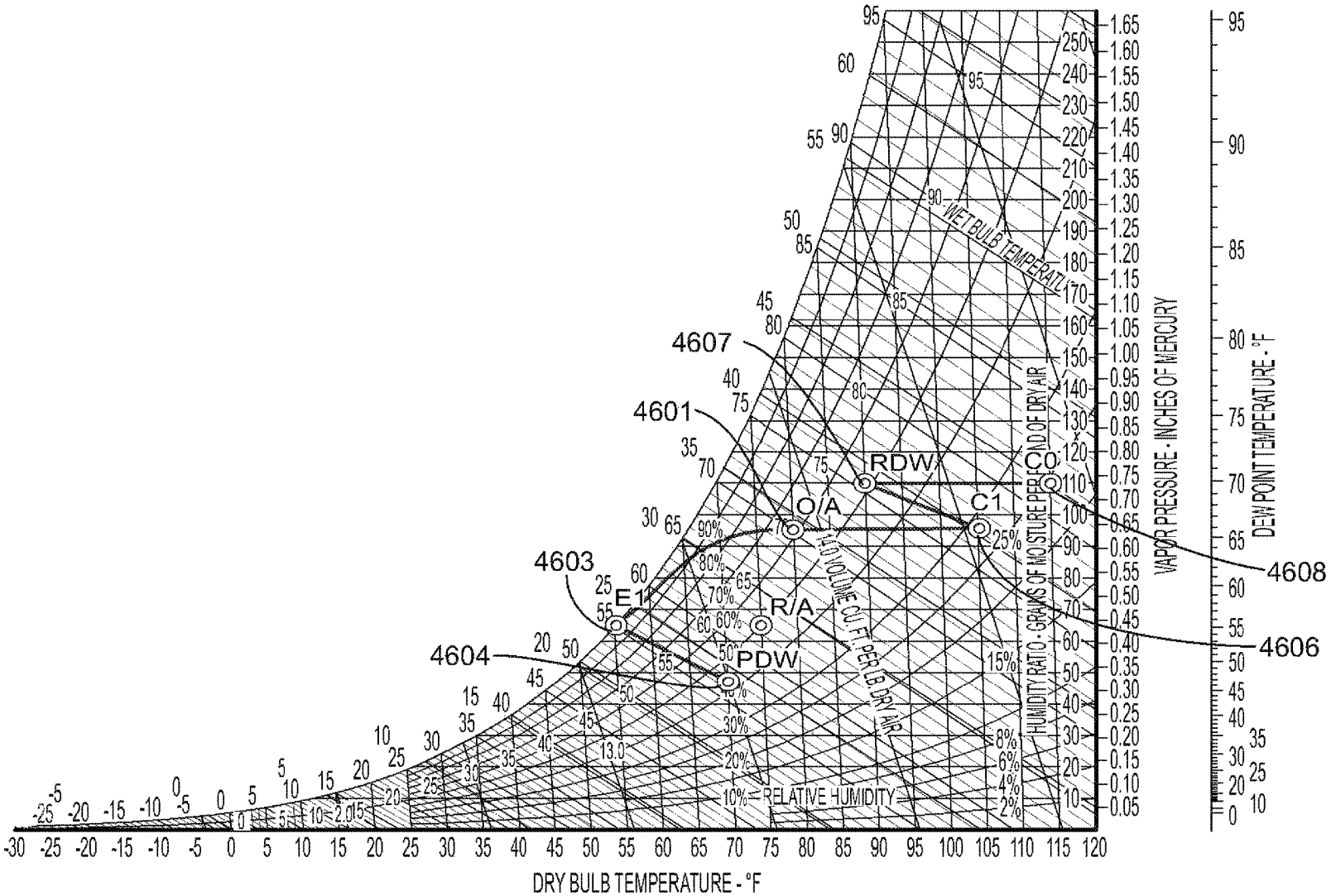
FIG. 46 is a psychrometric chart of the supply air and regeneration air of a heat pump system operating in a summer mode.

FIG. 46 illustrates the system 1100 in the summer mode when using 100% outside air as the entering supply air while configured to perform pre-cooling, dehumidification and no post-sensible cooling. In this configuration, the outside air inlet 1137 is open, the return air outlet 1130 is open, the mixing box damper 1135 is close, the mixing box damper 1185 is closed and the outside air inlet 1103 is open such that all the outside air through outside air inlet 1137 provides all of the supply air and all the outside air through outside air inlet 1103 provides all of the regeneration air. FIG. 46 illustrates outside air at data point 4601 with a dry bulb temperature of 80° F., a wet bulb temperature of approximately 70° F. and a relative humidity of approximately 60%. As the supply air passes through the active supply air heat exchanger 1120, the humidity and temperature of the outside air is changed to data point 4603 (dry bulb temperature of 55° F., wet bulb temperature of 55° F. and 100% relative humidity), and as the air passes through the processing module 1122, the air conditions are adjusted to data point 4604 (dry bulb temperature of 70° F., wet bulb temperature of 57° F. and 43% relative humidity). As the air passes through the inactive supply air heat exchanger 1180, the supply air conditions are unchanged. The regeneration air is also illustrated in FIG. 46, where outside air at data point 4601 with a dry bulb temperature of 80° F., a wet bulb temperature of approximately 70° F. and a relative humidity of approximately 60%. As the regeneration air passes through the active regeneration air heat exchanger 1142, the humidity and temperature of the regeneration air is changed to data point 4606 (dry bulb temperature of 105° F., wet bulb temperature of 77° F. and 28% relative humidity), and as the air passes through the processing module 1122, the air conditions are adjusted to data point 4607 (dry bulb temperature of 89° F., wet bulb temperature of 75° F. and 52% relative humidity). As the air passes through the second active regeneration air heat exchanger 1162, the conditions are further changed to data point 4608 and discharges to ambient (dry bulb temperature of 115° F., wet bulb temperature of 81.5° F. and relative humidity 24%). Because the heat absorbed in the refrigeration system is released in two separate condenser coils, with the second condenser coil located after the processing module 1122 where the temperature is reduced this substantially improves the performance of the refrigeration system 1144 because operation discharge pressures are lowered. Furthermore, since the supply heat exchanger 1180 is inactive the sensible load and latent load of the space can be maintained independently.

Figure 47:
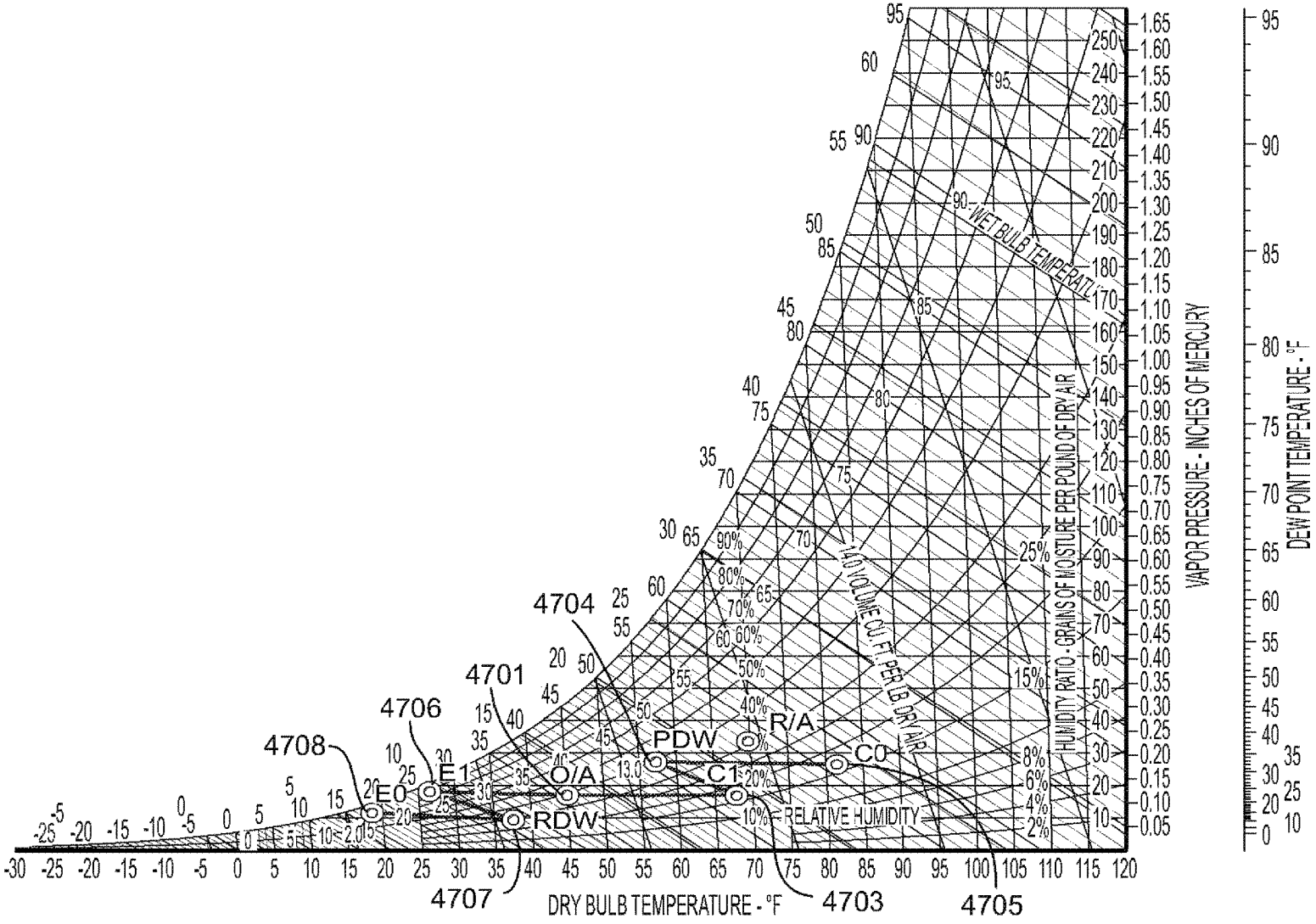
FIG. 47 is a psychrometric chart of the supply air and regeneration air of a heat pump system operating in a winter mode.

FIG. 47 illustrates the system 1100 in the winter mode when using 100% outside air as the entering supply air while configured to perform pre-heating, humidification and post-sensible heating. In this configuration, the outside air inlet 1137 is open, the return air outlet 1130 is open, the mixing box damper 1135 is close, the mixing box damper 1185 is closed and the outside air inlet 1103 is open such that all the outside air through outside air inlet 1137 provides all of the supply air and all the outside air through outside air inlet 1103 provides all of the regeneration air. FIG. 47 illustrates outside air at data point 4701 with a dry bulb temperature of 45° F., a wet bulb temperature of approximately 36° F. and a relative humidity of approximately 40%. As the supply air passes through the active supply air heat exchanger 1120, the humidity and temperature of the outside air is changed to data point 4703 (dry bulb temperature of 68° F., wet bulb temperature of 48° F. and 18% relative humidity), and as the air passes through the processing module 1122, the air conditions are adjusted to data point 4704 (dry bulb temperature of 57° F., wet bulb temperature of 46° F. and 40% relative humidity). As the air passes through the active supply air heat exchanger 1180, the conditions are further changed to data point 4705 and supplied to the controlled space (dry bulb temperature of 81° F., wet bulb temperature of 56° F. and relative humidity 18%). The heat exchanger 1180 performs post sensible heating. The regeneration air is also illustrated in FIG. 47, where outside air at data point 4701 with a dry bulb temperature of 45° F., a wet bulb temperature of approximately 36° F. and a relative humidity of approximately 40%. As the regeneration air passes through the active regeneration air heat exchanger 1142, the humidity and temperature of the regeneration air is changed to data point 4706 (dry bulb temperature of 26° F., wet bulb temperature of 25° F. and 85% relative humidity), and as the air passes through the processing module 1122, the air conditions are adjusted to data point 4707 (dry bulb temperature of 37° F., wet bulb temperature of 29° F. and 35% relative humidity). As the air passes through the second active regeneration air heat exchanger 1162, the conditions are further changed to data point 4708 and discharges to ambient (dry bulb temperature of 18° F., wet bulb temperature of 17° F. and relative humidity 90%). Because the refrigeration system 1144 includes heat exchanger switches 1190 and 1192 that control the flow of refrigerant independently to the regeneration air heat exchangers 1142 and 1162 this improved the performance of the processing module 1122 to absorb moisture and heat the regeneration air stream thus substantially improving the performance of the refrigeration system 1144 because the suction pressures are higher, improving the coefficient of performance (COP) of the system. Additionally the processing module offsets humidification load requirement in the space. Furthermore, because the refrigeration system 1144 includes heat exchanger switches 1174 and 1176 that control the flow of refrigerant independently to the supply air heat exchangers 1120 and 1180 the sensible load and latent load of the space can be maintained independently.

Figure 48:
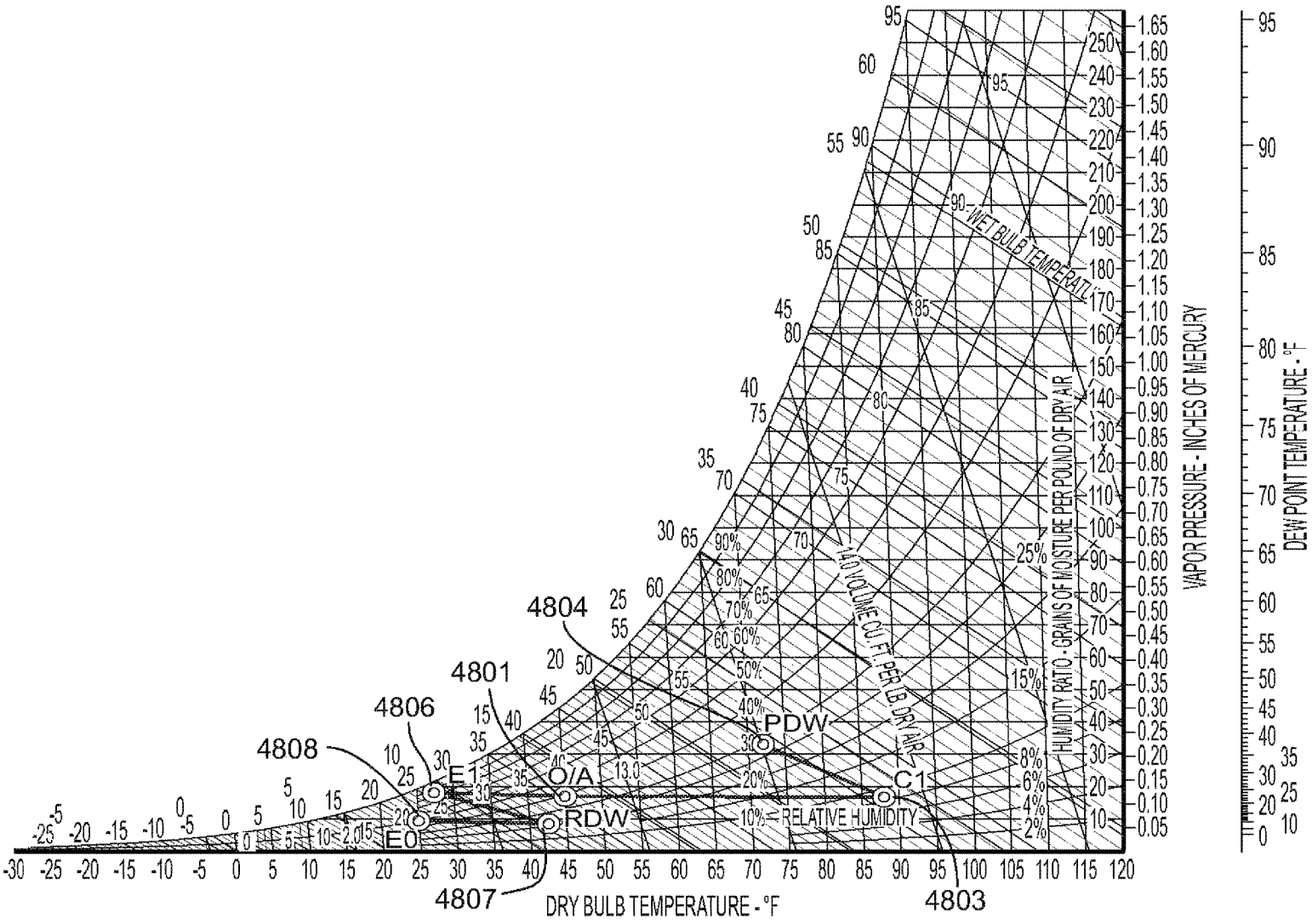
FIG. 48 is a psychrometric chart of the supply air and regeneration air of a heat pump system operating in a winter mode.

FIG. 48 illustrates the system 1100 in the winter mode when using 100% outside air as the entering supply air while configured to perform pre-heating, humidification and no post-sensible heating. In this configuration, the outside air inlet 1137 is open, the return air outlet 1130 is open, the mixing box damper 1135 is close, the mixing box damper 1185 is closed and the outside air inlet 1103 is open such that all the outside air through outside air inlet 1137 provides all of the supply air and all the outside air through outside air inlet 1103 provides all of the regeneration air. FIG. 48 illustrates outside air at data point 4801 with a dry bulb temperature of 45° F., a wet bulb temperature of approximately 36° F. and a relative humidity of approximately 40%. As the supply air passes through the active supply air heat exchanger 1120, the humidity and temperature of the outside air is changed to data point 4803 (dry bulb temperature of 88° F., wet bulb temperature of 56° F. and 9% relative humidity), and as the air passes through the processing module 1122, the air conditions are adjusted to data point 4804 (dry bulb temperature of 72° F., wet bulb temperature of 54° F. and 28% relative humidity). As the air passes through the inactive supply air heat exchanger 1180, the supply air conditions are unchanged. The heat exchanger 1180 performs no post-sensible heating. The regeneration air is also illustrated in FIG. 48, where outside air at data point 4801 with a dry bulb temperature of 45° F., a wet bulb temperature of approximately 36° F. and a relative humidity of approximately 40%. As the regeneration air passes through the active regeneration air heat exchanger 1142, the humidity and temperature of the regeneration air is changed to data point 4806 (dry bulb temperature of 26° F., wet bulb temperature of 25° F. and 85% relative humidity), and as the air passes through the processing module 1122, the air conditions are adjusted to data point 4807 (dry bulb temperature of 43° F., wet bulb temperature of 30° F. and 22% relative humidity). As the air passes through the second active regeneration air heat exchanger 1162, the conditions are further changed to data point 4808 and discharges to ambient (dry bulb temperature of 24° F., wet bulb temperature of 19° F. and relative humidity 50%). Because the refrigeration system 1144 includes heat exchanger switches 1190 and 1192 that control the flow of refrigerant independently to the regeneration air heat exchangers 1142 and 1162 this improved the performance of the processing module 1122 to absorb moisture and heat the regeneration air stream thus substantially improving the performance of the refrigeration system 1144 because the suction pressures are higher, improving the coefficient of performance (COP) of the system. Additionally the processing module offsets humidification load requirement in the space. Furthermore, because the refrigeration system 1144 includes heat exchanger switches 1174 and 1176 that control the flow of refrigerant independently to the supply air heat exchangers 1120 and 1180 the sensible load and latent load of the space can be maintained independently.

In one embodiment, the heat pump system 1100 senses a condition of at least one of the supply air or regeneration air to control an output of at least one of the supply air heat exchangers 1120 and/or 1180, the supply heat exchanger switches 1174 and/or 1176, the regeneration air heat exchangers 1142 and/or 1162, the regeneration heat exchanger switches 1190 and/or 1192, the processing module 1122, to achieve a pre-determined dehumidification in the summer mode and pre-determined humidification in a winter mode.

In another embodiment, the heat pump system 1100 senses a condition of at least one of the supply air or regeneration air to control an output of at least one of the supply air heat exchangers 1120 and/or 1180, the supply heat exchanger switches 1174 and/or 1176, the regeneration air heat exchangers 1142 and/or 1162, the regeneration heat exchanger switches 1190 and/or 1192, the processing module 1122, to achieve a pre-determined performance of the system 1100.

In another embodiment, the heat pump system 1100 senses a condition of at least one of the supply air or regeneration air to control an output of at least one of the supply air heat exchangers 1120 and/or 1180, the supply heat exchanger switches 1174 and/or 1176, the regeneration air heat exchangers 1142 and/or 1162, the regeneration heat exchanger switches 1190 and/or 1192, the processing module 1122, to limit frost formation in the regeneration air heat exchangers 1142 and/or 1162 in the winter mode.

In another embodiment, the heat pump system 1100 is used for conditioning air supplied to a space. The system includes conditioning supply air with a processing module using only outside air. The system also includes at least one of heating or cooling the air prior to or after the processing module with one or more supply air heat exchangers in flow communication with the processing module. The system 1100 also includes at least one heat exchanger switch in flow communication with the supply air heat exchangers that is fluidly coupled to a refrigerant system and a control system that allows the space sensible load and latent load to be maintained independently.

In another embodiment, the heat pump system 1100 described herein utilizes a plurality of heat exchangers and a refrigeration system in both summer and winter modes for energy recovery. The embodiment further utilizes a plurality of heat exchanger switches to control the flow of cold and hot refrigerant in the refrigeration system. Additionally, as the outside air is dehumidified by the processing module, the dry bulb temperature of the outside air is increased which increases the efficiency of the heat pump. The evaporator can then run at lower temperatures without freezing the evaporator fins. In winter mode the energy in the outside air is used in the reverse air source heat pump cycle.

In another embodiment, the system 1100 may include at least one fan to draw air into and move air through the supply air flow path 1102. Outside air flows through the supply air inlet 1137 and through supply heat exchanger 1120, a pre-processing module 1122 positioned downstream of the supply air inlet 1137.

In another embodiment additional compressors, additional refrigerant systems, pre-cooling, pre-heating supply heat exchangers and energy recovery devices (not shown) can be added to system 1100 further performance of the system.

In another embodiment, the heat pump system 1100 described herein, supply air is humidified by the processing module to reduce humidification load requirements and energy consumption for the buildings in the winter mode while using only outside air. The embodiments also provide an efficient air source heat pump for winter heating in lieu of electric, gas, HW, or stream.

Figure 49:
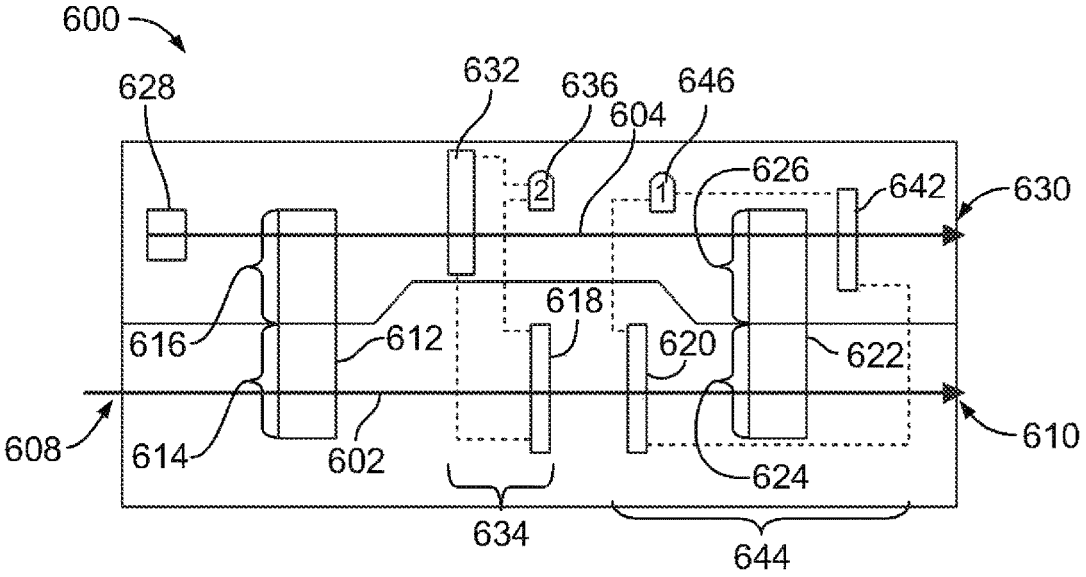
FIG. 49 is a schematic view of another heat pump system formed in accordance with an embodiment.

FIG. 49 is a schematic view of another heat pump system 600 formed in accordance with an embodiment capable of operating in a summer mode or a winter mode.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A heat pump system for conditioning air supplied to a space, the system configured to operate in both a summer mode and a winter mode, the system comprising:

a return air path including a return air inlet and a return air outlet downstream of the return air inlet, the return air path receiving return air at the return air inlet and delivering conditioned return air to the return air outlet;

a supply air path including a supply air inlet and a supply air outlet connected to the space and downstream of the supply air inlet, the supply air path receiving one or more of return air and outside air at the supply air inlet and delivering conditioned supply air to the supply air outlet;

a supply air heat exchanger that operates as an evaporator coil in the summer mode and as a condenser coil in the winter mode, wherein the supply air heat exchanger is disposed within the supply air flow path;

a regeneration air heat exchanger that operates as a condenser coil in the summer mode and an evaporator coil in the winter mode, wherein the regeneration air heat exchanger is disposed within the return air flow path; and a processing module in flow communication with the supply air heat exchanger and the regeneration air heat exchanger to condition the supply air using return air, wherein the processing module includes a supply portion disposed in the supply air flow path downstream of the supply air heat exchanger, and includes a regeneration portion disposed in the return air flow path downstream of the regeneration air heat exchanger.

2. The heat pump system of claim 1 further comprising:

a control system configured to sense a condition of a supply air stream, and control an output of at least one of the processing module, a single compressor, multiple compressors or a variable compressor to achieve a predetermined dehumidification in the summer mode and predetermined humidification in the winter mode.

3. The heat pump system of claim 1 further comprising:

a control system configured to control an output of at least one of the processing module, a single compressor, multiple compressors or a variable compressor to achieve a predetermined performance in both the summer mode and the winter mode.

4. The heat pump system of claim 1 further comprising a heat exchanger switch in flow communication with both the supply and regeneration air heat exchangers that is fluidly coupled to a refrigerant system.

5. The heat pump system of claim 4 further comprising a control system that allows a space sensible load and a latent load to be maintained independently.

6. The heat pump system of claim 1, wherein the air supplied to the space is at least one of outside air or return air.

7. The heat pump system of claim 1, wherein the regeneration air heat exchanger is configured to receive regeneration air, wherein the regeneration air is at least one of outside air or return air.

8. The heat pump system of claim 7, wherein moisture is transferred between the air supplied to the space and the regeneration air through the processing module.

9. The heat pump system of claim 7 wherein one or both of the supply air heat exchanger and the processing module is configured to transfer heat between the air supplied to the space and the regeneration air.

10. The heat pump system of claim 1 further comprising a control system that allows a space sensible load and a latent load to he maintained independently.

11. The heat pump system of claim 1 further comprising a control system to limit frost formation in the processing module and or the heat exchanger in the winter mode.

12. The heat pump system of claim 1 further comprising a control system to limit frost formation in the processing module and or the supply or regeneration air heat exchangers in the winter mode.

13. The heat pump system of claim 1 further comprising a switch in flow communication with the supply air heat exchanger that is fluidly coupled to a refrigerant system.

14. The heat pump system of claim 13 further comprising:

a control system configured to sense a condition of at least one of a supply air stream or a regeneration air stream, and control an output of at least one of the processing module, the supply air heat exchanger, the heat exchanger switch, a single compressor, multiple compressors, or a variable compressor to achieve a predetermined performance in both the summer mode and the winter mode.

15. The heat pump system of claim 13, wherein the system senses a condition of at least one of a supply air stream or a regeneration air stream to control an output of the supply air heat exchanger switch to achieve a predetermined amount of at least one of moisture transfer, heat transfer or limit frost formation in at least one of the processing module or the supply air heat exchanger.

16. The heat pump system of claim 1 further comprising an additional supply air heat exchanger located downstream from the processing module, and wherein the supply air heat exchanger is located upstream from the processing module.

17. The heat pump system of claim 16 further comprising a heat exchanger switch to control the flow of refrigerant in the supply air heat exchanger and the additional supply air heat exchanger.

18. The heat pump system of claim 17, wherein the system senses a condition of at least one of a supply air stream or a regeneration air stream to control an output of at least one of the heat exchanger switch to achieve a predetermined amount of at least one of moisture transfer, heat transfer or limit frost formation in at least one of the processing module or the supply air and additional supply air heat exchangers.

19. The heat pump system of claim 1 further comprising a heat exchanger switch to control flow of refrigerant in the supply and regeneration air heat exchangers.

20. The heat pump system of claim 19, wherein the system senses a condition of at least one of a supply air stream or a regeneration air stream to control an output of at least one of a heat exchanger switch to achieve a predetermined amount of at least one of moisture transfer, heat transfer or limit frost formation in at least one of the processing module or heat exchangers.

21. The heat pump system of claim 1 further comprising a damper to change the flow of return air between the air supplied to the space and a regeneration air stream.

22. The heat pump system of claim 21 further comprising an outside air damper.

23. The heat pump system of claim 1 further comprising at least one heat exchanger switch to control the flow of cold and hot refrigerant in the refrigeration system.

24. The heat pump system of claim 1 further comprising a control system that allows a space sensible load and a latent load to be maintained independently.

25. The heat pump system of claim 1 further comprising a control system to limit frost formation in the processing module and or the supply air heat exchanger in the winter mode.

26. The heat pump system of claim 1 further comprising:

a control system configured to sense a condition of at least one of a supply air stream or a regeneration air stream, and control an output of at least one of the processing module, the supply air heat exchanger, a heat exchanger switch, a single compressor, multiple compressors or a variable compressor to achieve a predetermined performance in both the summer mode and winter mode.

27. The heat pump system of claim 1, wherein the system senses a condition of at least one of a supply air stream or a regeneration air stream to control an output of at least one of a heat exchanger switch to achieve a predetermined amount of at least one of moisture transfer, heat transfer or limit frost formation in at least one of the processing module, the supply air heat exchanger, or the regeneration air heat exchanger.

28. The heat pump system of claim 1 further comprising a mixing damper and control system to mix both outside air and return air in a pre-determined amount to optimize performance of the system.

29. The heat pump system of claim 1, wherein the processing module comprises one or more of a desiccant wheel or liquid desiccant system configured to remove or transfer moisture from the air.

30. The heat pump system of claim 1, further comprising a pre-processing module having a first portion disposed within the supply air flow path and a second portion disposed in the return air flow path, wherein the supply air heat exchanger is disposed within the supply air flow path between the first portion of the pre-processing module and the first portion of the processing module, and wherein the regeneration heat exchanger is disposed within the return air flow path between the second portion of the pre-processing module and the second portion of the processing module.

31. The heat pump system of claim 30, wherein the pre-processing module comprises one or more of an enthalpy wheel, a fixed enthalpy plate, or an enthalpy pump.

32. The heat pump system of claim 1, wherein the supply air flow path includes a supply air inlet that receives outside air, and a supply air outlet that delivers conditioned air to the space.

33. The heat pump system of claim 32, wherein the return air flow path includes a return air inlet that receives return air from the space, and a return air outlet that exhausts the return air outside of the space.

34. The heat pump system of claim 1, further comprising a damper to change a direction of flow of return air between a first condition and a second condition, the regeneration heat exchanger upstream of the regeneration portion of the processing module in the first condition, and the regeneration heat exchanger downstream of the regeneration portion of the processing module in the second condition, wherein the regeneration air heat exchanger conditions air received from the regeneration portion of the processing module to create conditioned return air for delivery to the space in the second condition.

35. A humidifying and dehumidifying heat pump system operable in a summer mode and a winter mode, the heat pump system comprising:

a return air path comprising:
- a return air inlet; and
- a return air outlet downstream of the return air inlet, the return air path receiving return air at the return air inlet and delivering conditioned return air to the return air outlet;

a supply air path comprising:
- a supply air inlet; and
- a supply air outlet connected to the space and downstream of the supply air inlet, the supply air path receiving one or more of return air and outside air at the supply air inlet and delivering conditioned supply air to the supply air outlet;

a supply heat exchanger located in the supply air flow path and operable as an evaporator in the summer mode and a condenser in the winter mode;

a regeneration heat exchanger located in the return air flow path and operable as a condenser coil in the summer mode and an evaporator coil in the winter mode;

a processing module configured to condition the supply air downstream of the supply heat exchanger using return air, the processing module comprising:
- a supply processing portion located in the supply air path downstreamof the supply heat exchanger; and
- a return processing portion located in the return air path downstream of the regeneration heat exchanger; and a pre-processing module configured to condition the supply air upstream of the supply heat exchanger using return air, the pre-processing module comprising:
- a supply pre-processing portion located in the supply air path upstream of the supply heat exchanger; and
- a return pre-processing portion located in the return air path upstream of the regeneration heat exchanger.

36. The heat pump system of claim 35, further comprising a control damper to change a direction of flow of return air between a first condition and a second condition, the regeneration heat exchanger upstream of the regeneration portion of the processing module in the first condition, and the regeneration heat exchanger downstream of the regeneration portion of the processing module in the second condition, wherein the regeneration air heat exchanger conditions air received from the regeneration portion of the processing module to create conditioned return air for delivery to the space in the second condition.

37. The heat pump system of claim 35, further comprising a recirculation damper to change a direction of flow of return air between a third condition and a fourth condition, the recirculation damper to deliver conditioned air from the processing module upstream of the regeneration air heat exchanger in the third condition, and the recirculation damper configured to force conditioned air from the processing module to the return air outlet in the fourth condition.

* * * * *